US005813333A

United States Patent [19]

Ohno

[11] Patent Number: 5,813,333

[45] Date of Patent: Sep. 29, 1998

[54] AUTOMATIC REGISTER CONTROL SYSTEM FOR MULTI-COLOR ROTARY PRESSES, AND APPARATUS AND METHOD FOR DETECTING REGISTERING ERRORS

[75] Inventor: Kinichiro Ohno, Machida, Japan

[73] Assignee: Tokyo Kikai Seisakusho, Ltd., Tokyo, Japan

[21] Appl. No.: 510,610

[22] Filed: Aug. 3, 1995

[30] Foreign Application Priority Data

| | | | |
|---|---|---|---|
| Aug. 8, 1994 | [JP] | Japan | 6-185657 |
| Aug. 16, 1994 | [JP] | Japan | 6-192410 |
| Aug. 16, 1994 | [JP] | Japan | 6-192411 |

[51] Int. Cl.[6] ..... B41F 7/04; B41F 5/08; B41F 5/16

[52] U.S. Cl. ..... 101/181; 101/486

[58] Field of Search ..... 101/181, 211, 101/183, 483, 484, 485, 486, 177; 250/559.01, 559.04, 548, 549, 559.39, 554, 557; 364/469, 470, 471, 526, 469.04, 469.01, 469.03; 226/2, 24, 27–32, 34, 38, 40–42; 382/112, 162; 356/429

[56] References Cited

U.S. PATENT DOCUMENTS

| | | | |
|---|---|---|---|
| 4,641,244 | 2/1987 | Wilson et al. | 364/475 |
| 5,056,430 | 10/1991 | Bayeriein et al. | 101/211 |

FOREIGN PATENT DOCUMENTS

| | | |
|---|---|---|
| 58-217362 | 12/1983 | Japan . |
| 62-231755 | 10/1987 | Japan . |
| 62-234934 | 10/1987 | Japan . |
| 63-22651 | 1/1988 | Japan . |

*Primary Examiner*—J. Reed Fisher
*Attorney, Agent, or Firm*—McGlew and Tuttle

[57] ABSTRACT

An automatic register control system for multi-color rotary presses having adjusting means for adjusting the phase on a plate cylinder of each printing section, comprising a registering error detecting device that reads register marks each printed on a traveling paper web by each printing section with a CCD camera as image data, corrects the image data using inherent correcting means, and detects the characteristic points of the register marks as their coordinates to detect a deviation between the actual coordinates of the detected characteristic points and the desired coordinates thereof, and adjusting signal output means for outputting an adjusting signal to the adjusting means to adjust the phase of the plate cylinder in each printing section on the basis of the deviation detected by the registering error detecting device, thereby automatically adjusting registering errors in the multi-color rotary press.

31 Claims, 45 Drawing Sheets

FIG. 14.1
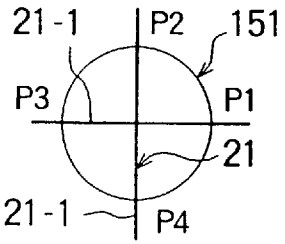
FIG. 14.2
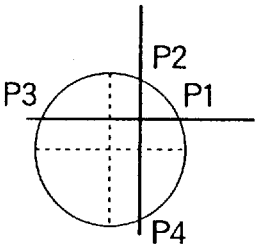
FIG. 14.3
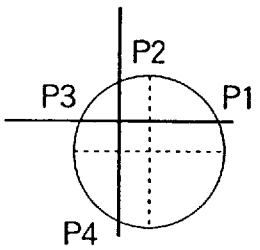
FIG. 14.4
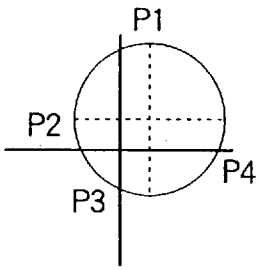
FIG. 14.5
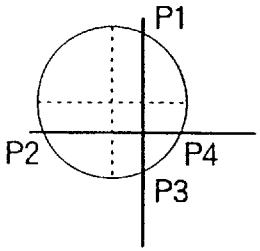
FIG. 14.6
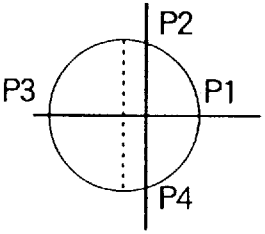
FIG. 14.7
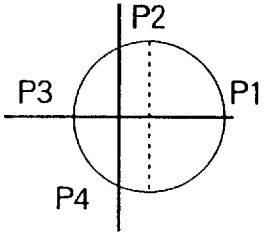
FIG. 14.8
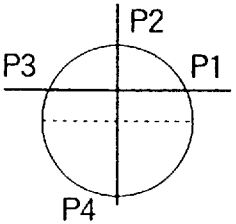
[9]
FIG. 14.9
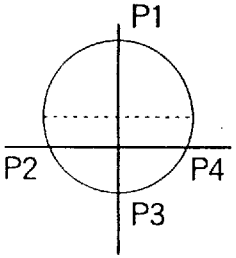

FIG. 15.01
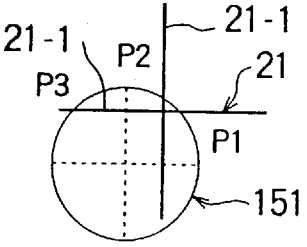
FIG. 15.02
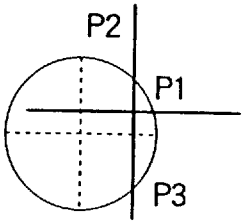
FIG. 15.03
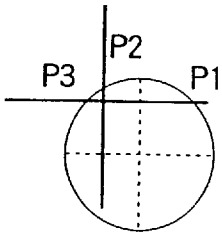
FIG. 15.04
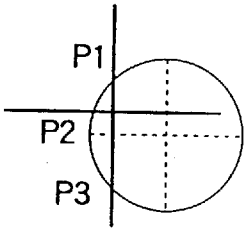
FIG. 15.05
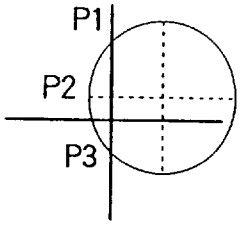
FIG. 15.06
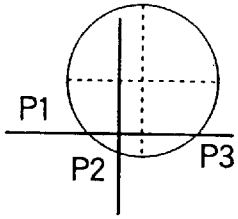
FIG. 15.07
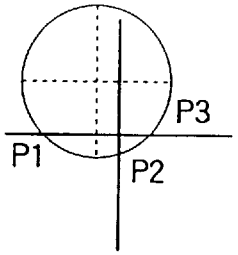
FIG. 15.08
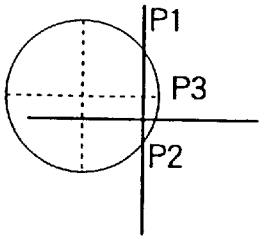
FIG. 15.09
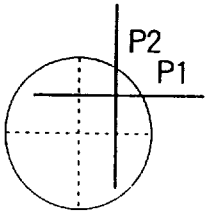
FIG. 15.10
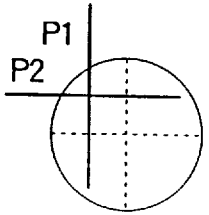
FIG. 15.11
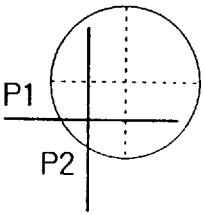
FIG. 15.12
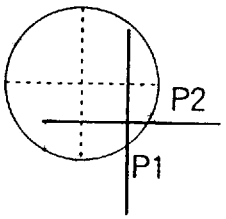

FIG. 25.1
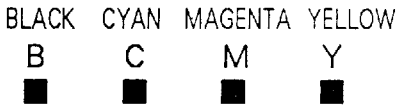
FIG. 25.2
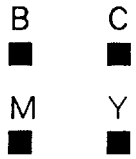
FIG. 25.3
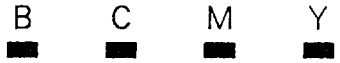
FIG. 25.4
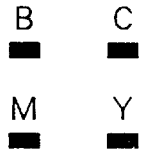
FIG. 25.5
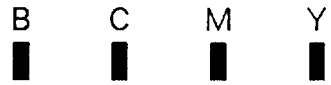
FIG. 25.6
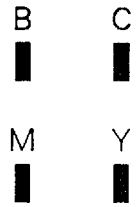

FIG. 30.1

| 8 | 7 | 6 | 5 | 4 | 3 | 2 | 1 |
|---|---|---|---|---|---|---|---|
| 0 | 0 | 0 | 0 | 1 | 0 | 0 | 0 |

FIG. 30.2

| 8 | 7 | 6 | 5 | 4 | 3 | 2 | 1 |
|---|---|---|---|---|---|---|---|
| 0 | 0 | 0 | 1 | 1 | 0 | 0 | 0 |

FIG. 33

H LINE →

V LINE ↓

| | 0 | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 | 0 | 0 |
| 2 | 0 | 0 | 0 | 1 | 1 | 1 | 0 | 0 | 1 | 1 | 1 | 0 | 1 | 1 | 1 | 0 | 0 | 0 |
| 3 | 0 | 0 | 1 | 1 | 1 | 1 | 1 | 1 | 1 | 1 | 1 | 1 | 1 | 1 | 1 | 1 | 0 | 0 |
| 4 | 0 | 0 | 1 | 1 | 1 | 1 | 1 | 1 | 1 | 1 | 1 | 1 | 1 | 1 | 1 | 1 | 0 | 0 |
| 5 | 0 | 0 | 1 | 1 | 1 | 1 | 1 | 1 | 0 | 0 | 1 | 1 | 1 | 1 | 1 | 1 | 0 | 0 |
| 6 | 0 | 0 | 1 | 1 | 1 | 1 | 1 | 1 | 1 | 1 | 1 | 1 | 1 | 1 | 1 | 1 | 0 | 0 |
| 7 | 0 | 0 | 0 | 1 | 1 | 1 | 1 | 0 | 1 | 1 | 1 | 1 | 1 | 1 | 1 | 0 | 0 | 0 |
| 8 | 0 | 0 | 1 | 1 | 1 | 1 | 1 | 1 | 1 | 1 | 1 | 1 | 1 | 1 | 1 | 1 | 0 | 0 |
| 9 | 0 | 0 | 1 | 1 | 1 | 1 | 1 | 1 | 1 | 1 | 1 | 1 | 1 | 1 | 1 | 1 | 0 | 0 |
| 10 | 0 | 0 | 1 | 1 | 1 | 1 | 1 | 0 | 1 | 0 | 1 | 1 | 1 | 1 | 1 | 1 | 0 | 0 |
| 11 | 0 | 0 | 0 | 1 | 1 | 1 | 1 | 1 | 1 | 1 | 1 | 1 | 1 | 1 | 1 | 0 | 0 | 0 |
| 12 | 0 | 0 | 0 | 1 | 1 | 1 | 1 | 1 | 1 | 1 | 1 | 1 | 1 | 1 | 1 | 0 | 0 | 0 |
| 13 | 0 | 0 | 1 | 1 | 1 | 1 | 1 | 1 | 1 | 1 | 1 | 1 | 1 | 1 | 1 | 1 | 0 | 0 |
| 14 | 0 | 0 | 1 | 1 | 1 | 1 | 1 | 1 | 1 | 1 | 1 | 1 | 1 | 1 | 1 | 1 | 0 | 0 |
| 15 | 0 | 0 | 0 | 1 | 1 | 0 | 1 | 1 | 1 | 1 | 0 | 0 | 1 | 1 | 1 | 0 | 0 | 0 |
| 16 | 0 | 0 | 0 | 0 | 0 | 0 | 0 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 | 0 | 0 | 0 | 0 | 0 | 0 | 0 |

FIG. 34

| *1 | |
|---|---|
| 1 | × |
| ① | 1 |

| *2 | |
|---|---|
| × | 1 |
| 1 | ① |

| *3 | |
|---|---|
| 1 | 1 |
| ① | × |

| *4 | |
|---|---|
| 1 | 1 |
| × | ① |

FIG. 35

| | 17 | 16 | 15 | 14 | 13 | 12 | 11 | 10 | 9 | 8 | 7 | 6 | 5 | 4 | 3 | 2 | 1 | 0 | |
|---|---|---|---|---|---|---|---|---|---|---|---|---|---|---|---|---|---|---|---|
| | | | *2 | | | | *2 | | | *1 | | *2 | | | *1 | | | | |
| 2 | 0 | 0 | 0 | 1 | 1 | 1 | 0 | 1 | 1 | 1 | 0 | 0 | 1 | 1 | 1 | 0 | 0 | 0 | → |
| 3 | 0 | 0 | 1 | 1 | 1 | 1 | 1 | 1 | 1 | 1 | 1 | 1 | 1 | 1 | 1 | 1 | 0 | 0 | → |
| | | | | | | | | *3 | | *4 | | | | | | | | | |
| 4 | 0 | 0 | 1 | 1 | 1 | 1 | 1 | 1 | 1 | 1 | 1 | 1 | 1 | 1 | 1 | 1 | 0 | 0 | → |
| 5 | 0 | 0 | 1 | 1 | 1 | 1 | 1 | 1 | 0 | 0 | 1 | 1 | 1 | 1 | 1 | 1 | 0 | 0 | → |
| | | | *4 | | | | | | | *3 | | | | | *3 | | | | |
| 6 | 0 | 0 | 1 | 1 | 1 | 1 | 1 | 1 | 1 | 1 | 1 | 1 | 1 | 1 | 1 | 1 | 0 | 0 | → |
| 7 | 0 | 0 | 0 | 1 | 1 | 1 | 1 | 1 | 1 | 1 | 0 | 1 | 1 | 1 | 1 | 0 | 0 | 0 | → |
| | | | *4 | | | | | *2 | | *2 | | | | | *3 | | | | |
| 10 | 0 | 0 | 1 | 1 | 1 | 1 | 1 | 0 | 1 | 0 | 1 | 1 | 1 | 1 | 1 | 1 | 0 | 0 | → |
| 11 | 0 | 0 | 0 | 1 | 1 | 1 | 1 | 1 | 1 | 1 | 1 | 1 | 1 | 1 | 1 | 0 | 0 | 0 | → |
| | | | *2 | | | | | | | | | | | | *1 | | | | |
| 12 | 0 | 0 | 0 | 1 | 1 | 1 | 1 | 1 | 1 | 1 | 1 | 1 | 1 | 1 | 1 | 0 | 0 | 0 | → |
| 13 | 0 | 0 | 1 | 1 | 1 | 1 | 1 | 1 | 1 | 1 | 1 | 1 | 1 | 1 | 1 | 1 | 0 | 0 | → |
| | | | *4 | | | *3 | | *4 | | | | | *4 | | *3 | | | | |
| 14 | 0 | 0 | 1 | 1 | 1 | 1 | 1 | 1 | 1 | 1 | 1 | 1 | 1 | 1 | 1 | 0 | 0 | 0 | → |
| 15 | 0 | 0 | 0 | 1 | 1 | 1 | 0 | 0 | 1 | 1 | 1 | 1 | 0 | 1 | 1 | 0 | 0 | 0 | → |

FIG. 37

| | | | | | | | | | | | |
|---|---|---|---|---|---|---|---|---|---|---|---|
| PRECEDING | 1 | 1 | 1 | ① | ① | 0 | 0 | ① | ① | 1 | → |
| SUCCEEDING | 1 | 1 | 0 | ① | ① | 1 | 1 | ① | ① | 0 | → |

FIG. 41

| X COORDINATES | | TOTAL OF X-COORDINATE ADDRESSES | TOTAL OF PICTURE ELEMENTS |
|---|---|---|---|
| V3 | 5+6+7+8+9+10+11+12+13+14+15 | =110 | 11 |
| V4 | 5+6+7+8+9+10+11+12+13+14+15 | =110 | 11 |
| V5 | 5+6+7+8+9+10+11+12+13+14+15 | =110 | 11 |
| V6 | 5+6+7+8+9+10+11+12+13+14+15 | =110 | 11 |
| V7 | 5+6+7+8+9+10+11+12+13+14+15 | =110 | 11 |
| V8 | 5+6+7+8+9+10+11+12+13+14+15 | =121 | 11 |
| V9 | 6+7+8+9+10+11+12+13+14+15+16 | =121 | 11 |
| V10 | 6+7+8+9+10+11+12+13+14+15+16 | =121 | 11 |
| V11 | 6+7+8+9+10+11+12+13+14+15+16 | =121 | 11 |
| V12 | 6+7+8+9+10+11+12+13+14+15+16 | =121 | 11 |
| V13 | 6+7+8+9+10+11+12+13+14+15+16 | =121 | 11 |
| V14 | 6+7+8+9+10+11+12+13+14+15+16 | =121 | 11 |
| V15 | 6+7+8+9+10+11+12+13+14+15+16 | =121 | 11 |
| V16 | 9+10+11+12+13+14+15+16 | = 91 | 7 |
| | | 1598 | 150 |

$$\text{X COORDINATES} = \frac{1598}{150} = 10.653$$

FIG. 42

| Y COORDINATES | | TOTAL OF Y-COORDINATE ADDRESSES | TOTAL OF PICTURE ELEMENTS |
|---|---|---|---|
| H5 | 3+4+5+6+7+8 | = 33 | 6 |
| H6 | 3+4+5+6+7+8+9+10+11+12+13+14+15 | =117 | 13 |
| H7 | 3+4+5+6+7+8+9+10+11+12+13+14+15 | =117 | 13 |
| H8 | 3+4+5+6+7+8+9+10+11+12+13+14+15 | =117 | 13 |
| H9 | 3+4+5+6+7+8+9+10+11+12+13+14+15 | =117 | 13 |
| H10 | 3+4+5+6+7+8+9+10+11+12+13+14+15+16 | =133 | 14 |
| H11 | 3+4+5+6+7+8+9+10+11+12+13+14+15+16 | =133 | 14 |
| H12 | 3+4+5+6+7+8+9+10+11+12+13+14+15+16 | =133 | 14 |
| H13 | 3+4+5+6+7+8+9+10+11+12+13+14+15+16 | =133 | 14 |
| H14 | 3+4+5+6+7+8+9+10+11+12+13+14+15+16 | =133 | 14 |
| H15 | 3+4+5+6+7+8+9+10+11+12+13+14+15+16 | =133 | 14 |
| H16 | 9+10+11+12+13+14+15+16 | =100 | 8 |
| | | 1399 | 150 |

$$\text{Y COORDINATES} = \frac{1399}{150} = 9.3266$$

AUTOMATIC REGISTER CONTROL SYSTEM FOR MULTI-COLOR ROTARY PRESSES, AND APPARATUS AND METHOD FOR DETECTING REGISTERING ERRORS

BACKGROUND OF THE INVENTION

1. Field of the Invention

This invention relates generally to an automatic register control system for automatically adjusting registering errors in a multi-color rotary press, and more specifically to a method for detecting registering errors of register marks printed by each printing section to ensure exact agreement in the printing position of each color, an apparatus for detecting registering errors, and an automatic register control system for controlling register to eliminate errors in detected register marks.

2. Description of the Prior Art

In a multi-color rotary press, register control is effected to detect errors in the printing position of each color and eliminate such registering errors since a desired color image cannot be accomplished unless exact agreement is reached in the printing position of each color.

As to the method and apparatus for detecting registering errors in multi-color printing, and register control for eliminating the detected registering errors, there are two types; i.e., a type in which register marks printed on paper are detected, and another type in which register marks provided on a printing plate attached to a printing cylinder are detected. As the type in which register marks printed on paper are detected, as employed in the present invention, Japanese Published Unexamined Patent Publication No. Sho-63(1988)-22651, Japanese Published Unexamined Patent Publication No. Sho-62(1987)-234934, Japanese Published Unexamined Patent Publication No. Sho-62 (1987)-231755, Japanese Published Unexamined Patent Publication No. Sho-58(1983)-217362, etc. have been disclosed and publicly known.

The technical contents of Japanese Published Unexamined Patent Publication No. Sho-63(1988)-22651 are concerned with a system in which rhombic marks printed by each printing section are one-dimensionally scanned at a plurality of locations to obtain image data equivalent to substantially two-dimensional scanning; the image data are sequentially stored in a memory, and then the coordinates of the upper and lower vertexes of each mark are calculated and the coordinates of the center of the mark are calculated from the coordinates of the upper and lower vertexes; the calculated center coordinates are compared with the predetermined coordinates that have been stored to calculate registering errors, thereby performing longitudinal and transverse register control to eliminate the registering errors. In the technology, the coordinates of vertexes are determined by averaging the data.

The technical contents of Japanese Published Unexamined Patent Publication No. Sho-62(1987)-234934 relate to a method for detecting longitudinal registering errors in which register marks for each printing section are formed by a pair of triangles having a side orthogonal to the paper web traveling direction and two oblique sides, each arranged in the web traveling direction, the register marks are photoelectrically detected sequentially with a single detector as the paper web travels to obtain the center of each marks and the distance between the reference position and the center; the obtained distance being compared with a predetermined distance to obtain longitudinal registering errors.

The technical contents of Japanese Published Unexamined Patent Publication No. Sho-58(1983)-217362 is concerned with an apparatus for registering in longitudinal, transverse and obliquely inclined directions in which predetermined printing fields on which a plurality of comparison-color lines arranged in parallel so that they are in a predetermined relationship with reference-color lines of a predetermined width arranged in parallel at predetermined intervals are provided separately at a plurality of locations for each comparison colors; each of the printing fields is irradiated with electromagnetic energy (normally visible or infrared or ultraviolet rays) to detect the amount of energy reflected from each printing field to obtain the difference in the ratio of non-printing area among the printing fields. Based on the ratio, registering errors in the direction orthogonal to the above-mentioned lines of each printing field, that is, in the longitudinal or transverse direction are obtained; the difference in the ratio of non-printing areas among the printing fields of the same comparison colors at separated locations is obtained; and the registering errors in the direction oblique to the plate cylinder so that registering in the longitudinal, transverse and obliquely inclined directions is performed to eliminate these obtained registering errors.

These techniques disclosed in the past Japanese Patent Publications have the following shortcomings.

That is, a disadvantage of the technique disclosed in Japanese Published Unexamined Patent Publication No. Sho-63(1988)-22651 is that the registering error detecting accuracy, or registering accuracy, is lowered when printing speed is increased or decreased. That is, this technique involves the process in which one-dimensional scanning using a CCD is started with a signal relating to the phase of the rotation of the plate cylinder; and then the aforementioned scanning is repeated every 26 $\mu$s based on the clock signal; the number of scanning operations is counted while the length of the rotating periphery of the plate cylinder during the scanning is divided by the number of scanning operations to obtain a pitch per scanning; and the pitch value is used to calculate the coordinates of the traveling web in the traveling (longitudinal) direction when the CCD scans and detects the register marks. The result is that in newspaper printing, for example, if printing speed is increased or decreased by 10,000 copies/hour in 1 second, the traveling speed of the paper web is increased or decreased by 760 mm/s, causing a change of approximately 20 $\mu$m in a scanning period of 26 $\mu$s. This means that the above coordinates may become less accurate. lowering the longitudinal registering error detecting accuracy and the registering accuracy.

Although each scanning is carried out one-dimensionally, the amount of image data practically equivalent to that in two-dimensional scanning is acquired by repeating a plurality of scanning operations for each register mark, and calculated to detect registering errors. This requires considerable processing time, increasing a burden on the operating means.

The techniques disclosed in Japanese Published Unexamined Patent Publication Nos. Sho-62(1987)-234934 and Sho-62(1087)-231755 involve rester marks consisting of two triangles. This would inevitably increase the size of register marks, contrary to the customers' needs to use as small register marks as possible to meet the requirement for expanding printing areas. Furthermore, the detecting accuracy cannot be improved without reducing the diameter of the light-beam spot irradiated onto the paper web. That is, the detecting accuracy has to be less than 10 $\mu$m. This could lead to an expensive system.

Moreover, the method involving irradiation of a light beam has to place a photoelectrical device close to the traveling paper web to improve detection accuracy. This would be unfavorable in terms of paper threading and maintenance.

The technique disclosed in Japanese Published Unexamined Patent Publication No. Sho-58(1983)-217362 cannot use in common a set of overprinted parallel lines (register marks) for detecting registering errors in both longitudinal and transverse directions, and therefore has to provide separate printing fields for those register marks. In this sense, this technique is contrary to users' needs, as with the techniques disclosed in Japanese Published Unexamined Patent Publication Nos. Sho-62(1987)-234934 and Sho-62 (1987)-231755.

In addition, this technique is designed to detect registering errors by sensing the amount of reflection of the electromagnetic energy (normally visible, infrared or ultraviolet) that is irradiated on superimposed printing fields. This requires the technique to select the frequency of electromagnetic energy to be used, taking into account the colors to be printed and the back-ground color of a material on which printing is made. In some cases, the technique may involve the use of irradiating means and/or sensing means of electromagnetic energy.

SUMMARY OF THE INVENTION

It is an object of this invention to provide an automatic register control system for multi-color rotary presses in which exact color matching is automatically effected by detecting registering errors based on the image data of register marks printed by each printing section so that proper color overprinting is checked by the exact superimposition of the printing position of each color It is another object of this invention to provide an automatic register control system for multi-color rotary presses in which exact color matching is automatically effected by using register marks having tangible or intangible inherent reference points, and detecting registering errors based on the image data of the register marks by a first registering error detecting method so that proper color overprinting is accomplished by the exact superimposition of the printing position of each color.

It is still another object of this invention to provide an automatic register control system for multi-color rotary presses in which exact color matching is automatically effected by using square or rectangular register marks and detecting registering errors based on the image data of the register marks by a second registering error detecting method so that proper color over-printing is accomplished by the exact superimposition of the printing position of each color.

It is a further object of this invention to provide an automatic register control system for multi-color rotary presses in which exact color matching is effected by using cross-shaped register marks having reference points and detecting registering errors based on the image data of the register marks by a third registering error detecting method so that proper color overprinting is accomplished by the exact superimposition of the printing position of each color.

It is still a further object of this invention to provide an automatic register control method and apparatus for detecting register errors by using register marks having tangible or intangible inherent reference points.

It is still a further object of this invention to provide a method for reading the position of a center line of the lines constituting register marks having tangible or intangible inherent reference points.

It is still a further object of this invention to provide a registering error detecting method and apparatus for detecting registering errors by using square or rectangular register marks.

It is still a further object of this invention to provide a method for correcting errors in reading square or rectangular register marks, and means for correcting the image of read errors.

It is still a further object of this invention to provide a majority logic filter that is suitable for correcting errors in reading square or rectangular register marks.

It is still a further object of this invention to provide a method and apparatus for detecting registering errors by using cross-shaped register marks having reference points.

It is still a further object of this invention to provide a method for correcting errors in reading cross-shaped register marks having reference points, and means for correcting the image of read errors.

It is still a further object of this invention to provide display means for displaying a deviation detected by a registering error detecting apparatus and indicating that the deviation exceeds a predetermined value to an unadjustable extent.

BRIEF DESCRIPTION OF THE DRAWINGS

FIG. 14 is a diagram illustrating the range where the circular CCD sensor captures an image of a register mark.

FIG. 15 is a diagram illustrating the range where the circular CCD sensor captures an image of a register mark.

FIG. 25 is a diagram of assistance in explaining the layout of register marks in this invention.

FIG. 30 is a diagram of assistance in explaining image data containing noise.

FIG. 33 is a diagram of assistance in explaining an example of image data in which a CCD matrix sensor reads a register mark.

FIG. 34 is a diagram of assistance in explaining an image correcting logic filter.

FIG. 35 is a diagram of assistance in explaining image correction in which the logic filter is applied to an image data.

FIG. 37 is a diagram of assistance in explaining an image data which is inputted into the image correcting circuit shown in FIG. 36.

FIG. 41 is a diagram of assistance in explaining the results of detection of X gravity coordinates.

FIG. 42 is a diagram of assistance in explaining the results of detection of Y gravity coordinates.

DETAILED DESCRIPTION OF PREFERRED EMBODIMENTS

Figure 1:
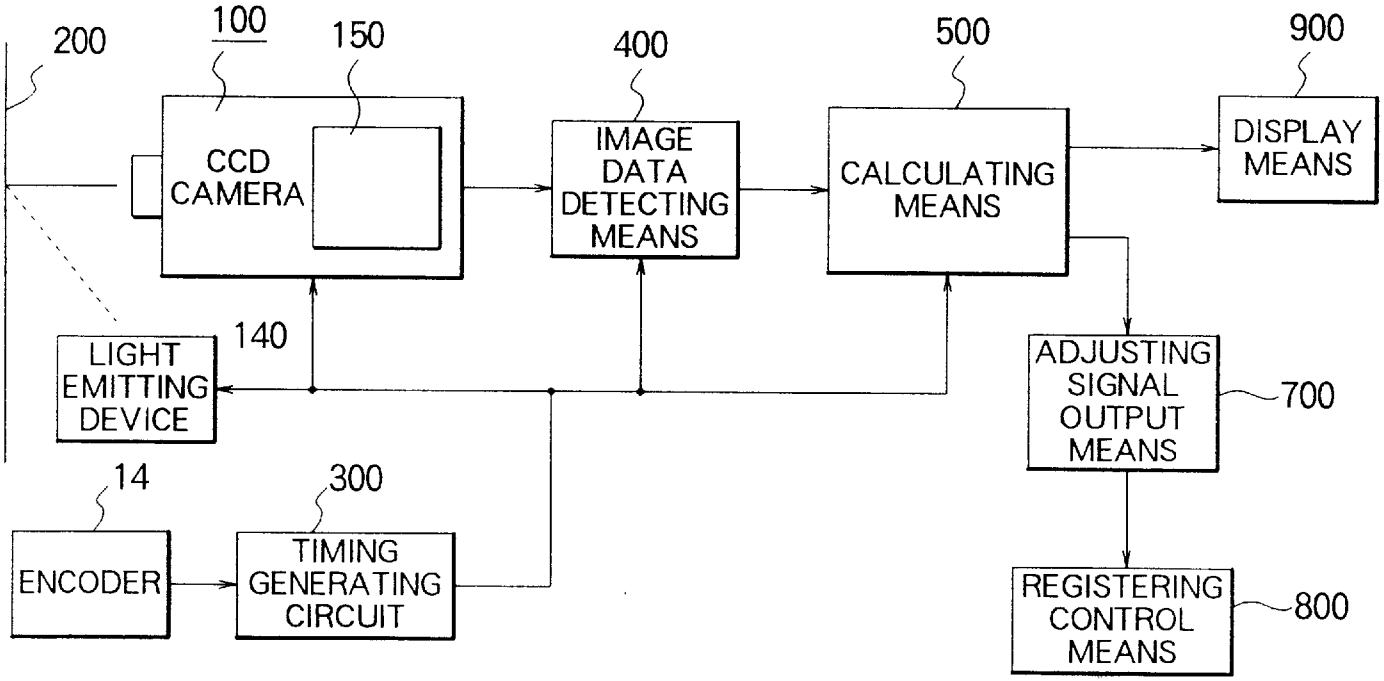
FIG. 1 is a block diagram illustrating the circuit configuration of this invention.

FIG. 1 is a schematic diagram illustrating the circuit configuration of this invention.

In the figure, reference numeral 100 denotes a CCD camera for photographing an image of register marks printed on a travelling paper web 200. In photographing the register marks, a timing generating circuit 300 generates appropriate pulses at each timing when the time generating circuit 300 receives a signal from an encoder 14 that detects the rotation of the plate cylinder. One of such timing pulses triggers a light emitting device 140 to emit light to irradiate register marks printed on the traveling paper web 200. (The register mark will be described in detail later.) A CCD sensor 150 in the CCD camera 100 scans the irradiated register marks on the traveling paper web 200 to obtain picture element data on the image being photographed.

The picture element data on the photographed image are subjected to picture element data detecting means 400 to discriminate the register marks from the background color. After various corrections are made by inherent correcting means, picture element data on the register marks are detected. Various correction methods by the inherent correction means, such as a method for discriminating register marks from a background color, or a method for removing noise caused by ink splashes, or a method for removing the effects of printing skips in a register mark, will be described in detail later.

Calculating means 500 calculates the coordinates representing the reference point of a register mark based on the picture element data on the register mark to obtain deviation from the target coordinates for the reference point. The calculating means 500 displays the deviation value on a display means 900 and transmits the deviation to adjusting signal outputting means 700.

Upon receiving the deviation value, the adjusting signal outputting means 700 generates an adjusting signal corresponding to the deviation, causing registering means 800 to make adjustments to eliminate the deviation.

These registering error detection and register control processes are carried out simultaneously for each color of black, cyan, magenta and yellow to be printed by a color printer.

Figure 2:
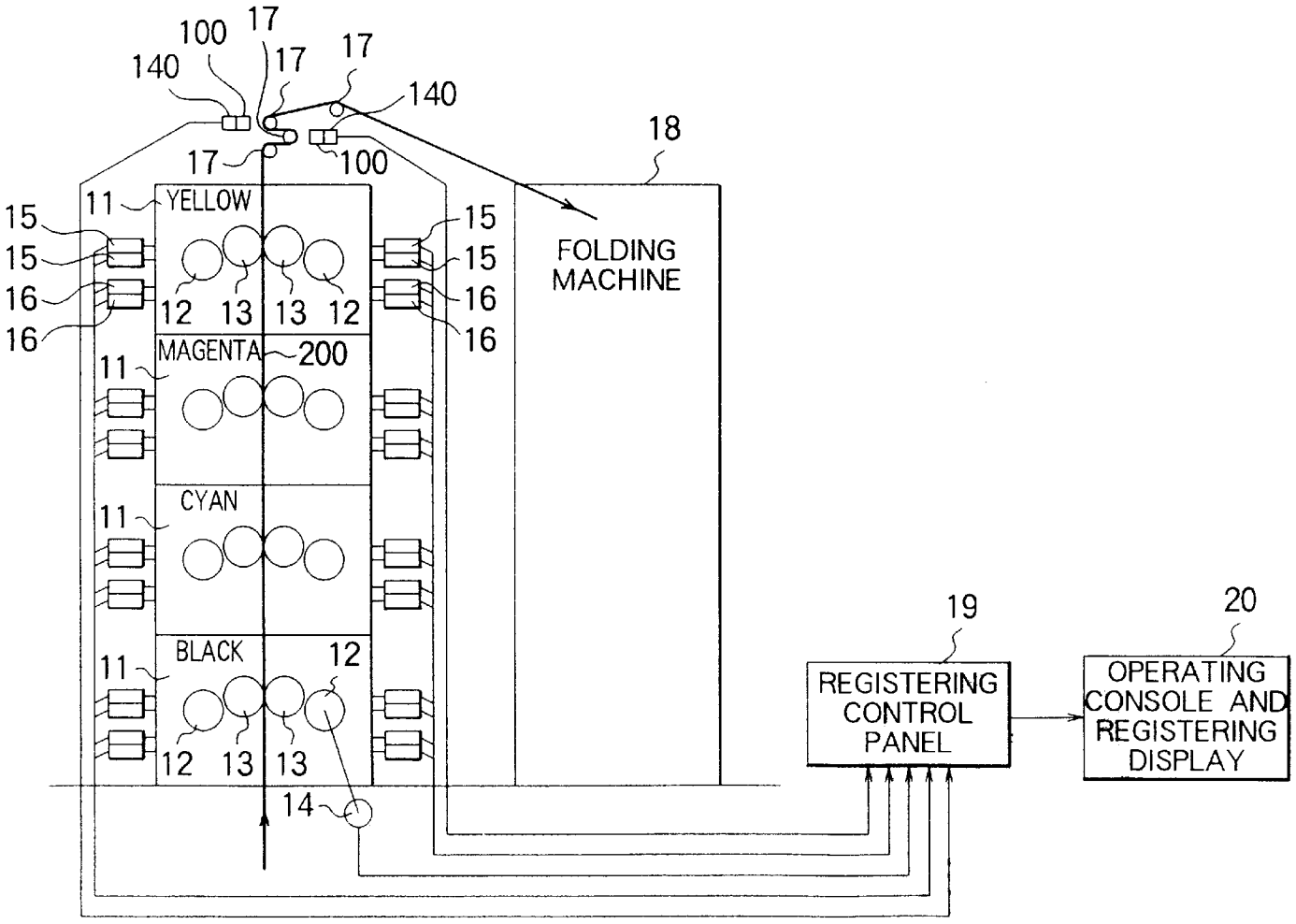
FIG. 2 is a schematic diagram illustrating an outline of a multi-color rotary press embodying this invention.

FIG. 2 is a schematic diagram illustrating an outline of a multi-color rotary press embodying this invention.

In the figure, B—B type printing units 11 are stacked in four stages for black, cyan, magenta and yellow from the bottom stage to the top stage, constituting a tower type printer capable of multi-color printing with four colors.

Each printing unit 11 has a plate cylinder 12, a blanket cylinder 13, an encoder rotating in synchronism with the plate cylinder 12 to print black, cyan, magenta and yellow in the ascending order from the bottom on the traveling paper web 200 traveling from the bottom to the top of the printing unit 11. In the course of these printing operations, register marks for use as reference marks to maintain the exact agreement of color printing positions are printed at predetermined positions in the order of black, cyan, magenta and yellow in accordance with the register mark detecting method employed. The register marks are printed on non-printing areas on the traveling paper web 200, as shown by 21 in FIG. 4, for example.

The traveling paper web 200 printed in this way by each printing unit is led to a guide roller 17, cut in appropriate lengths and folded into a predetermined shape in a folder 18.

Figure 3:
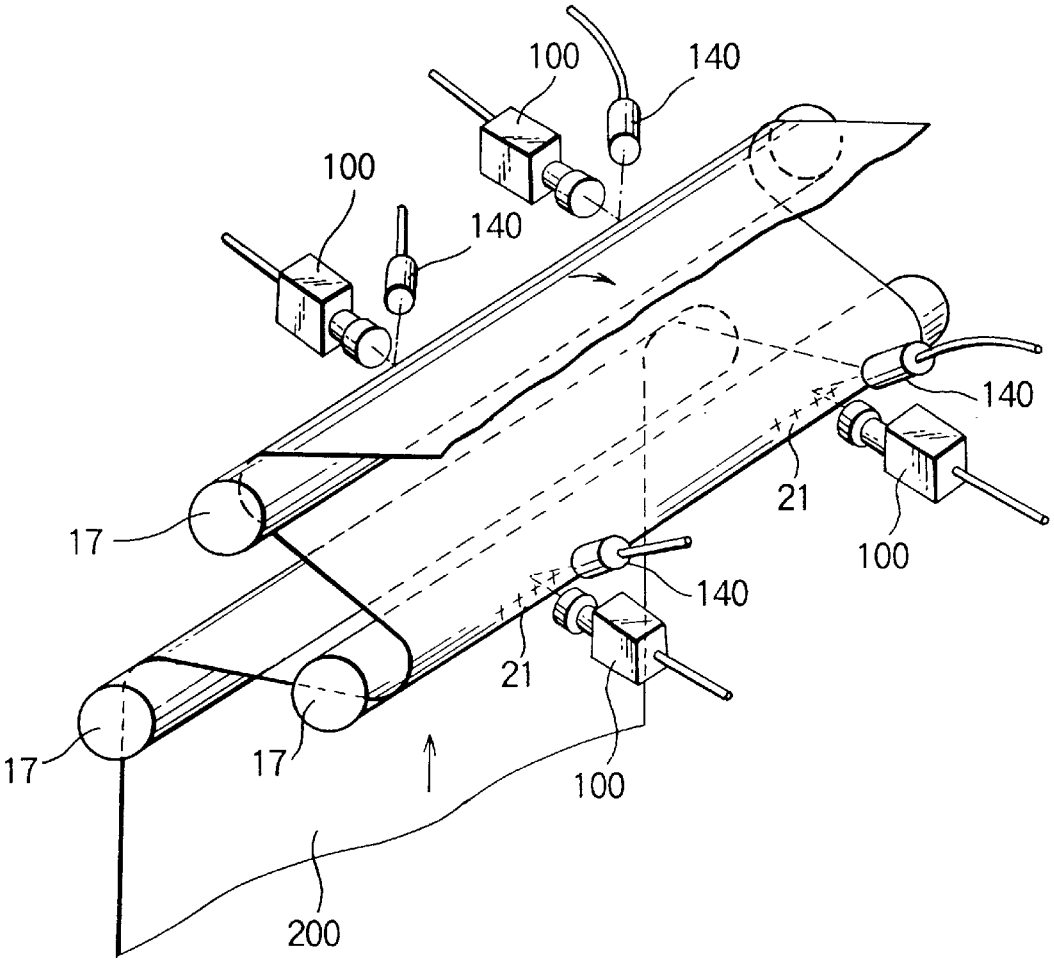
FIG. 3 is an enlarged diagram of assistance in explaining a register mark reading section.

A CCD camera 100 and a light emitting device 140 having a xenon flash light source for detecting the register marks 21 printed on the traveling paper web 200 are disposed in the vicinity of the guide roller 17, as shown in FIG. 3.

Figure 4:
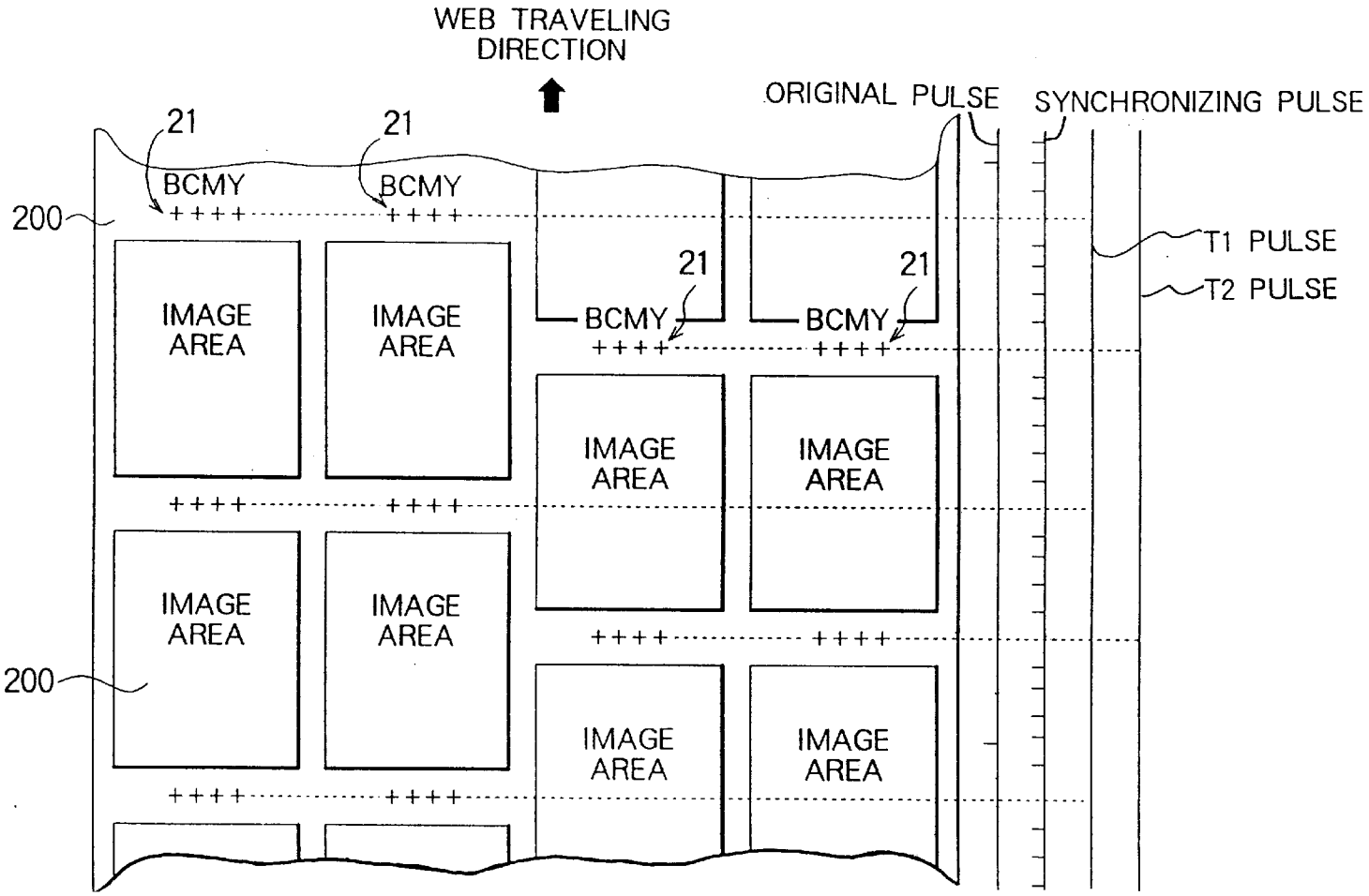
FIG. 4 is a diagram of assistance in explaining the relationship between the printing positions of register marks and the generation of relevant pulses.

In a newsprint rotary press, for example, where 2-page long printing plates are normally placed on a plate cylinder by shifting each plate transversely by 90 degrees, register marks 21 are read twice per rotation of the plate cylinder with pulses T1 and T2, as shown in FIG. 4. That is, the timing at which CCD camera 100 reads the register marks 21 is such that the synchronizing pulses generated in synchronism with the rotation of the plate cylinder 12 are counted on the basis of the reference point pulses produced by the encoder 14 that is rotated in conjunction with the plate cylinder 12 to instruct the angular position of the rotating plate cylinder 12, pulses T1 and T2 are generated at predetermined rotating angular positions; with the pulse T1 starting reading into the CCD sensor 150 (refer to FIG. 1) in the CCD camera 100 and causing the light emitting device 140 having a xenon light source to emit light to read the register marks 21 on the left side, and the pulse T2 being used as a signal to read the register marks 21 on the right side that are printed by a plate installed at a position shifted by 90 degrees.

In FIG. 2, the picture element data photographed by the CCD camera 100 are fed to a register control panel 19 to detect the registering errors of the reference point of each register mark 21, as described in FIG. 1. The detected registering errors are displayed on an operation console and registering display 20, and a signal for adjusting deviations based on the registering errors is fed to a motor 15 for controlling the longitudinal direction of the divided plate cylinder in each printing unit 11 and a motor 22 for controlling the transverse direction of the divided plate cylinder so as to adjust the deviations to zero.

Next, a first detecting method for detecting registering errors in a multi-color rotary press will be described, in which at least one register mark having an inherent reference point is printed on each printing area of the traveling paper web 200, and a circular CCD sensor of the CCD camera having a plurality of detecting element (CCD sensors) arranged in a circular shape scans the traveling paper web 200 to detect the picture element data for each register mark, so that the coordinates of the aforementioned reference point are calculated for each register mark on the basis of the detected picture element data in a coordinate system having the origin at the center of the circular CCD sensor to obtain a deviation from the target coordinates of the reference point.

In this registering error detecting method using a coordinate system having the origin at the center of a circular CCD sensor, the coordinates of the positions of more than two different register-mark lines detected by the circular CCD sensor are obtained for one register mark of a shape having an inherent reference point. Based on the coordinates of the positions of these lines, the coordinates of the reference point of the register mark are calculated, and the calculated coordinates and the target coordinates of the reference point are compared to obtain deviation as a registering error. The first registering error method will be described in the following.

Figure 5:
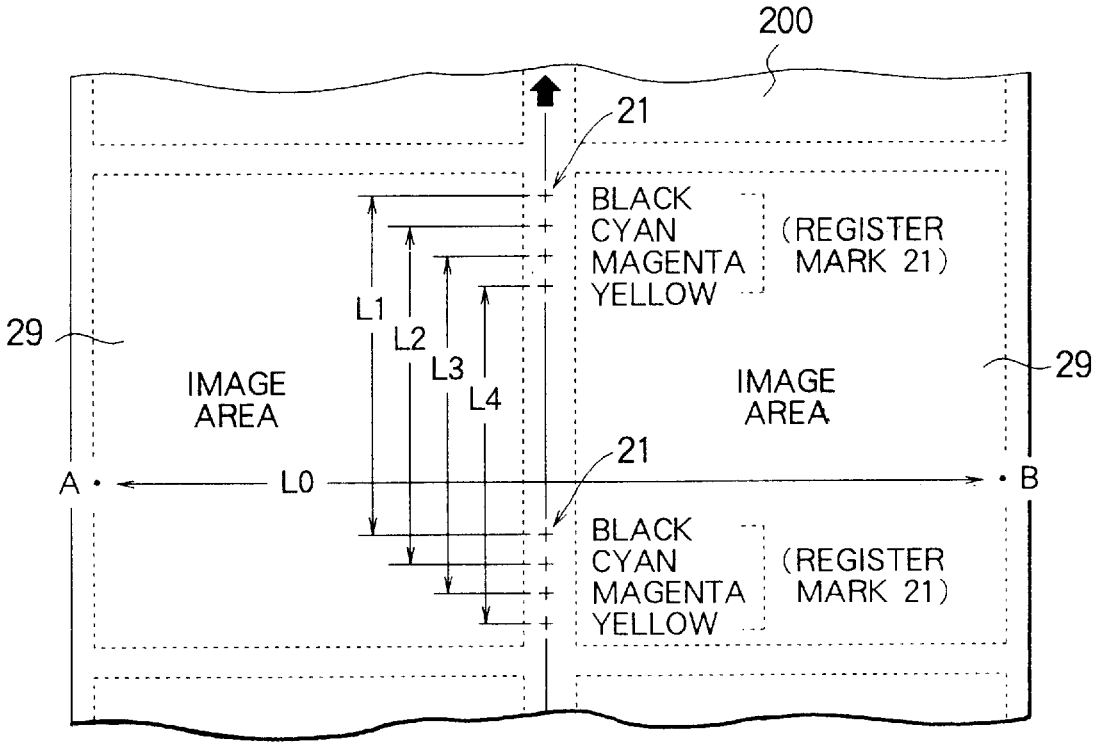
FIG. 5 is a diagram illustrating an example of the layout of register marks.

FIG. 5 is a diagram illustrating an example of the layout of register marks.

In the figure, register marks 21 are printed in the order of black, cyan, magenta and yellow on the leading and trailing edges of a printing image area 29 in a straight line in the traveling direction of the traveling paper web 200. The registering marks of the same color at the leading and trailing edges, that is, a pair of register marks for black L1, that of register marks for cyan L2, that of register marks for magenta L3, and that of register marks for yellow L4 on the leading and trailing edges are arranged at equal intervals, as shown in the figure. Two register marks 21 are provided on the traveling paper web 200 to detect plate inclination. The rotary press has such a construction that the web width L0 can be adjusted for plate inclination in such a manner that point B is moved longitudinally around point A as a fulcrum. When a plate inclination occurs, the plate is adjusted upward or downward. A longitudinal or transverse inclination can be detected using these register marks. The method for detecting longitudinal or transverse inclination will be described later.

Figure 6A:
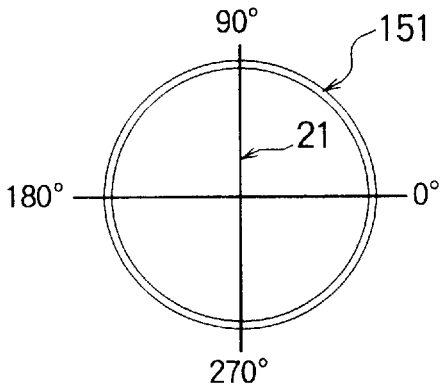
FIG. 6 is a diagram of assistance in explaining the relationship between a circular CCD sensor and a register mark.
Figure 6B:
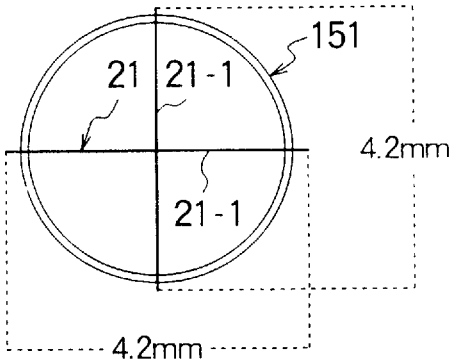
Figure 7A:
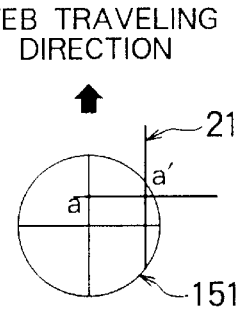
FIG. 7 is a diagram of assistance in explaining transverse and longitudinal shifts of a register mark.
Figure 7B:
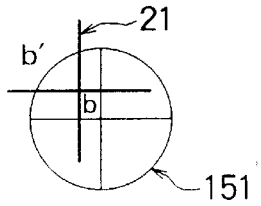
Figure 7C:
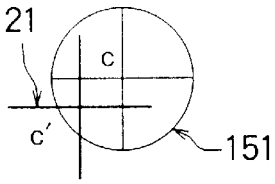
Figure 7D:
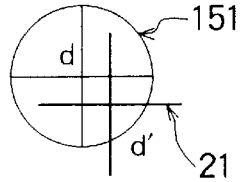

FIG. 6 is a diagram of assistance in explaining the relationship between the circular CCD sensor and the register mark.

The circular CCD sensor 151 used in this invention is so constructed that arrays of light receiving elements consisting of 720 picture elements are arranged in a circular shape, as shown in FIG. 6 (A). When the center of the circular CCD sensor 151 agrees with the inherent reference point, that is, the intersection point of a register mark 21, the point at which the register mark 21 intersects with an array of light receiving elements at the right of a side perpendicular to the traveling direction of the traveling paper web 200 is set to 0°, and the array number, that is, the picture element number of the light receiving elements at that point is assigned as No. 1. In this way, the picture element numbers from ranging from No. 2 to No. 720 are sequentially assigned counter-clockwise to arrays at 0°, 90°, 180°, 270°, 359.5°.

As shown in FIG. 6 (B), a printed register mark 21 is of a cross having two intersecting lines (hereinafter referred to as bars to avoid confusion) having a width of 0.2 mm and a length of 4.2 mm, whereas the detection area of the circular CCD sensor 151 is set to 4 mm in diameter.

The maximum longitudinal shift is 2.5 mm, the maximum transverse shift 2.5 mm, and the maximum inclination 0.3 mm in a normal offset rotary press. Consequently, the register mark must always be within the detection area of the circular CCD sensor 151 even when the maximum shift takes place. The register mark 21 can be detected by the circular CCD sensor 151 so long as the register mark 21 is within the maximum shift.

FIG. 7 is a diagram illustrating transverse and longitudinal shifts of a register mark; (A) being transverse and longitudinal shifts of a register mark for black, (B) those for cyan, (C) those for magenta, and (D) those for yellow. The intersecting point, that is, the inherent reference point (the intersecting point of the register mark is hereinafter referred to as the reference point) of the register mark for black, as shown in FIG. 7 (A), is shifted from the basic position of the circular CCD sensor 151, that is, the center a of the circle denoting the circular CCD sensor 151 to point a'. Similarly, the register mark 21 for cyan, as shown in (B), is also shifted from the center b of the circle representing the circular CCD sensor 151 to point b', the register mark 21 for magenta, as shown in (C), is shifted from the center c of the circle representing the circular CCD sensor 151 to point c', and the register mark 21 for yellow, as shown in (D), is shifted from the center d of the circle representing the circular CCD sensor 151 to point d'.

Figure 8:
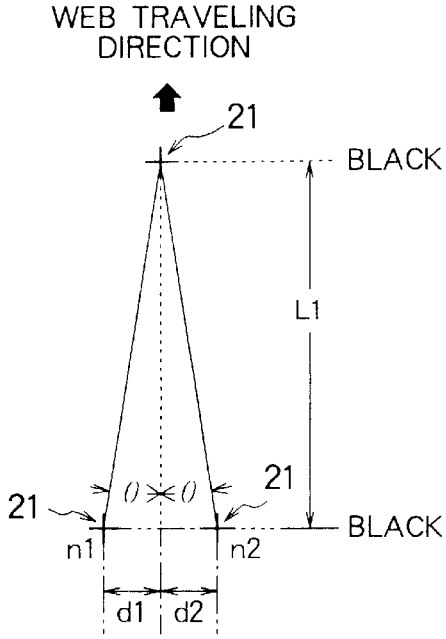
FIG. 8 is a diagram of assistance in explaining obliquely inclined register marks.

FIG. 8 is a diagram of assistance in explaining inclination.

In the figure, register marks on the same plate that are to be printed on a straight line coinciding with the traveling direction of the traveling paper web 200 are inclined, that is, the lower register mark 21 is shifted either leftward or rightward with respect to the upper register mark 21. This results in an inclination, that is, an inclination with respect to the axial line of the plate cylinder, of a plate installed on the plate cylinder, or an image on the plate. The same inclination can occur on any plate for black, cyan, magenta and yellow. d1 and d2 in the figure denote the amount of inclination.

Next, the method for detecting the amount of longitudinal and transverse shifts, and the amount of inclination of a plate will be described.

Figure 9:
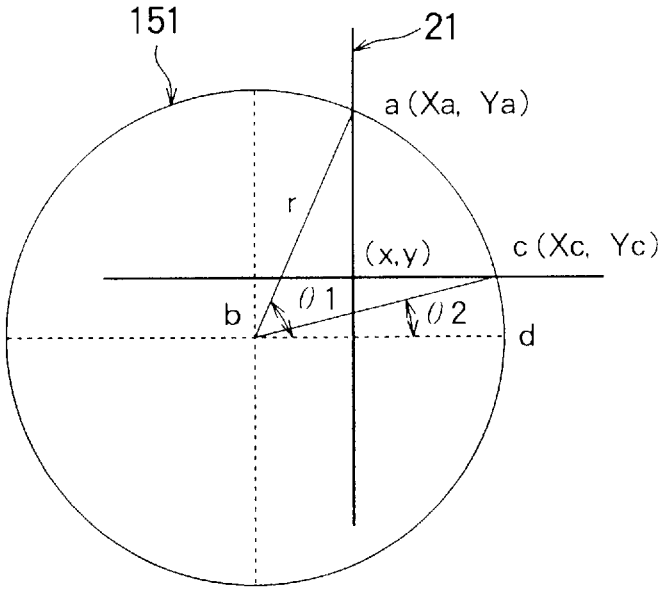
FIG. 9 is a diagram of assistance in explaining a method for detecting the amount of transverse or longitudinal shift.

FIG. 9 is a diagram of assistance in explaining the state of detection of the amount of longitudinal and transverse shifts.

In the figure, when the circular CCD sensor 151 detects a register mark 21, the intersecting points a and c of the circular CCD sensor 151 and the register mark 21 indicate an angle of the center coordinates of the circular CCD sensor 151 if there is no inclination at all in a coordinate system with the center of the circular CCD sensor 151 as the origin (hereinafter coordinates refer to the coordinates with the center of the circular CCD sensor 151), and thus the circular CCD sensor 151 can read ∠abd ($\theta 1$) and ∠cbd ($\theta 2$) from the picture element numbers assigned in FIG. 6 (A).

Consequently, the amount of longitudinal and transverse shifts of a register mark 21 can be obtained from the coordinates of the reference point of the register mark 21. That is, the coordinates (x, y) of the reference point of the register mark 21 can be found by the following equations; $x=r\cdot\cos\theta 1$ and $y=\sin\theta 2$ where r presents the radius of a circle in which arrays of light-receiving elements of the circular CCD sensor 151 are arranged into a true circle.

Figure 10:
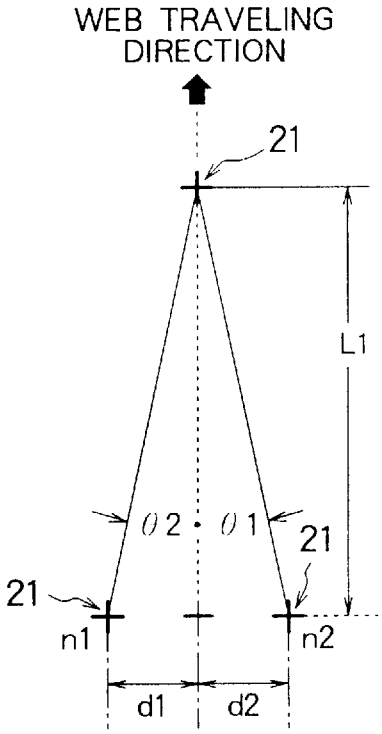
FIG. 10 is a diagram of assistance in explaining a method for detecting the amount of plate inclination.

FIG. 10 is a diagram illustrating the state of detection of the amount plate inclination.

The figure illustrates the state where the rear register mark 21 for black is inclined with respect to the leading register mark 21 for black. When the position of the rear register mark 21 is shifted off the preset line to n2, the amount of inclination of the plate can be found by an equation $D=L0\cdot\tan\iota 1$ where L0 represents the web width as shown in FIG. 5. In the equation $\tan\iota 1=d2/L1$, L1 represents a fixed printing length.

When the position of the rear register mark 21 is shifted from the preset line to n1, the amount of plate inclination D can be found by $D=L0\cdot\tan(180°-\theta 2)$.

The amount of plate inclination is corrected by turning an end of the plate cylinder around the other as the fulcrum. When the register mark 21 is shifted towards the side of n2, the amount of inclination D is corrected in the upward direction. When the register 21 is shifted towards the side of n1, the amount of inclination D is corrected in the downward direction.

Figure 11:
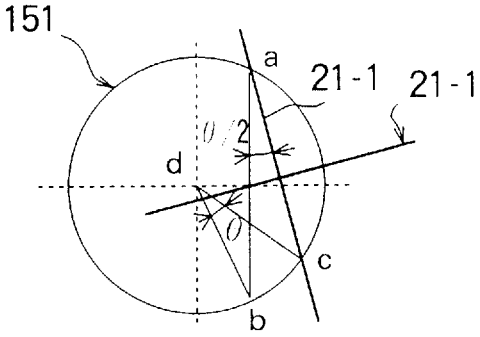
FIG. 11 is a diagram of assistance in explaining a method for detecting the amount of plate inclination.

FIG. 11 is a diagram of assistance in explaining another example of detection of the amount of plate inclination.

Figure 12:
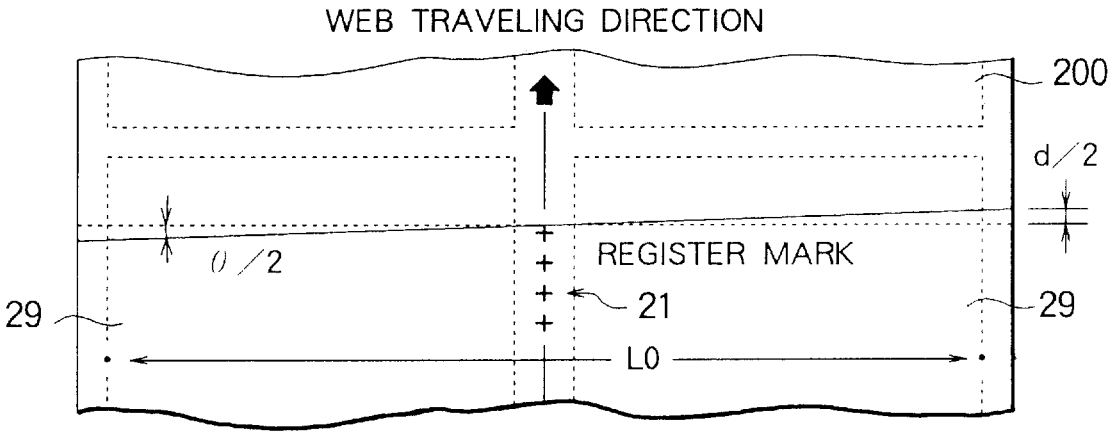
FIG. 12 is a diagram of assistance in explaining a method for detecting a plate inclination by calculation.

The figure shows an inclination detecting method in which the circle of the circular CCD sensor 151 is used. As shown in the figure, when a bar 21-1 of the register mark 21 intersects the circular CCD sensor 151 at points a and c, that is, when the bar 21-1 is inclined obliquely, the register 21 intersecting orthogonally with the traveling direction of the traveling paper web 200 is inclined by $\theta/2$ shown in FIG. 12 because ∠cdb is the double angle of ∠cab. Consequently, the amount of plate inclination D can be found by the equation $D=L0\cdot\tan\theta/2$.

This method can detect a plate inclination with a single register mark 21 on the upper part of the plate.

Figure 13:
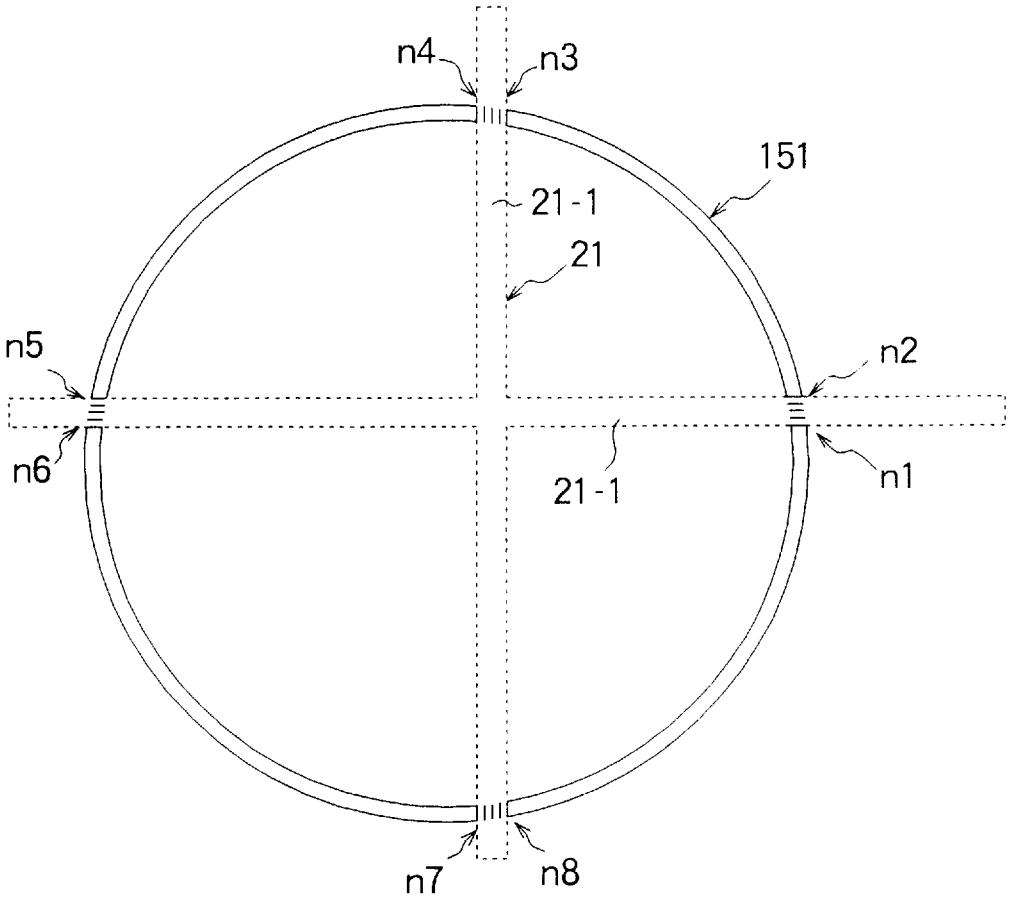
FIG. 13 is a diagram of assistance in explaining a method for detecting bars of a register mark.

FIG. 13 is a diagram of assistance in explaining the state of detection of a bar of the register mark.

If the width of a register mark 21 printed becomes thicker or thinner due to changes in dot gain, the change in the width of the register mark affects detection accuracy. To prevent the adverse effect of the change in the width of the register mark, as the circular CCD sensor 151 is scanned counterclockwise, the first dark picture element number n1 as scanning enters a dark area from a bright area (n1 is a general number. Hereinafter n2, n3, - - - are also general numbers) and the last dark picture element number n2 as scanning clears the dark area, moving to the bright area again are detected to obtain an average picture element number of (n1+n2)/2. The average picture element thus obtained is used as the picture element for the position of the centerline of the bar 21-1 of the register mark 21 to eliminate the possible adverse effects when obtaining the intersecting point with the register mark 21.

In the figure, n3 and n4, n5 and n6, and n7 and n8 are used in the same manner as described above to obtain picture element numbers for their respective centerline positions.

The picture element in the Y direction when the register mark 21 matches, or is close to match with the circular CCD sensor 151 is not shown in the figure because it spans across the first quadrant and the fourth quadrant of a coordinate with the center of the circular CCD sensor 151 as its origin. But its centerline position is determined by obtaining a picture element number corresponding to ½ of n2 and n9 (n9 being the first dark picture element number in the fourth quadrant as the detection or scanning results change from brightness to darkness).

FIGS. 14 and 15 are diagrams illustrating patterns representing ranges where a circular CCD sensor acquires the image of a register mark.

The number of patterns where a register mark 21 crosses the picture element of a circular CCD sensor 151 is 21, which can be classified by the number of intersecting points into three types; those having four intersecting points, those having three intersecting points, and those having two intersecting points. The register mark 21, however, tends to involve registering errors insofar as the register mark 21 does not cross the circular CCD sensor 151 at only one intersecting point within the detection range of the circular CCD sensor 151, as described in FIG. 6 above.

The patterns shown in FIG. 14 can be classified according to the coordinate position of the reference point of the register mark 21 into the following three types; those patterns where the reference point of the register mark 21 lies in any of the first, second, third and fourth quadrants of a coordinate circle with the center of the circular CCD sensor 151 as its origin (Pattern Nos. 14.2 through 14.5, 15.01 through 15.12), those patterns where the reference point of the register mark 21 agrees with the center of the circle of the circular CCD sensor 151 (Pattern No. 14.1), and those patterns where either of X or Y axis of the bars 21-1 of the register mark 21 agrees with either of the coordinate axes of the circle of the circular CCD sensor 151 (Patterns 14.6 through 14.9).

In what quadrant of the coordinate of the circular CCD sensor 151 the reference point of the register mark 21 lies can be detected from the patterns by detecting those patterns where there are two intersecting points of the register mark 21 and the circular CCD sensor 151 within the same quadrant.

Though details will be described later, in Pattern 14.2, for example, two intersecting points P1 and P2 lie in the first quadrant, which means that the reference point of the register mark 21 is in the first quadrant of the coordinate of the circular CCD sensor 151. Consequently, the presence of the reference point of the register mark 21 in the first quadrant indicates that the register mark 21 is shifted in both the upward and rightward directions.

Pattern 14.1 indicates that the reference point of the register mark 21 agrees with the origin of the coordinate of the circular CCD sensor 151.

Figure 16:
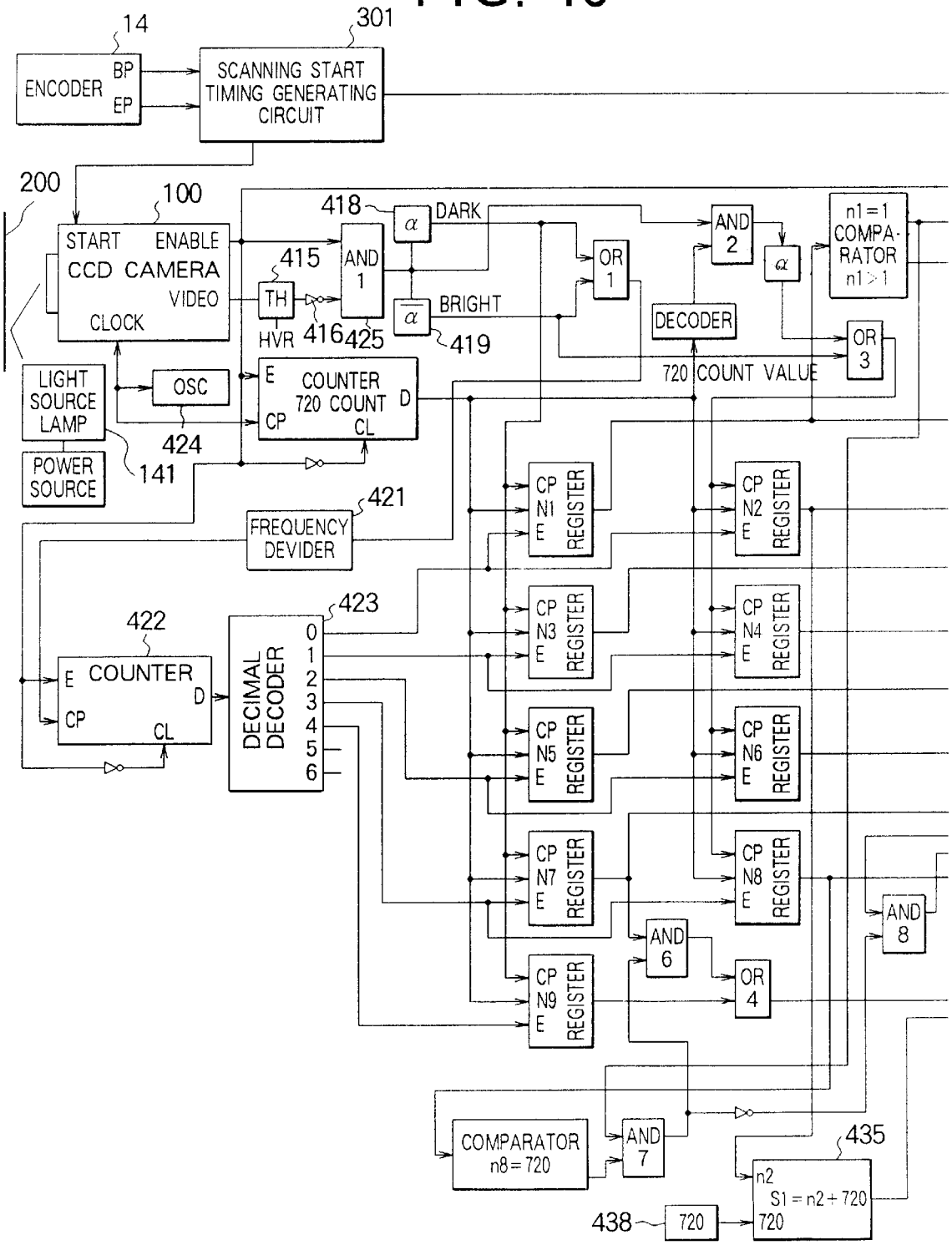
FIG. 16 is a partial block diagram illustrating the configuration of a registering error detecting circuit for multi-color rotary presses according to this invention.
Figure 17:
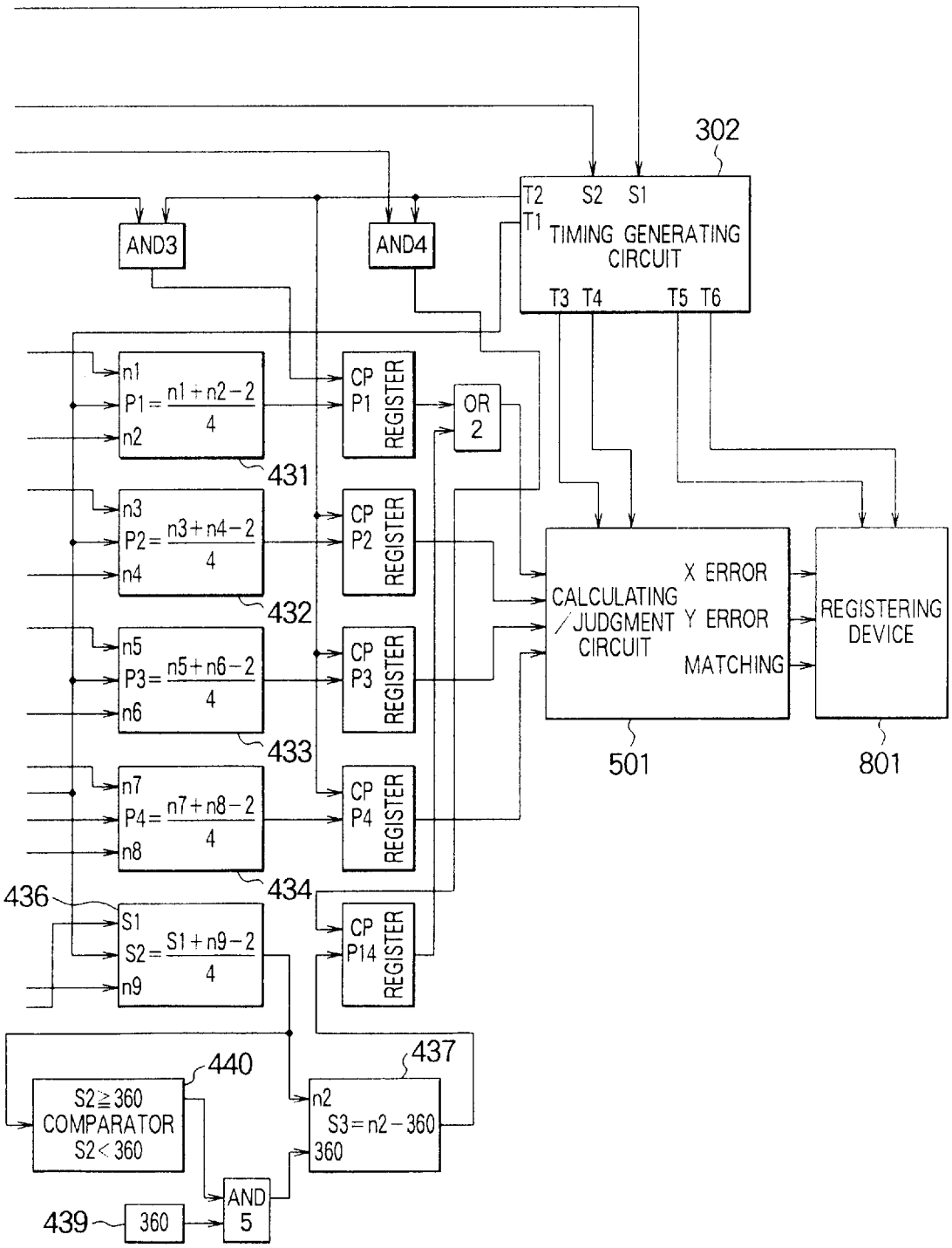
FIG. 17 is a partial block diagram illustrating the configuration of a registering error detecting circuit for multi-color rotary presses according to this invention; the left side thereof being connected to the right side of FIG. 16.

FIG. 16 is a diagram illustrating part of a registering error detection circuit for multi-color rotary presses embodying this invention. FIG. 17 is a diagram illustrating part of a registering error detection circuit for multi-color rotary presses embodying this invention, the left side of which is connected to the right side of FIG. 16. Now, these figures will be described, referring to a time chart of main parts of this invention shown in FIG. 20.

Adjustment of registering errors in vertical and horizontal directions is performed only after registering errors due to a plate inclination have been adjusted, which will be described later. This is because when there is no plate inclination, the amount of vertical and horizontal shift of the register mark 21 can be found by calculating the coordinate position of the reference point of the register mark 21, as described before with reference to FIG. 9.

In FIGS. 16 and 17, a pulse EP generated by an encoder 14 in synchronism with the rotation of the plate cylinder, that is, a synchronization pulse ([2] in FIG. 20), and a pulse BP generated in synchronism with the synchronization pulse at a predetermined position of plate cylinder rotation, that is, reference pulse ([3] in FIG. 20) are inputted into a scanning start timing generating circuit 301. The scanning start timing generating circuit 301 is constructed so that a scanning start pulse ([4] in FIG. 20) is generated when the register mark 21 arrives at a register matching position, that is, a position at which a CCD camera 100 having the circular CCD sensor 151 consisting of 720 light-receiving elements, as described above, can catch sight of a black register mark 21 ([1] in FIG. 20). The scanning start timing generating circuit 301 generates a scanning start pulse ([4] in FIG. 20) every time when each of black, cyan, magenta and yellow register marks 21 printed at the leading edge of the web ([1] in FIG. 20) arrives at the register matching position of the CCD camera 100.

A high-intensity halogen lamp, for example, is used as the light source lamp 141 irradiating the reading position of the CCD camera 100. As the black register mark 21 printed at the leading edge arrives at the reading position of the CCD camera 100, and a scanning start pulse is inputted by the scanning start timing generating circuit 301 into the CCD camera 100 ([4] in FIG. 20), then the CCD camera 100 starts scanning to transmit a video signal for reading the image of the register mark 21 ([5] in FIG. 20). This video signal is fed to the threshold circuit 415 to discriminate the brightness and darkness of image and non-image parts, and the discriminated signal is inputted into an AND circuit AND1 via an inverter circuit 416.

The enable signal of the CCD camera 100 is set at an H level (hereinafter referred to as H for short) during the period when the video signal is being sent ([6] in FIG. 20), and the signal of H is inputted into the AND circuit AND1. A clock signal ([7] in FIG. 20) generated by an oscillator 424 is inputted into the CCD camera 100, which outputs the aforementioned video signal and an enable signal in synchronism with the clock signal ([6] and [8] in FIG. 20).

The output signal from the AND circuit AND1 is inputted into two differentiating circuits 418 and 419. The differentiating circuit 418 generates a differentiating pulse when the output signal of the AND circuit AND1 changes from an L level (hereinafter referred to as "L") to H, that is, when the video signal of the CCD camera 100 changes from brightness to darkness. The differentiating circuit 419 generates a differentiating pulse when the output signal of the AND circuit AND1 changes from H to L, that is, when the video signal of the CCD camera 100 changes from darkness to brightness.

Differentiating pulses generated by these two differentiating circuits 418 and 419 are inputted into an OR circuit OR1, whose output signal is then inputted into a counter 422 via a frequency divider 421 of the frequency-division ratio of 2. The differentiating pulses are counted by the counter 422 while the enable signal of the CCD camera 100 is kept at H ([9] in FIG. 20). That is, a set of the differentiating pulse generated as the video signal out-putted by the differentiating circuit 418 change from brightness to darkness, and a differentiating pulse generated by the differentiating circuit 419 as the video signal of the CCD camera 100 changes from darkness to brightness is counted by the counter 422 as one pulse.

Figure 20:
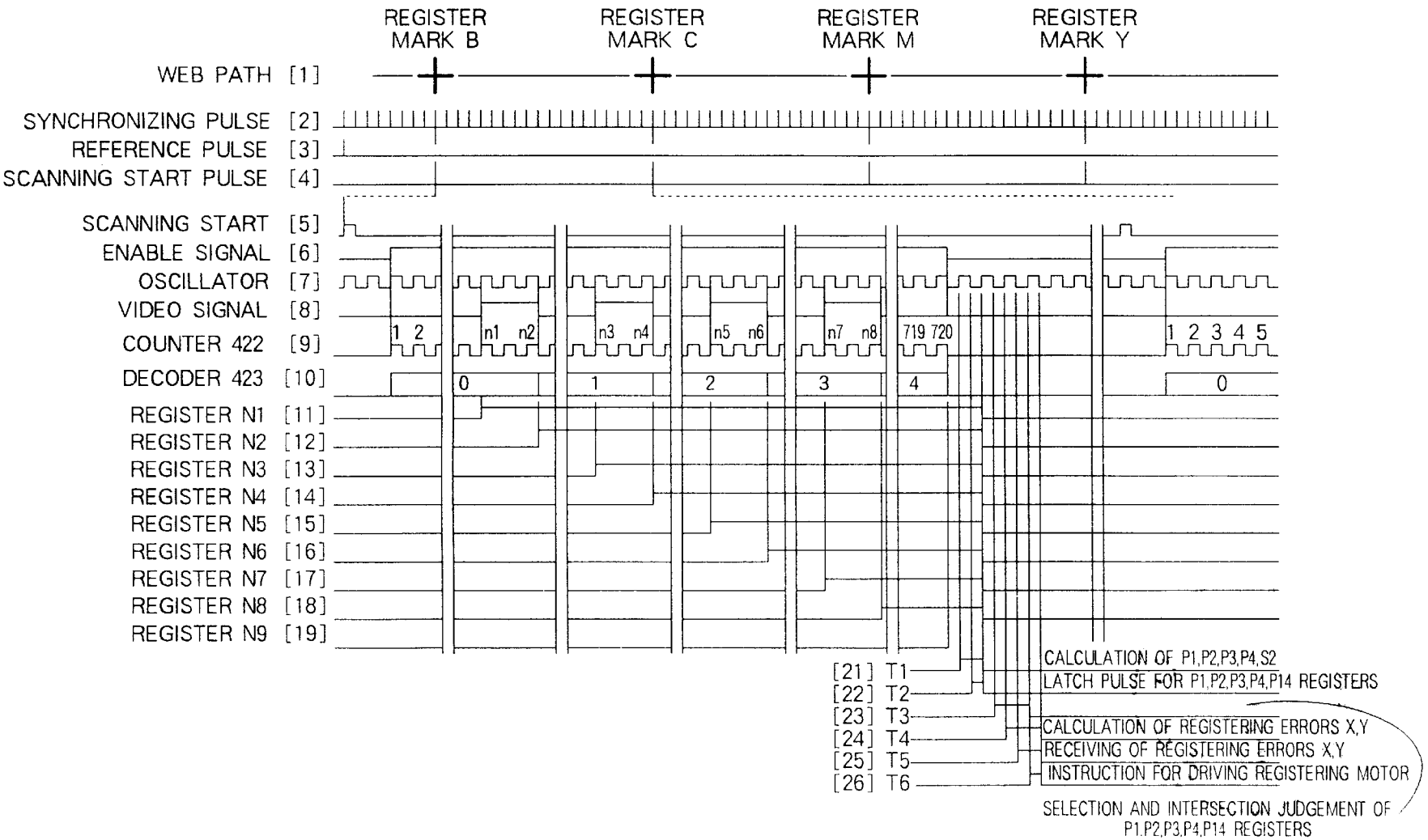
FIG. 20 is a time chart illustrating operations of major parts shown in FIGS. 16 through 19.

The count value of the counter 422 is decoded by a decimal decoder 423, whose output 0 enables registers N1 and N2 associated with the first intersecting point P1 (see FIGS. 14 and 15) of the circular CCD sensor 151 and the register mater 21, whose output 1 enables registers N3 and N4 associated with the second intersecting point P2 as described above, whose output 2 enables registers N5 and N6 associated with the third intersecting point P3, whose output 3 enables registers N7 and N8 associated with the fourth intersecting point P4, and whose output 4 enables registers N9 associated with an intersecting point P14 (which will be described later), producing a timing signal for latching the picture element signals generated as the video signal changes from brightness to darkness and from darkness to brightness, as described with reference to FIG. 13, to each register ([10] in FIG. 20).

The clock signal from the oscillator 424 is also inputted into the counter 425, which counts 720 clock signals up to 720 while the counter 425 receives the enable signal from the CCD camera 100, that is, while the picture element signals 1 to 720 are scanned.

The count value of the counter 425 is inputted to the registers N1 through N9 as described above, and the differentiating pulse of the differentiating circuit 418 that detects the change of the video signal from brightness to darkness is inputted to the registers N1, N3, N5, N7 and N9 while the differentiating pulse of the differentiating circuit 419 that detects the change of the video signal from darkness to brightness is inputted to the registers N2, N4, N6 and N8 via an OR circuit OR3.

Consequently, the first dark picture element number n1 of the circular CCD sensor 151 when scanning results change from brightness to darkness at the first intersecting point P1 of the circular CCD sensor 151 and the register mark 21 is latched to the register N1 ([11] in FIG. 20), and the last dark picture element number n2 of the circular CCD sensor 151 when scanning results changes from darkness to brightness at the intersecting point P1 as described above is latched to the register N2 ([12] in FIG. 20).

Similarly, the first dark picture element numbers n3, n5, n7 and n9 (n9 is not shown) of the circular CCD sensor 151 when scanning results change from brightness to darkness at the intersecting points P2, P3, P4 and PX are latched to the registers N3, N5, N7 and N9 ([13], [15], [17] and [19]) in FIG. 20), and the last dark picture element numbers n4, n6 and n8 when scanning results change from darkness to brightness at the intersecting points P2, P3 and P4 are latched to the registers N4, N6 and N8 ([14], [16] and [18] in FIG. 20).

The enable signal of the CCD camera 100 is also inputted to the timing signal generating circuit 302, which outputs pulses T1 through T6 after the lapse of a predetermined time interval after the enable signal has been inputted, that is, after the array of 720 light-receiving elements of the circular CCD sensor 151 have been scanned ([21 through [26] in FIG. 20).

Upon receipt of a pulse T1, calculating circuits 431 through 434 and calculating circuits 435 through 437 perform the following calculation based on the data latched to the registers N1 through N9.

In the calculating circuit 431, P1=(n1+n2-2)/4 is calculated to obtain the angle θ1 of the first intersecting point P1 of the bar 21-1 of the register mark 21 and the circular CCD sensor 151 (where the average value of the bar 21-1 of the register mark 21 as described with reference to FIG. 13 is used. The same allies to the following description.) In the calculating circuit 432, P2=(n3+n4-2)/4 is calculated to obtain the angle θ2 of the second intersecting point P2 of the bar 21-1 of the register mark 21 and the circular CCD sensor 151, and in the calculating circuit 433, P3=(n5+n6-2)/4 is calculated to obtain the angle θ3 of the third intersecting point P3 of the bar 21-1 of the register mark 21 and the circular CCD sensor 151, and in the calculating circuit 434, P4=(n7+n8-2)/4 is calculated to obtain the angle θ4 of the fourth intersecting point P4 of the bar 21-1 of the register mark 21 and the circular CCD sensor 151.

In the calculating circuit 435, S1=n2+720 is calculated using 720" latched in advance to the register 433. In the calculating circuit 436, S2=(S1+n9−2)/4 is calculated, and in the calculating circuit 437, S3=S2−360 is calculated using "360" latched in advance to the register 439 on condition that the S2 calculated in the calculating circuit 436 satisfies S2≧360.

Next, upon receipt of a pulse T2, the following operations are performed.

As the value n1 latched to the register N1 and "1" are compared by the comparator 440, if n1>1, the P1 obtained in the calculating circuit 431 is latched to the register P1 via an AND circuit 3. If n1=1, the S3 obtained in the calculating circuit 437 is latched to the register P14 via an AND circuit 4. If n1>1, the P1 latched to the register P1 is inputted to a calculating/judgment circuit 501 via an OR circuit OR2, and if n1=1, the P14 (=S3) latched to the register P14 is inputted to the calculating/judgment circuit 501 via the OR circuit OR2.

The P2 through P4 obtained in the calculating circuits 432 through 434 are latched to the registers P1 through P4 provided corresponding to the calculating circuits 432 through 434, respectively, and the latched values are inputted to the calculating/judgment circuit 501.

If the value nl latched to the register N1 is equal to 1 (n1=1), it means that the first array of light-receiving elements of the circular CCD sensor 151 detects an image, indicating that the image of the intersecting point P14 may be in both the first and fourth quadrants of the coordinate system of the circular CCD sensor 151. If the value nl latched to the register N1 is larger than 1 (n1>1), then it means that the first array of light-receiving elements of the circular CCD sensor 151 detects brightness, indicating that the image of the intersecting point P14 is not in the fourth quadrant, that is, that the intersecting point P14 does not exist, or that the bar 21-1 of the register mark 21 does not intersect the X axis of the circular CCD sensor 151.

The case where the value n1 latched to the register N1 is equal to 1 (n1=1) will be described in further detail in reference to the intersecting point P14. The bar 21-1 of the register mark 21 having a width equal to the length of more than ten picture elements, for example, is printed. Consequently, when the picture element number 1 represents an image, that is, when the first array of light-receiving elements of the circular CCD sensor 151 detects an image, the preceding light-receiving element array may detect an image because the first light-receiving element array first detects darkness.

If the content of the register N1 is 1, for example, n1=1. This means that the picture element number is 1, so the first video signal transmitted is dark, and the following video signal remains dark up to the picture element number 8, and then changes to brightness at the picture element number of 9, with the content of the register N2 being 8 with the result that n2=8. Since more than ten picture elements may exist in the width of the bar 21-1 of the register mark 21, dark picture elements may exist in the fourth quadrant. If the content of the register N9 at this time is 715, for example, and n9=715, the position of the center of the bar 21-1 with respect to the X coordinate of the coordinate system of the circular CCD sensor 151, as expressed by angle, can be calculated by the calculating circuits 434 and 346 using an equation of S2=(n2+720+n9−2)/4. Substituting the above figure into the equation yields S2=(720+8+7115−2)/4=360.25 degrees.

Since this angle equals 0.25 degrees, a comparison by the comparator 440 leads to S2≧360. Calculating an equation S3=S2−360 of the calculating circuit 436, therefore, yields S2=θ=0.25 degrees. When comparing by the comparator 440, the S2 value calculated in the calculating circuit 436 is obtained as angle θ1 in the calculating circuit 436 if S2<360 degrees, and is latched to the register P14 at the timing of pulse T2.

During the scanning of the circular CCD sensor 151, if the first picture element number 1 is dark, representing an image data, it is suggested that the preceding picture element numbers lower than 719 are also dark, representing image data. The intersecting point of the bar of the register mark 21 and the circular CCD sensor 151 at that time is called P14. The first dark picture element number when scanning results change from brightness to darkness at the intersecting point P14 is latched to the register N9.

When n1>1, the video signal n1 is a picture element number when scanning results changes from brightness to darkness, as described above. The angle θ1 of the intersecting point P1 can be found by P1=θ1=(n1+n2−2)/4 in the calculating circuit 431.

In the aforementioned latch process, if the value n8 latched to the register N8 equals 720, a value latched to the register N9, that is, the intersecting point P14, is not generated, and no calculation is performed in the calculating circuit 434. As a result, the value n7 latched to the register N7 is used as the value n9 in the calculating equation for the calculating circuit 436. Consequently, the value P4=θ4 latched to the register P4 is not calculated in the calculating circuit 434.

The next pulses T3 and T4 generated by the timing generating circuit 302 cause the calculating/judgment circuit 501 to operate, and the succeeding pulses T5 and T6 cause the registering device 801 to operate. The operation of both will be described in detail, referring to FIGS. 18 and 19.

Though not shown in the figure, the registers N1 through N9, the registers P1 through P4 and the register P14 are reset at an appropriate timing, at a pulse T2 shown in FIG. 20, for example, after the registering errors dx and dy as described with reference to FIGS. 18 and 19 have been calculated.

Figure 18:
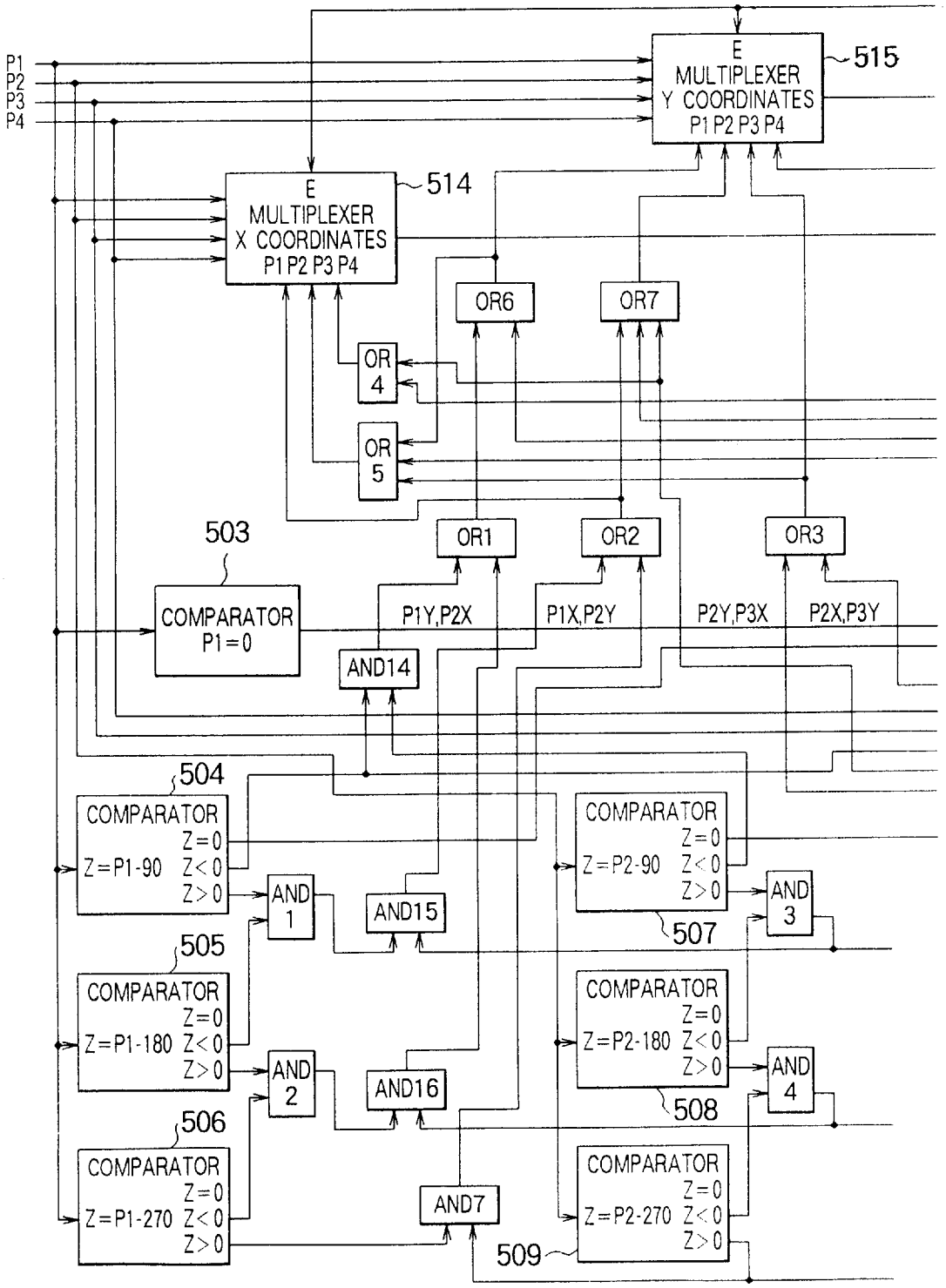
FIG. 18 is a partial block diagram illustrating the configuration of a calculation/judgment circuit used in FIG. 17.
Figure 19:
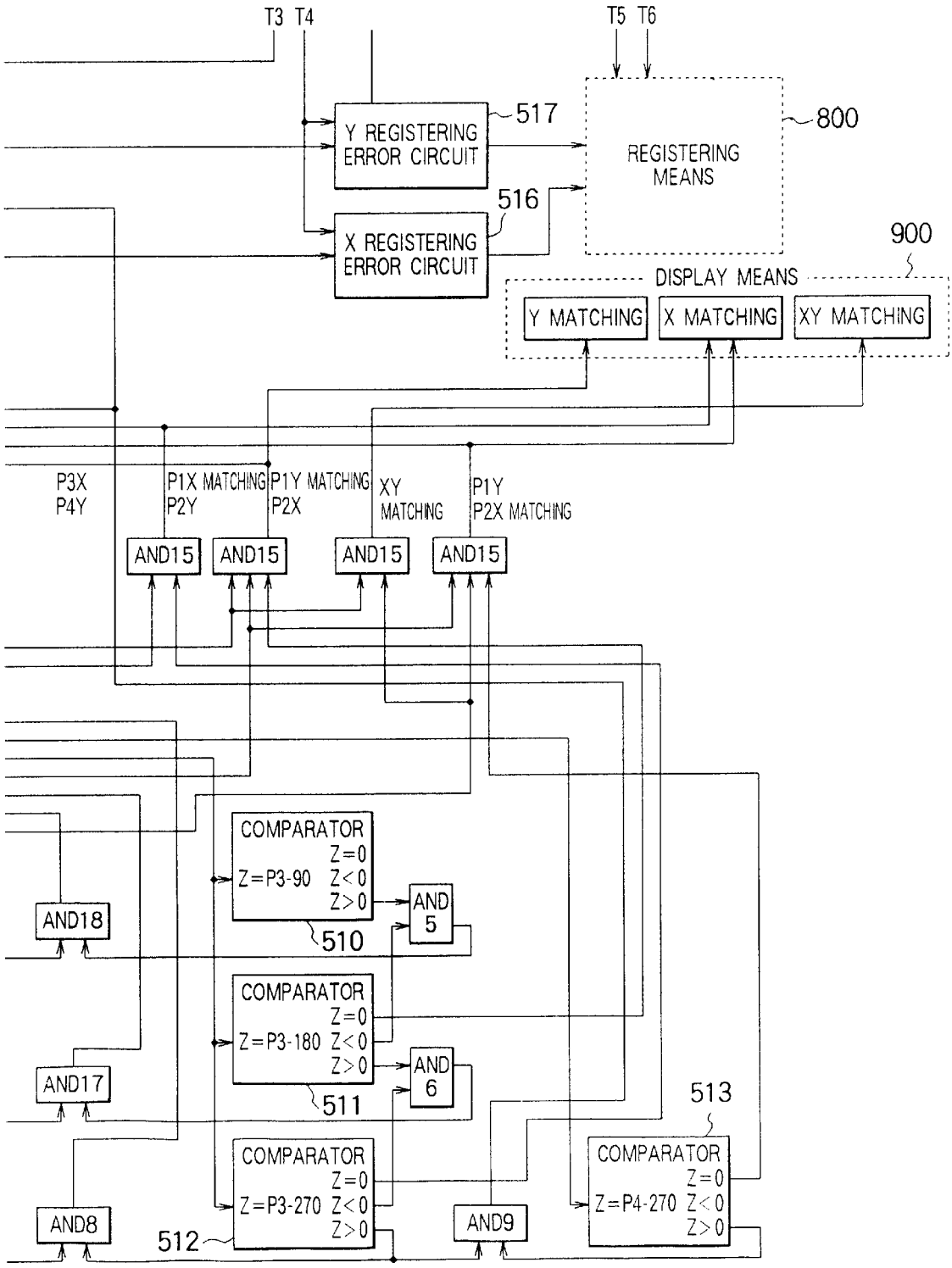
FIG. 19 is a partial block diagram illustrating the configuration of a calculation/judgment circuit used in FIG. 17; the left side thereof being connected to the right side of FIG. 18.

FIG. 18 is a partial diagram illustrating an example of calculating/judgement circuit used in FIG. 17, and FIG. 19 is a partial diagram illustrating an example of calculating/judgment circuit used in FIG. 17, the left side of which is connected to the right side of FIG. 18.

The calculating/judgment circuit 501 is a circuit for judging in what quadrant the reference point of the register mark 21 is located in the coordinate system of the circular CCD sensor 151, and calculating the horizontal and vertical registering errors of the reference point with respect to the origin.

Angular data for the registers P1 or P14, P2, P3 and P4 are inputted into comparators 503 through 513 to compare with their respective predetermined values. That is, the comparators 503 through 506 compare the data to determine in what quadrant the first intersecting point P1 or P14 is located in the coordinate system of the circular CCD sensor 151, the comparators 507 through 509 compare the data to determine in what quadrant the second intersecting point P2 is located, the comparators 510 through 512 compare the data to determine in what quadrant the third intersecting point P3 is located, and the comparator 513 compares the data to determine whether the fourth intersecting point P4 is located in the fourth quadrant. The comparators 504, 507 and 510 compare the data to determine whether the intersecting points P1 or P14, P2 and P3 are located in the first quadrant of the coordinate system of the circular CCD sensor 151, the comparator 505, 508 and 511 compare the data to determine whether the intersecting points P1 or P14, P2 and P3 are located in the second quadrant, and the comparators 506, 509 and 512 compare the data to determine whether the intersecting points P1 or P14, P2 and P3 are located in the third quadrant.

When the reference point of the register mark 21 is found located in the first quadrant of the coordinate system of the circular CCD sensor 151 (excluding the cases where the reference point is on the coordinate axes) from the judgment results of these comparators 514 and 513, a signal is outputted from an AND circuit AND14. It is in the cases of FIG. 14.2, and FIGS. 15.01, 15.02, 15.09 that a signal is outputted from the AND circuit AND14. At this time, the signal is sent via OR circuits OR1, OR6 and OR5 to a multiplexer 514 where a P2 angle θ2 is selected. The P2 angle θ2 is inputted to an X registering error circuit 516 to calculate a registering error dx=r·cosθ2 where r is the radius of the circle of the circular CCD sensor 151.

The signal of the AND circuit AND14 is also sent to another multiplexer 515 where a P1 angle θ1 is selected. The P1 angle θ1 is inputted into a Y registering error circuit 517 to calculate a registering error dy=r·sinθ1.

These registering errors dx and dy are transmitted to a registering means 800, which is designed to perform register adjustment on the basis of the registering errors dx and dy.

When the reference point of the register mark 21 is located in the second quadrant of the coordinate system of the circular CCD sensor 151 (excluding the cases where the reference point is on the coordinate axes), a signal is outputted from AND circuits AND15 and AND18. It is in the cases of FIGS. 15.04, 15.10 that a signal is outputted from the AND circuit AND15. At this time, the signal is sent via an OR circuit OR2 to a multiplexer 64 where a P1 angle θ1 is selected. The signal is also sent via an OR circuit OR7 to a multiplexer 515 where a P2 angle θ2 is selected. Thus, the registering errors dx and dy are calculated in the same manner as described above, and the registering means 800 performs register adjustment on the basis of these registering errors dx and dy.

It is in the cases of FIG. 14 and [12] in FIG. 15 that a signal is outputted from the AND circuit AND18. At this time, the signal is sent via OR circuits OR3 and OR5 to the multiplexer 514 where a P2 angle θ2 is selected. The signal is also sent to the multiplexer 515 where a P3 angle θ3 is selected. Thus, the registering errors dx and dy are calculated in the same manner as described above, and the registering means 800 performs register adjustment on the basis of the registering errors dx and dy.

When the reference point of the register mark 21 is located in the third quadrant of the coordinate system of the circular CCD sensor 151 (excluding the cases where the reference point is on the coordinate axes), a signal is outputted from AND circuits AND16 and AND17. It is in the cases of FIGS. 15.06, 15.11 that a signal is outputted from the AND circuit AND16. At this time, the signal is sent via an OR circuits OR1, OR6 and OR5 to the multiplexer 514 where a P2 angle θ2 is selected. The signal is also sent to the multiplexer 515 where a P1 angle θ1 is selected. Thus, the registering errors dx and dy are calculated in the same manner as described above, and the registering means 800 performs register adjustment on the basis of these registering errors dx and dy.

It is in the cases of FIG. 14.4 and FIG. 15.5 that a signal is outputted from the AND circuit AND17. At this time, the signal is sent via OR circuit OR4 to the multiplexer 514 where a P3 angle θ3 is selected. The signal is also sent via an OR circuit OR7 to the multiplexer 515 where a P2 angle θ2 is selected. Thus, the registering errors dx and dy are calculated in the same manner as described above, and the registering means 800 performs register adjustment on the basis of the registering errors dx and dy.

When the reference point of the register mark 21 is located in the fourth quadrant of the coordinate system of the circular CCD sensor 151 (excluding the cases where the reference point is on the coordinate axes), a signal is outputted from AND circuits AND7, AND8 and AND9. It is in the case of FIG. 15.12 that a signal is outputted from the AND circuit AND7. At this time, the signal is sent via an OR circuit OR2 to the multiplexer 514 where a P1 angle θ1is selected. The signal is also sent vis the OR circuit OR7 to the multiplexer 515 where a P2 angle θ2 is selected. Thus, the registering errors dx and dy are calculated in the same manner as described above, and the registering means 800 performs register adjustment on the basis of these registering errors dx and dy.

It is in the cases of FIGS. 15.07, 15.08 that a signal is outputted from the AND circuit AND8. At this time, the signal is sent via OR circuits OR3 and OR5 to the multiplexer 514 where a P2 angle θ2 is selected. The signal is also sent to the multiplexer 515 where a P3 angle θ3 is selected. Thus, the registering errors dx and dy are calculated in the same manner as described above, and the registering means 800 performs register adjustment on the basis of the registering errors dx and dy.

It is in the cases of FIG. 14.5 that a signal is outputted from the AND circuit AND9. At this time, the signal is sent via an OR circuit OR4 to the multiplexer 514 where a P3 angle θ3 is selected. The signal is also sent to the multiplexer 515 where a P4 angle θ4 is selected. Thus, the registering errors dx and dy are calculated in the same manner as described above, and the registering means 800 performs register adjustment on the basis of the registering errors dx and dy.

When the reference point of the register 21 is on the X axis of the coordinate system of the circular CCD sensor 151, on the other hand, a comparator 503 outputs a signal to indicate that the reference point is on the X axis. It is in the cases of FIGS. 14.1, 14.6, 14.7 that the comparator 503 outputs a signal. At this time, the signal from the comparator 503 is inputted to AND circuits AND11 and AND12.

In the case of FIG. 14.1, furthermore, the comparator 507 outputs a signal to indicate that the intersecting point P2 agrees with the Y axis of the coordinate system of the circular CCD sensor 151, and that signal is inputted to AND circuits AND12 and AND13.

With this, a XY-register signal is outputted from the AND circuit AND12, and an XY-register display is displayed on a display means 900. That is, the registering errors dx and dy are 0, meaning that no register adjustment is needed.

In the cases of FIGS. 14.6, 14.7, a signal is outputted to indicate that the intersecting point P3 agrees with the X axis of the coordinate system of the circular CCD sensor 151, and that signal is inputted to the AND circuit AND11. With this, a P1Y-register signal is outputted from the AND circuit AND11, and a Y-register display is displayed on the display means 900. At the same time, a signal is also sent via the OR circuit OR5 to the multiplexer 514 where a P2 angle θ2 is selected. Thus, the registering error dx due to the P2 angle θ2 is calculated in the same manner as described above, and the registering means performs register adjustment only for the registering error dx. That is, adjustment for the registering error dy is not needed since register is accomplished in the Y-axis direction When the reference point of the register mark 21 is on the Y axis of the coordinate system of the circular CD sensor 151, comparators 504 and 507, for example, output a signal indicating that the reference point is on the Y axis. It is in the case of FIG. 14.9 that the comparator 504 outputs a signal, and it is in the case of FIG. 14.8 that the comparator 507 outputs a signal. At this time, the signal of the comparator 504 is inputted to the AND circuit AND10, and the signal of the comparator 507 is inputted to the AND circuit AND13.

In the case of FIG. 14.9, the comparator 512 outputs a signal indicating that the intersecting point P3 agrees with the Y axis of the coordinate system of the circular CCD sensor 151, and that signal is inputted to the AND circuit AND10. With this, a P1X-register signal is outputted by the AND circuit AND10, and an X-register display is displayed on the display means 900. At the same time, a signal is also sent via the OR circuit OR7 to the multiplexer 515 where a P2 angle θ2 is selected. Thus, the registering error dy due to the P2 angle θ2 is calculated in the same manner as described above, and the registering means 800 performs register adjustment only for the registering error dy. Register adjustment for the registering error dx is not needed since register is accomplished in the X-axis direction.

In the case of FIG. 14.8, the comparator 513 outputs a signal indicating that the intersecting point P4 agrees with the Y axis of the coordinate system of the circular CCD sensor 151, and the signal is inputted to the AND circuit AND13. With this, a P2X-registering signal is outputted by the AND circuit AND13, and an X-register display is displayed on the display means 900. At the same time, a signal is also sent via the OR circuit OR6 to the multiplexer 515 where a P1 angle θ1 is selected. Thus, the registering error due to the P1 angle θ1 is calculated in the same manner as described above, and the registering means 800 performs register adjustment for the registering error dy. At this time, a signal is also sent via the OR circuit OR5 to the multiplexer 514 where a P2 angle θ2 is selected. However, since data on θ2=90° is inputted to the X register error circuit 516 and a registering error dx=0 is obtained, adjustment of the registering error dx is not necessary. In other words, register is accomplished in the X-axis direction, as displayed on the display means 900.

In the foregoing, description has been made on a register mark 21 for black. Registering errors are detected in the same manner on a register mark for cyan, magenta and yellow ([1] in FIG. 20). Thus, registering errors are performed for all colors, and color matching is completed.

Figure 21:
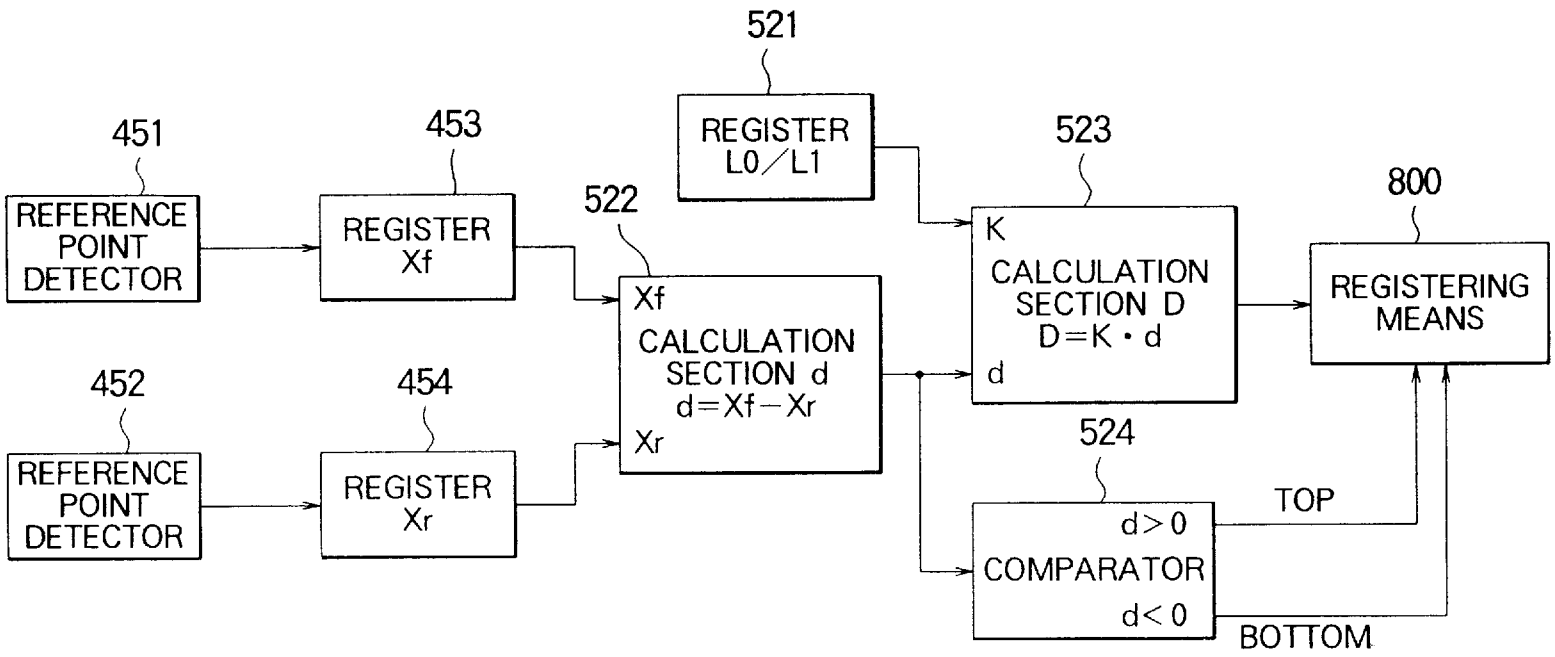
FIG. 21 is a block diagram illustrating the configuration of an example of the inclination detecting circuit.

FIG. 21 shows an example of the inclination detection circuit used in this invention.

In the figure, reference numeral 800 corresponds with that shown in FIG. 19. Numerals 451 and 452 refer to reference-point detection sections, 453, 454 and 421 to registers, 522 and 523 to calculating sections, and 524 to a comparator, respectively.

The reference-point detection section 451 detects the X-direction reference point of the leading register mark 21 for black and obtains data on the coordinates of the leading reference point using the circuit as described above. The data Xf on the leading reference point is latched to the register 453. Similarly, the reference-point detection section 452 detects the X-direction reference point of the trailing register mark 21 for black, and the resulting data Xr is latched to the register 454. To the register 521 latched in advance as a fixed value is the ratio L0/L1 of the paper width L0 as described with reference to FIG. 5 and the distance L1 between the leading and trailing register marks 21 for black.

In the calculating section 522, d=Xf−Xr is calculated based on the data latched to the registers 453 and 454, and multiplication of the ratio L0/L1 latched to the registers 453 and 454 and the value of d obtained in the calculating section 522 is performed in the calculating section 523 to detect the amount of inclination D. The amount of inclination D calculated is transmitted to the registering means 800, together with the correcting direction instruction signal obtained by detecting in which direction the plated in inclined, using the comparator 524. On the basis of this data, the registering means 800 adjusts the inclination D.

When one of the register marks 21 the coordinate positions of which are printed is regarded as a register-mark detecting and calculating coordinate, a coordinate Xf for detecting and calculating the register mark 21 to be used as a reference is latched in advance from an operation console to the register 453, using an appropriate signal (not shown), such as a correcting direction instruction signal for a leading register mark 21 as a reference value, and a registering error between Xf and data Xr on the trailing register mark 21 latched to the register 454 is obtained. Registering errors between colors to be overprinted can be obtained using the register mark for any one color as a reference.

Figure 22:
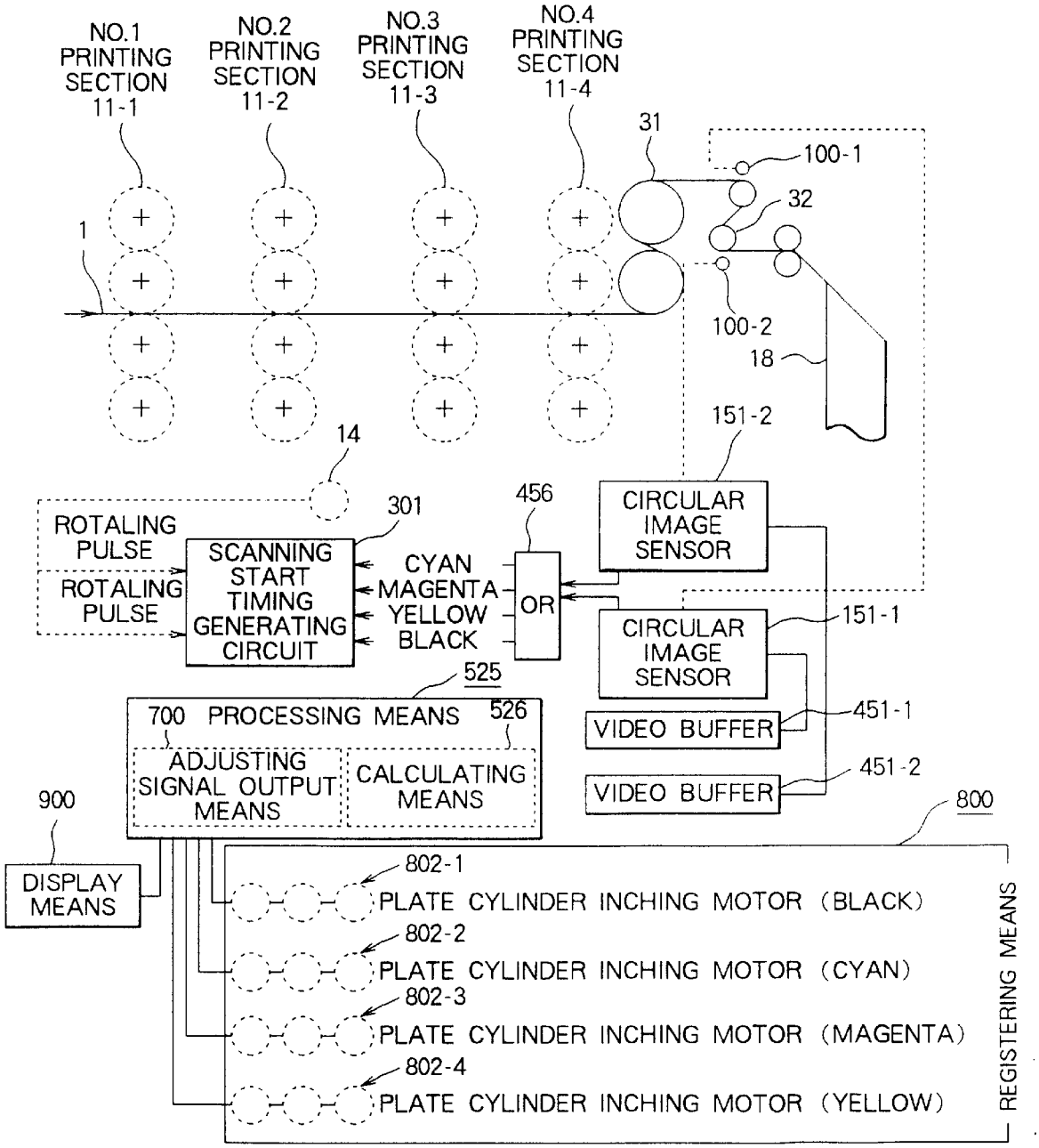
FIG. 22 is a block diagram illustrating the configuration of an example of the automatic register control system for multi-color rotary presses.

FIG. 22 shows an example of the automatic registering control system in multi-color rotary presses.

In the figure, a paper web 200 on which printing elements, including register marks for black, cyan, magenta and yellow in that order, are printed is passed through a chill roller 31 and a roller 32, cut into an appropriate length and placed in a folding section 18. CCD cameras 100-1 and 100-2 for detecting register marks on the front and rear sides of the paper web 200 is installed halfway the above process, and scanning data obtained the circular CCD sensors 151-1 and 151-2 in the CCD cameras 100-1 and 100-2 are stored in the video buffers 455-1 and 455-2.

The scanning data stored in the video buffers 455-1 and 455-2 are inputted to a processing means 525 for computer processing. The processing means 525 has the registering error shown in FIGS. 16 and 17, the calculating/judgment circuit shown in FIGS. 18 and 19, a calculating means 526 having the inclination detection circuit shown in FIG. 21, and an adjustment signal output means 700.

On the basis of signals for the register marks 21 inputted via the OR circuit 456 in the order of black, cyan, magenta and yellow, and also on the basis of rotation pulses and one-rotation pulses generated from the encoder 14 in synchronism with the rotation of the plate cylinder, timing pulses are produced in a scanning start timing generating circuit 301 to give appropriate timing to the processing means 525.

As described above, the processing means 525 calculates the vertical and horizontal registering errors of the register marks for each color and actuates a known registering means 800 to eliminate the registering errors and achieve register.

In the figure, three units each of plate-cylinder inching motors 802-1 through 802-4 for each color are shown for adjusting vertical registering errors, horizontal registering errors and inclined registering errors. Needless to say, the above three plate-cylinder inching motors 802-1 through 802-4 for each color are provided on each plate cylinder for front and rear sides in a rotary press for multi-color printing both sides of the paper web 200.

Though not shown, the processing means 802 judges, using appropriate comparators, etc., whether the registering errors obtained can be adjusted by the registering means 800, and if the registering error exceeds the adjustable range of the registering means 800, the registering means 800 are inactivated and a sign indicating that the registering means 800 cannot adjust the registering error is displayed on the display means 900, together with X- and Y-registering errors, XY register, X register and Y register, and an alarm is also issued.

That is, if the number of detected intersecting points between the circular CCD sensor 151 and a register mark is less than two due to an extremely large shift in register, the registering error cannot be calculated. This is judged by counting the signal generated by a decimal decoder 423 shown in FIG. 16 using a counter (not shown) to see if the count number reaches a predetermined number. That is, when the value n1 latched to the register n1 is n1>1 and the number of signals from the decimal decoder 423 is less than 2 (that is, the number of signals in FIG. 5 is up to signal 1 at most), or when n1=1 and the number of signals from the decimal decoder 423 is less than three (that is, the number of signals in FIG. 6 is up to signal 2 at most), the processing means 802 judges that it is impossible to calculate register errors. Then, the processing for the unadjustable state is executed, as described above.

Figure 23:
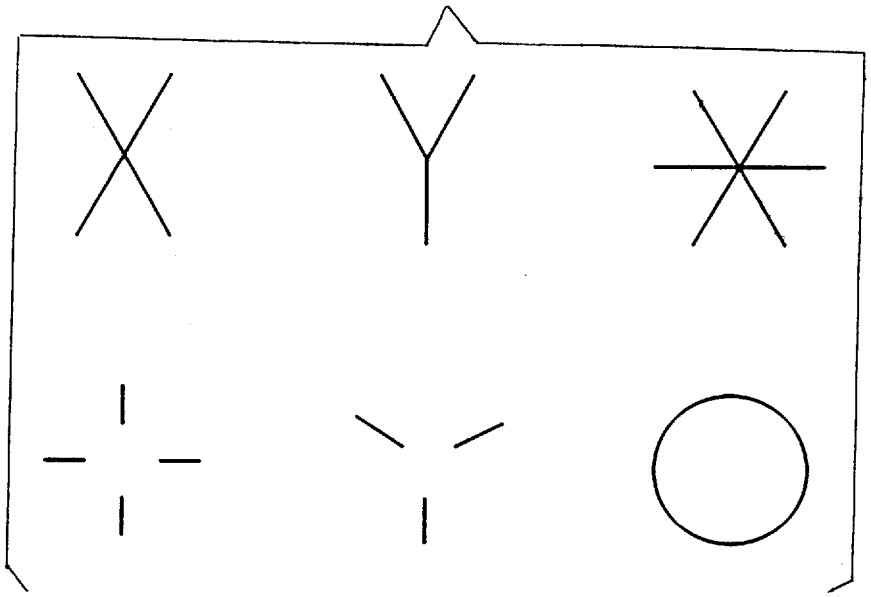
FIG. 23 is a diagram illustrating another examples of register marks.

In the foregoing, description has been made on the register mark 21 having a tangible reference point. Register marks may be of any other shapes, such as those of a shape having a tangible reference point shown, or those having no tangible clearly shown reference points but a particular reference point that can be detected, as shown in FIG. 23, or those of a circular shape.

The position of a register mark having an intangible reference point where two or three lines can intersect with each other in a predetermined relationship can also be easily detected in the same manner as described above. A register mark having a circular reference point is detected in the following manner.

Figure 24:
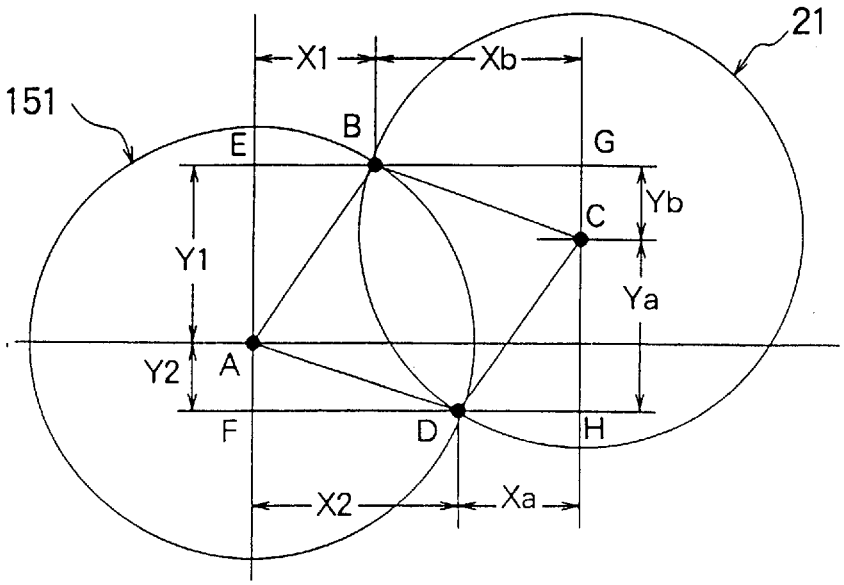
FIG. 24 is a diagram of assistance in explaining the detection of reference points when a register mark is a circle.

FIG. 24 is a diagram of assistance in explaining the detection of the reference point of a register mark having a circular reference point.

In the figure, numeral 151 refers to a circular CCD sensor; 21 to a circle of the register mark of the same diameter as that of the circular CCD sensor 151.

In a coordinate system with the center of the circular CCD sensor 151 as its origin, when it is assumed that the intersecting points of the circular CCD sensor 151 and the register mark 21 are B and D, the reference point intrinsic to the register mark 21, that is, the central point C, can be obtained as follows:

Let the coordinates of the intersecting points B and D be (X, Y1) and (X2, Y2), ΔABE and ΔCDH are congruous, and ΔADF and ΔCBG are congruous. Therefore, X1=Xa, X2=Xb, Y1=Ya, and Y2=Yb. The coordinates (X, Y) of the central point C of the register mark 4 are X=X1+X2, Y=Y1+Y2.

That is, the coordinate position of the central point C of the register mark 21 can be detected from the picture element number detected by the circular CCD sensor 151.

Even when the circle of the register mark 21 is filled in with a color, the above procedures can be applied.

The method and apparatus for detecting registering errors, and the automatic register control system embodying this invention using the above-mentioned first registering-error detection method have the following beneficial effects.

(1) There is no need for using register marks of special shapes to detect registering errors. Instead, register marks of conventional shapes can be used. By detecting each register mark with a single scanning operation, the coordinate position of the reference point of the register mark, and a deviation between the detected coordinate position and the original position can be easily obtained. Register marks of relatively diverse types can be used.

(2) The coordinate position of the reference point of a register mark is calculated based on the detected position of the center line of the register mark. This eliminates the adverse effects of fluctuations in the thickness of printing elements caused during plate printing and printing processes. This results in high precision registering-error detection and register control.

(3) Since X-register, Y-register and XY-register displays are provided on the display means, users can easily know in what direction register adjustment is needed and not needed. When automatic register control cannot be achieved because a register mark cannot be detected in a predetermined state, and because the detected registering error, that is, the deviation, is too large, that state is displayed and an alarm is issued, allowing users to take corrective measures.

(4) Since register marks can be easily read, and registering errors can be easily detected, inexpensive registering-error detecting apparatus and register control apparatus can be accomplished.

Next, description will be made in the following on the second detection method where a plurality of rectangular or square register marks are printed on a traveling paper web for each printing section in a direction traversing the travelling direction of the traveling paper web, picture-element data of each of the register marks are acquired by scanning a CCD matrix sensor of a CCD camera, in which a plurality of sensing elements are arranged, at a timing related to the rotation of the aforementioned printing section, and the coordinate position of the gravity center of each register mark is calculated based on the acquired picture-element data on the register mark to obtain a deviation between the coordinate position of the register mark and its aimed coordinate position to detect registering errors in a multicolor rotary press.

In this registering-error detection method, the image data on a plurality of rectangular or square register marks are obtained by a CCD matrix sensor. Based on the image data, the coordinate position of the gravity center of the register mark is calculated, and the calculated coordinate position of gravity is compared with the aimed coordinate position of the register mark to obtain the deviation as a registering error. In the following, the second registering-error detection method will be described.

FIG. 25 shows an example of register-mark layout according to this invention.

Rectangles or squares of less than 1 mm×1 mm are used as register marks for the second registering-error detection method. These register marks are printed in a predetermined layout with a non-printing-element area on the newsprint surface shown in FIG. 26, which will be described later. Examples of register-mark layouts are shown as FIGS. 25.1, 25.2, 25.3, 25.4, 25.5, 25.6.

By combining rectangles and squares, the same detection accuracy can be achieved. In this detection method where rectangular or square register marks are used and gravity coordinates are detected after special correction is made on the image data of register marks, fluctuations in the thickness of printing elements have little effect on detection accuracy.

Figure 26:
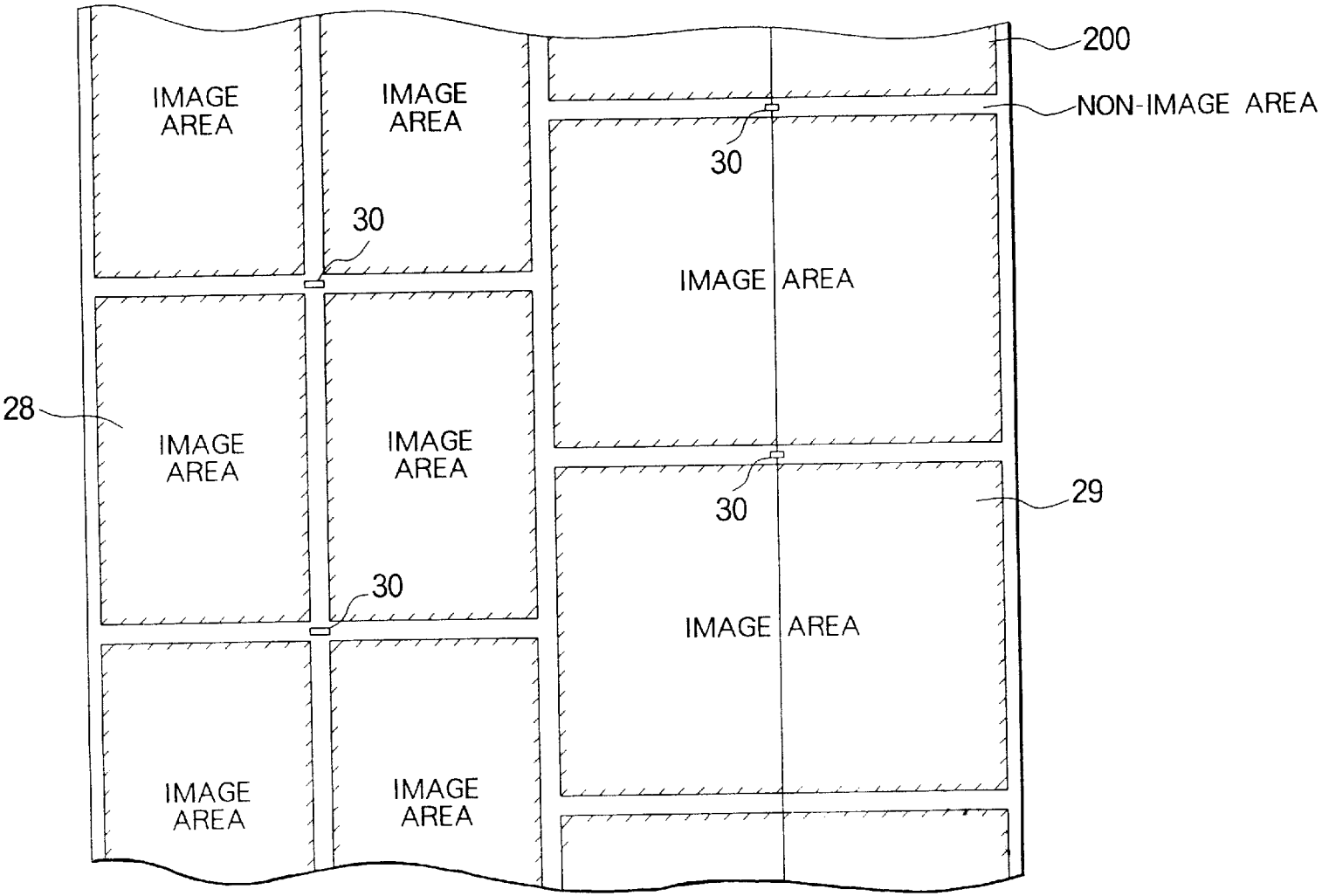
FIG. 26 is a diagram of assistance in explaining the layout of register marks printed on a traveling paper web.

FIG. 26 is a diagram illustrating the layout of register marks printed on the traveling paper web.

In the figure, numeral 28 refers to an image area to be printed on a plate surface area for one page of the traveling paper web 200, while numeral 29 refers to another image area for a two-page spread.

The register marks shown in (1) through (6) in FIG. 25 used in this error detection method are printed on a printing area 30.

Figure 27:
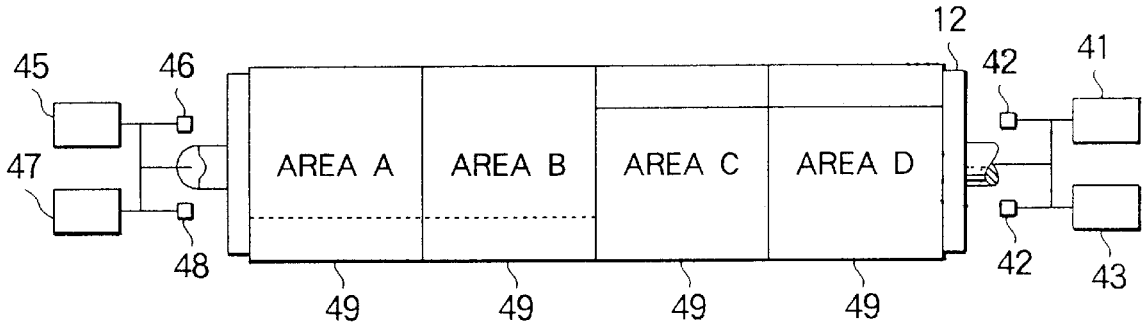
FIG. 27 is a block diagram illustrating the mechanism of a split plate cylinder.

FIG. 27 is a diagram outlining the mechanism of a split plate cylinder.

In the figure, numeral 41 refers to a motor with a reduction gear for controlling Area-C and Area-D plates in the vertical direction, numeral 42 to a potentiometer installed on the output shaft of the reduction gear, 43 to a motor with a reduction gear for controlling Area-C and Area-D plates in the horizontal direction, 44 to a potentiometer installed on the output shaft of the reduction gear. Numerals 45, 46, 47 and 48 refer to motors with reduction gears, and potentiometers for controlling Area-A and Area-B plates in the vertical and horizontal directions. Numeral 49 refers to a plate mounted on a plate cylinder. Numeral 12 refers to a plate cylinder.

Figure 28:
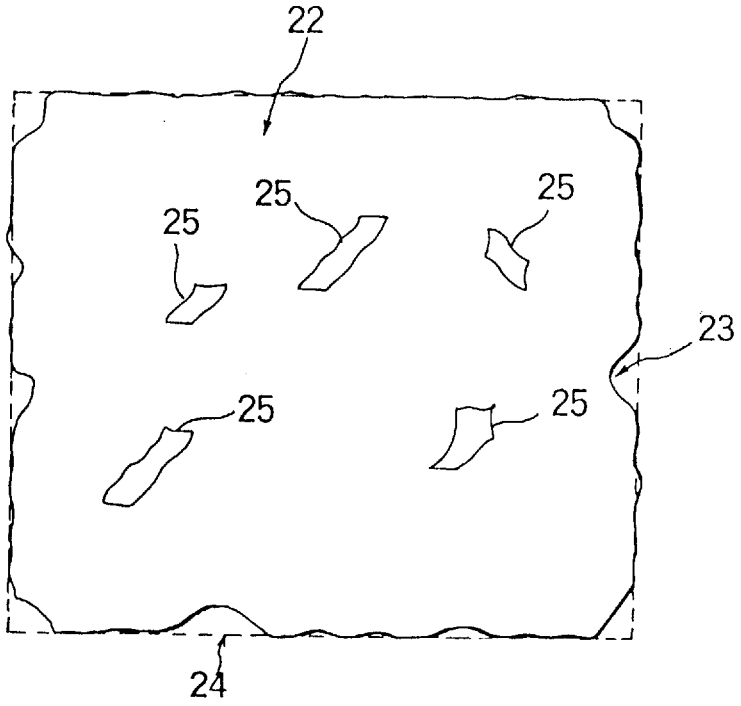
FIG. 28 is a diagram illustrating the state where register marks are printed on a newsprint web.

FIG. 28 shows the state where register marks are printed on a newspaper.

In the figure, numeral 22 refers to a printed register mark, 23 to an actual round shape of the register mark; 24 to the state where the outer edge of the register mark has not been printed; 25 to a printing error. When printed on a fibrous newsprint surface, a register mark 22 tends to involve printing errors often of a surface area less than about 20 μm×20 νm. A printing error is a state where too little ink is deposited on the paper surface for the CCD sensor to discriminate the register mark 22 from the background color.

Should sharp-edge areas of the register mark 22 not be printed properly, the accuracy in detecting gravity coordinates would have to be lowered unless such printing errors are corrected. Although printing errors seldom occur on quality printing paper, such as coated paper, this invention can be applied to both newspaper printing and commercial printing.

Figure 29:
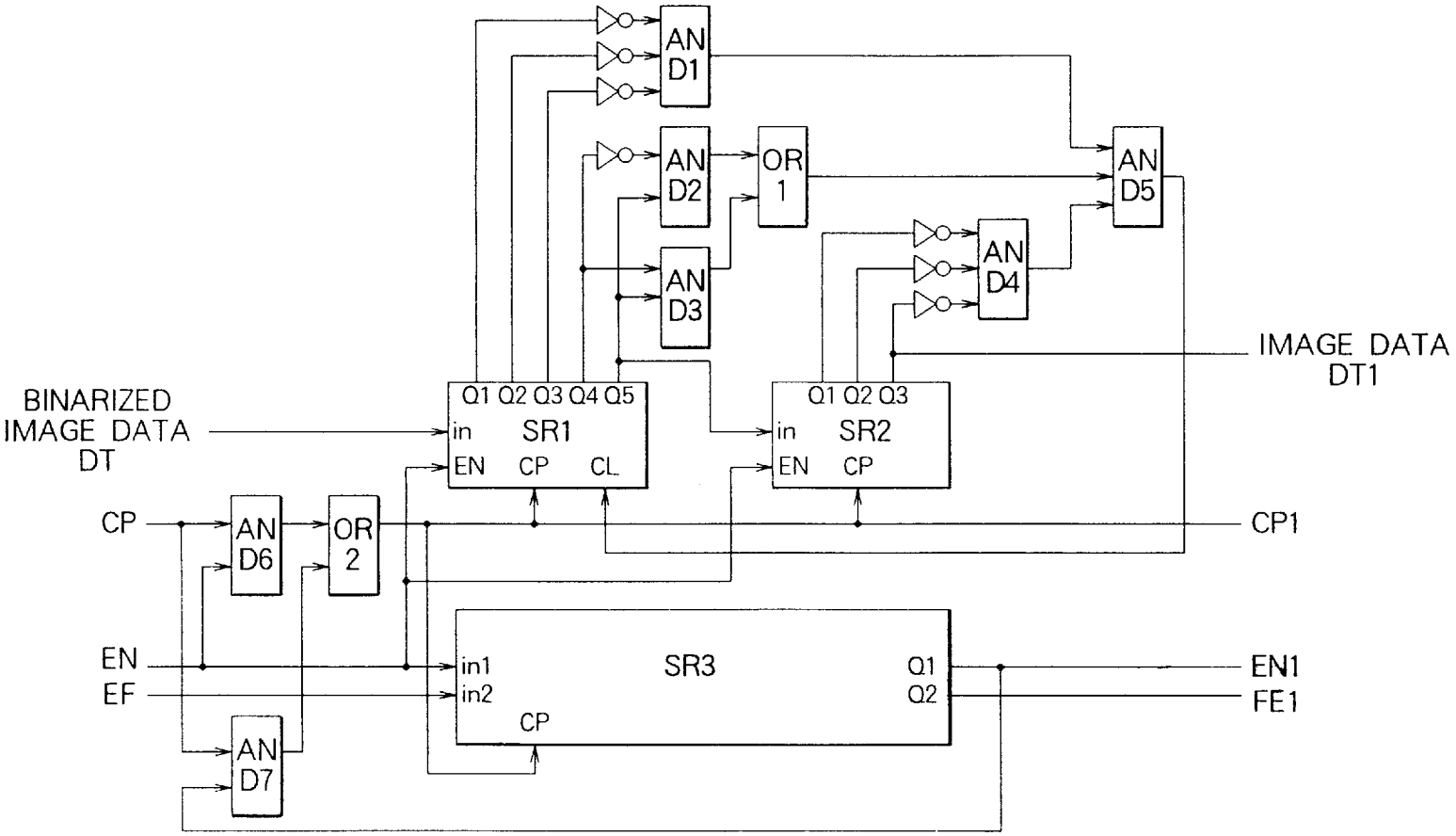
FIG. 29 is a block diagram illustrating an example of the noise reduction majority circuit.

Next, an example of the noise reduction majority circuit is shown in FIG. 29. Since noise, such as a contaminated paper surface caused by the adverse effects of ink mist depositing and other unfavorable phenomena taking place during printing, lowers the accuracy in reading register marks, this invention provides a noise reduction method. The incidence rate of such noises is normally one or two on a continuous underlying color.

As an example of correcting the reading of the register 22 using the noise reduction majority circuit shown in FIG. 29, trains of 8 continuous image data of the register mark 22, in which noise is produced are shown in FIG. 30.

FIG. 30.1 shows one noise generated in the binarized image data outputted by a CCD camera. FIG. 30.2 show two noises generated in the image data. In FIGS. 30.1 and 30.2, "1" represents noise.

Figure 31:
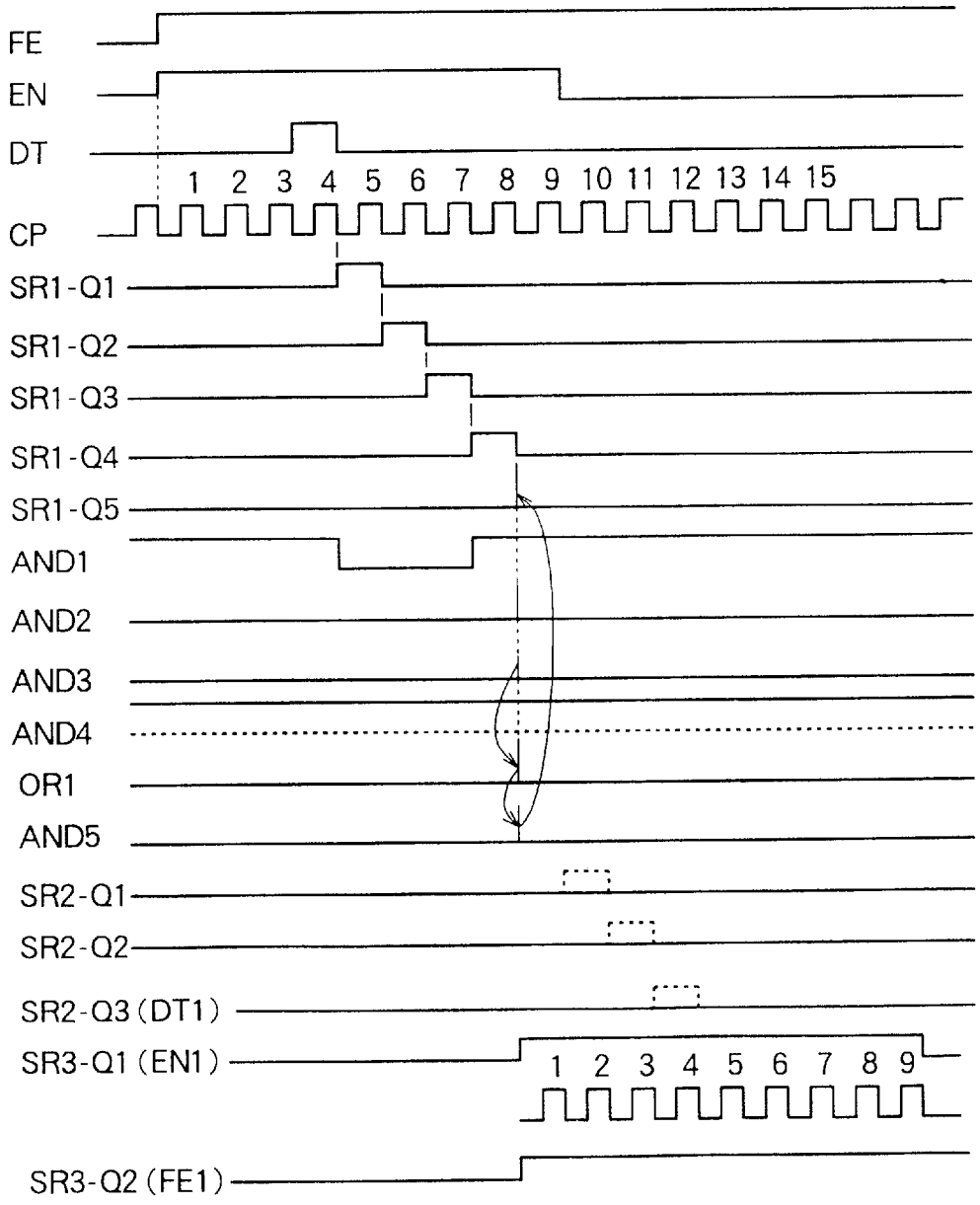
FIG. 31 is a timing chart of the image data shown in FIG. 30 (1).

An image signal containing these noises is inputted as a binarized image data DT into the noise reduction majority circuit shown in FIG. 29. The image signal is shifted as shift registers SR1 and SR2 are operated by a picture-element effective signal EN and a picture-signal shift signal CP. During this process, when a noise "1" in the image data shown in FIG. 30.1 is shifted to the Q5 of the shift register SR1, as shown in a timing chart of FIG. 31, an AND circuit AND2 becomes HIGH. This signal brings an OR circuit OR1 to HIGH, and an AND circuit AND5 to HIGH, clearing the shift register SR1. This operation removes the noise "1."

Figure 32:
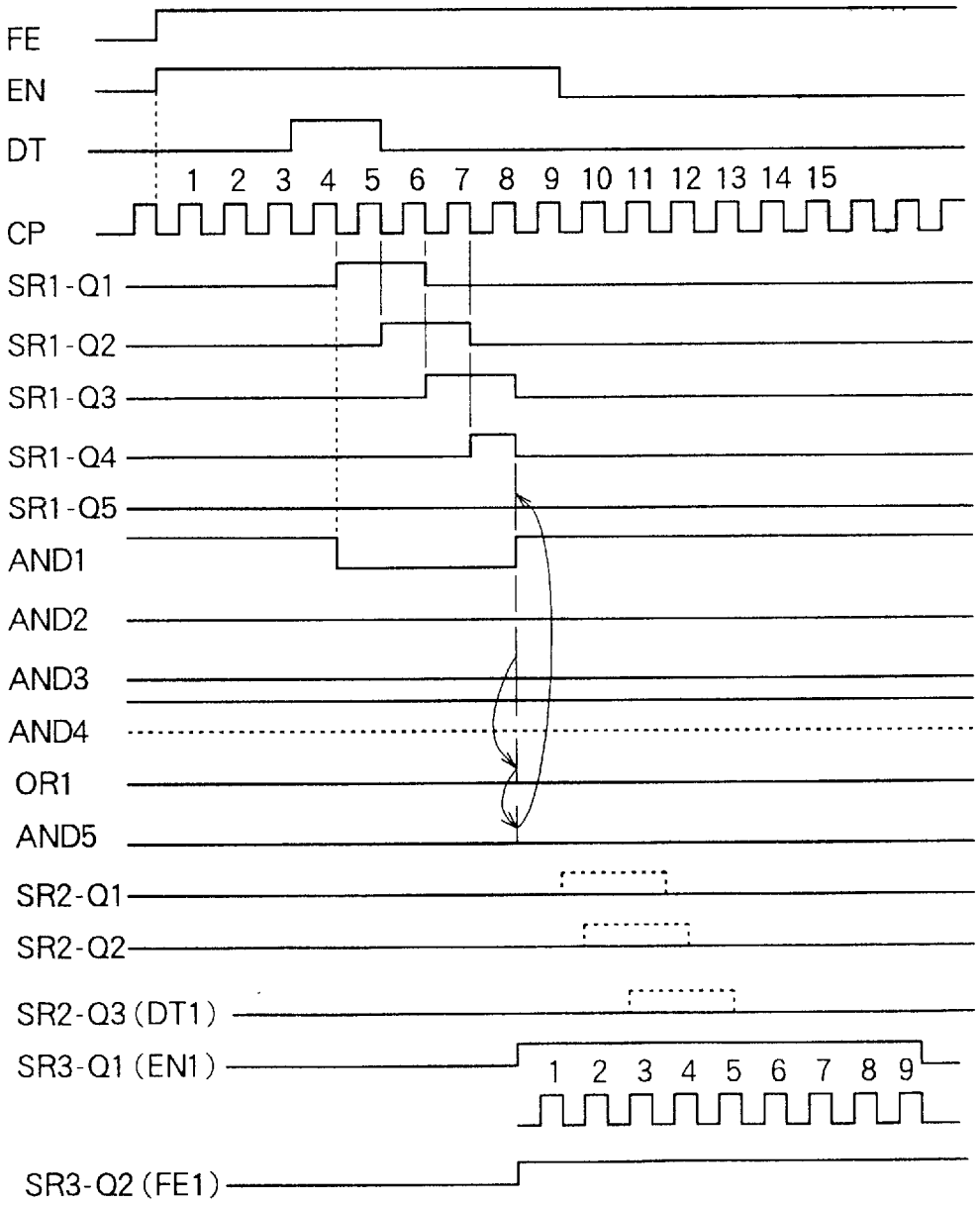
FIG. 32 is a timing chart of the image data shown in FIG. 30 (2).

In the case of the image data shown in FIG. 30.2, when the Q5 of the shift register SR1 becomes HIGH, as shown in a timing chart of FIG. 32, bringing an AND circuit AND3 to HIGH, causing the OR circuit OR1 (HIGH)→the AND circuit AND5 (HIGH) to operate, clearing the shift register SR1. This operation removes two noises "1."

FIG. 33 shows an example of image data to which a simplified CCD matrix sensor reads one register mark.

In the figure, [1] denotes an image data, and [0] a non-image data. H lines 0–17 represent column lines, while V lines 0–17 row lines. The image data [1] and the non-image data [0] are outputted sequentially in series, starting from 0 row in the direction of column lines, and inputted as an image signal DT1 into the image repair circuit shown in FIG. 3.

FIG. 34 shows an example of a logic filter for image repair.

The logic filter consists of four patterns; *1, *2, *3, and *4. When bits near [(1)] in the figure are formed in the manner as shown in the figure based on [(1)], the logic filter makes the [X} bit in the figure [1]. That is, the non-image data [0] is reversed into an image data [1]. [(1)] is a logic [1] as data. When 2 lines of a preceding H-line data and a succeeding H-line data are shifted simultaneously and passed through the logic filter, an image can be repaired.

FIG. 35 is a diagram illustrating the repair of an image where the logic filter is applied to image data.

That is, FIG. 35 is a diagram of assistance in explaining the repair of an image by applying the logic filter for image repair shown in FIG. 34 to the image data shown in FIG. 33. The data on the row lines 2 and 3 in FIG. 35 represent the data on the V lines 2 and 3 in FIG. 33. By applying the logic filters *1 and *2 to the positions where images are missing, the data of logic [0] is replaced with logic [1]. This means that the images are repaired. Images in the row lines (4, 5), (6, 7), (10, 11), (12, 13), and (14, 15) in FIG. 35 are also repaired in the same manner as described above. In order to successfully repair images, register marks 22 must be of a rectangular or square shape.

Figure 36:
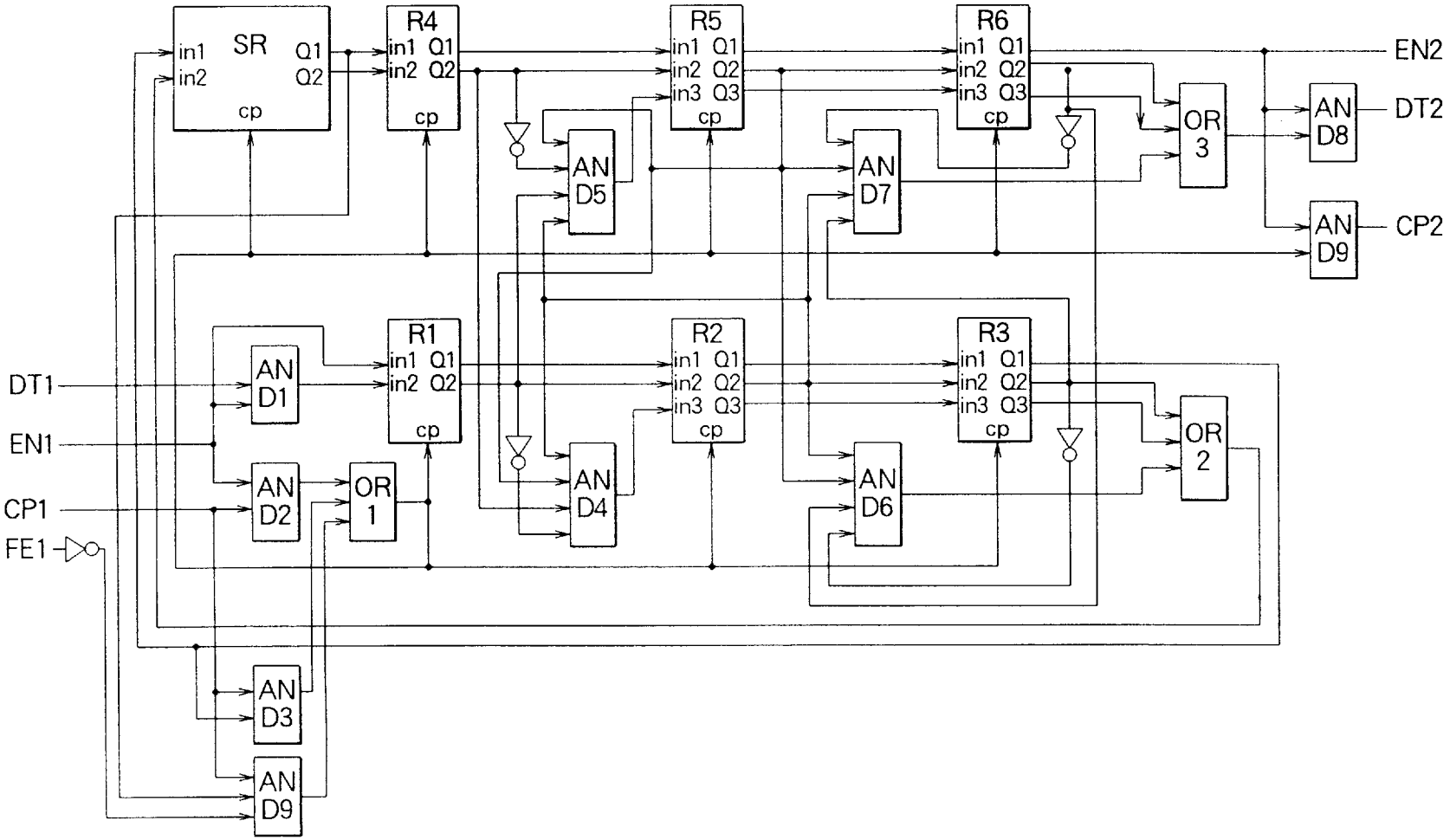
FIG. 36 is a diagram illustrating an example of the image correcting circuit.

FIG. 36 shows an example of the image repairing circuit.

FIG. 37 shows an example of image data inputted to the image repair circuit shown in FIG. 36. In the figure, an image data consisting of a preceding row line having 10 picture elements and a succeeding row line having 10 picture elements is shown in the interest of simplicity.

In the following, the operation of the image repairing circuit shown in FIG. 36 will be described.

A CCD matrix sensor consists of 512×512 picture elements, outputs an image data for 0 row line in series, then outputs an image data for 1 row line in series, and outputs sequentially up to 511 row lines. When an image data for a preceding row line is inputted into the image repairing circuit, the data is stored in a 512-bit shift register SR. When an image data for a succeeding line is inputted, the image data for the preceding line is outputted in series from the shift register SR in synchronism with the inputting of the image data for the succeeding line.

Figure 38:
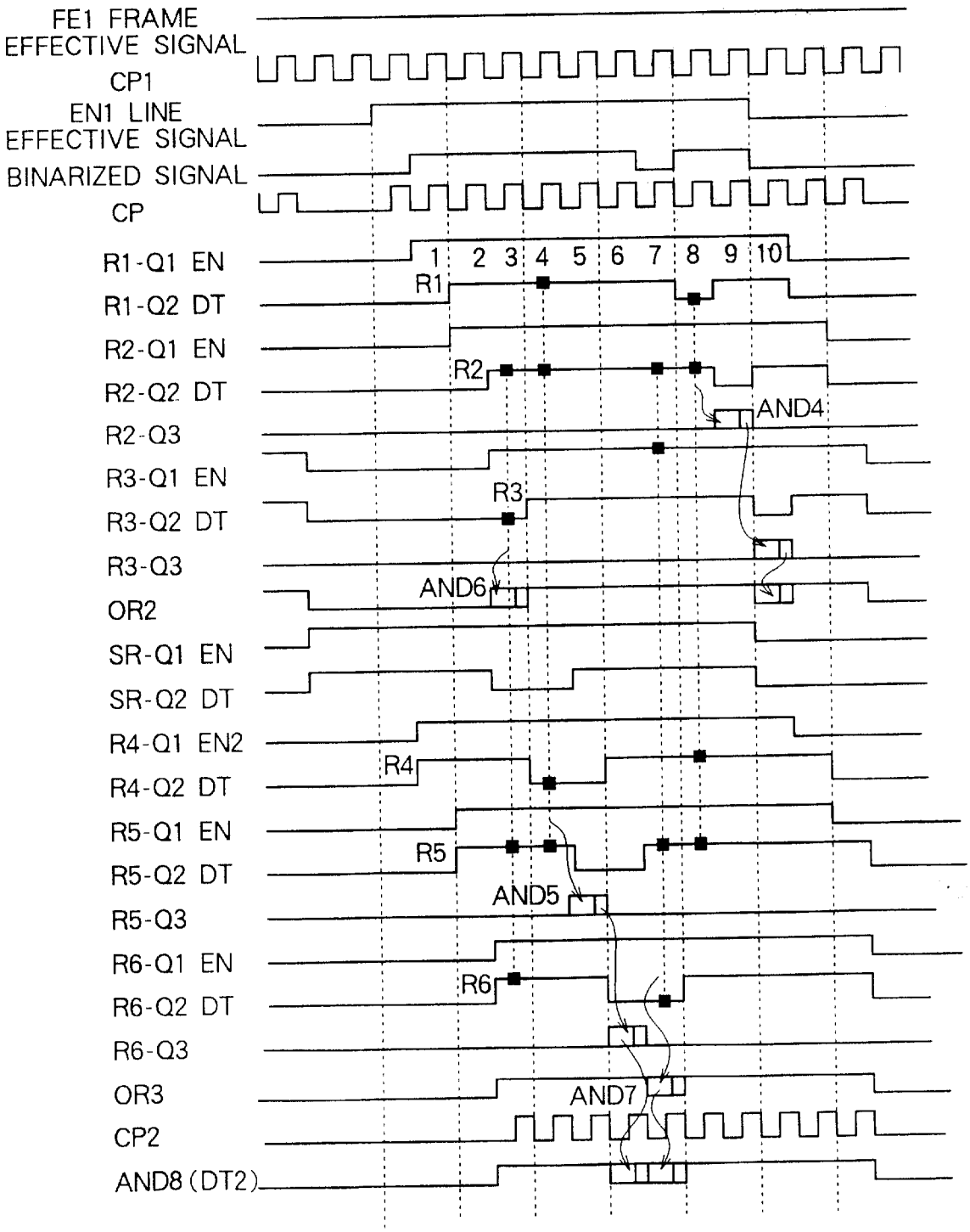
FIG. 38 is a timing chart of the circuit shown in FIG. 36.

The timing chart for this image repairing circuit is shown in FIG. 38. This timing chart is prepared based on the case where the image data shown in FIG. 37 is inputted into the image repairing circuit.

In the image repairing circuit shown in FIG. 36, an image effective signal EN1 and a binarized image signal DT1 and a clock pulse CP1 that is synchronized with the image are inputted into this circuit. The image signal DT1 and the image effective signal EN1 shift registers in a sequence of R1→R2→R3, and inputted and stored in the shift register SR.

The AND circuit AND3 shifts the shift register SR via the OR circuit OR1 with a shift clock CPI pulse until the image effective signal EN1 and the Q1 of the register R3 become LOW.

In synchronism with the shifting of an image signal for the next line to the register R1 in the aforementioned manner, the image data for the preceding line that is stored in the shift register SR is shifted to the register R4, then shifted to the register R5 with the next CPI clock, and then to the register R6 with the next CPI clock. This means that the preceding image signal shifts the registers in a sequence of R4→R5→R6, while in synchronism with this and in parallel, the succeeding image signal shifts the registers in a sequence of R1→R2→R3.

In these states, the logic filter *1 performs filtering on condition that the logic of the registers R5, R2 and R3 is [1], and the logic of the register R6 is [0]. Under these conditions, the output of the AND circuit AND7 becomes HIGH, bringing the output of the OR circuit OR3 to HIGH. Thus, the data is shifted to the binarized image repairing signal DT2 with logic [1] even if the register R6-Q2 is LOW.

The logic filter *2 perform filtering on condition that the logic of the registers R2, R3 and R5 is [1], and the logic of the register R4 is [0]. Under these conditions, the output of the AND circuit AND5 becomes HIGH, being inputted to the input in3 of the register R5. Then, the register R5-Q3 becomes HIGH with the operation of the next clock pulse CP2, and then this signal is shifted to the register R6-Q3 with the next shift clock pulse. Thus, the data is shifted to the binarized image repairing signal DT2 by the OR circuit OR3 with the logic of [1] even if the register R6-Q2 is LOW.

The logic filters *3, *4, *5 and *6 can also repair image data by converting logic [0] into logic [1] in the same manner as described above.

The aforementioned processing can be performed by hardware at a high speed of 45 ms (at a printing speed of 160,000 copies/hour) in real time.

Commercially available processors specially dedicated for image processing, which calculate gravity coordinates by temporarily loading one frame of the image data obtained from the CCD camera into a memory and executing filtering operation, cannot handle image data as fast as 45 ms. Since this detecting system enables high-speed processing, not only reduced waste paper and improved detecting accuracy can be accomplished but also an inexpensive system can be provided.

Figure 39:
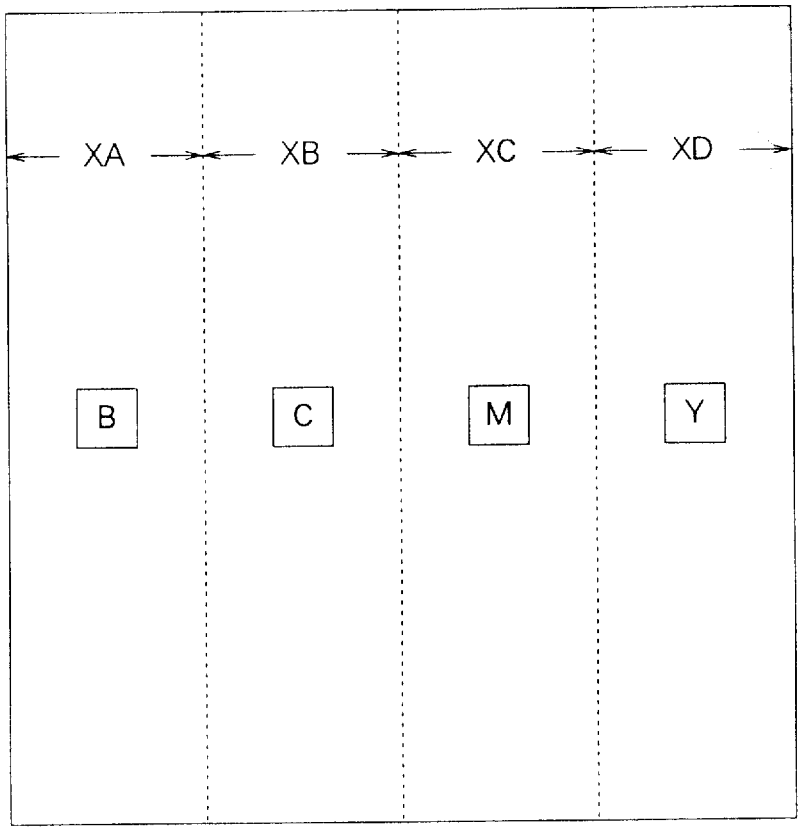
FIG. 39 is a diagram of assistance in explaining an image detecting area of a CCD sensor.

FIG. 39 is a diagram of assistance in explaining the image detecting areas of the CCD sensor.

In the figure, an image detecting area is composed of picture elements of more than 512(H)×512(V). The relationship between the image detecting areas and the positions for reading register marks is as shown by the layout of register marks in (1) of FIG. 25.

The detecting range of register marks is set to XA for B mark in terms of horizontal lines, XB for C mark, XC for M mark and XD for Y mark. The size of each mark is within 1 mm×1 mm and more than 0.5 mm×0.5 mm. The detecting range for register marks arranged as shown in FIG. 25 (2) is set to XA and XB in terms of horizontal lines and to YA and YB in terms of vertical lines.

Next, the method of detecting the gravity (picture center) of register marks.

Figure 40:
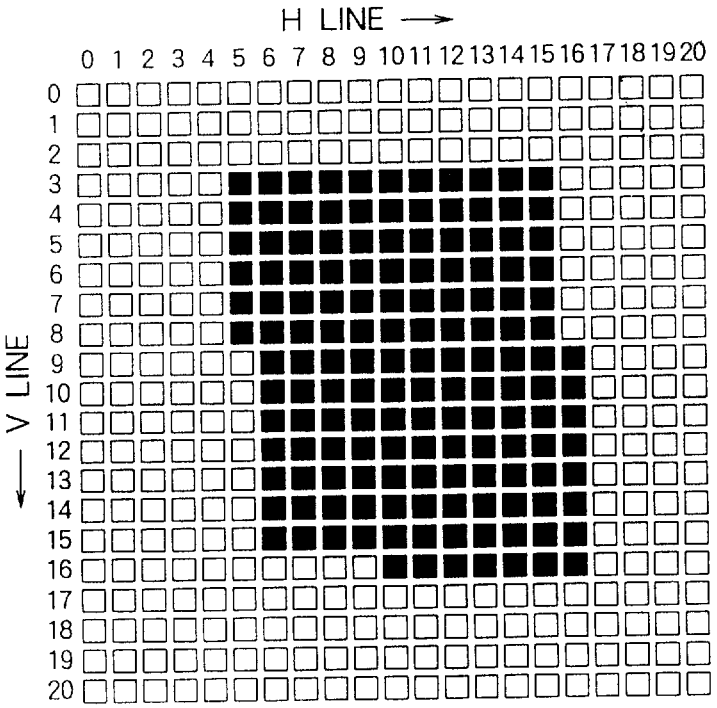
FIG. 40 is a diagram of assistance in explaining the state where a CCD matrix sensor reads an example of the register mark.

FIG. 40 is a diagram of a register mark read by a CCD matrix sensor.

In the figure, □ denotes a background color represented by logic [0], and ■ the color of a register mark represented by logic [1], each corresponding to one picture element of the CCD sensor.

FIG. 40 is composed of 21 H lines and 21 V lines for simplicity, though an actual CCD sensor comprises 512 (H lines) and 512 (V lines).

The X-gravity coordinate is calculated by calculating the cumulative total of H-line coordinate addresses of the image signals (for a register mark) represented by ■ to obtain a value by dividing the cumulative total by the number of register-mark picture elements. The Y-gravity coordinate is calculated by calculating the cumulative total of V-line coordinate addresses of the image signals (for a register mark) represented by ■ to obtain a value by dividing the cumulative total by the number of register-mark picture elements.

FIGS. 41 and 42 show examples of detection results of the X-gravity coordinate and the Y-gravity coordinate as examples of the detection results of register marks.

The X-gravity coordinate and the Y-gravity coordinate can be obtained by the following equations from the total of picture elements corresponding to the image of a register mark, the total of X-coordinate addresses corresponding to each picture element, and the total of Y-coordinate addresses corresponding to each picture element.

X-gravity coordinate=(total of X-coordinate addresses)/(total of picture elements)

Y-gravity coordinate=(total of Y-coordinate addresses)/(total of picture elements)

The detecting coordinates are calculated by obtaining the distances from each mark in both the horizontal and vertical directions with B mark used as the basis. Registering errors are detected by detecting how far the detecting coordinates deviate from the specified values. The position at which an image is read is determined so that a register mark on the paper surface being printed can be read as it reaches a predetermined position.

FIG. 39 shown above also shows the state where each register-mark reading area is set in the picture reading area of the CCD sensor to read register marks as described above.

Figure 43:
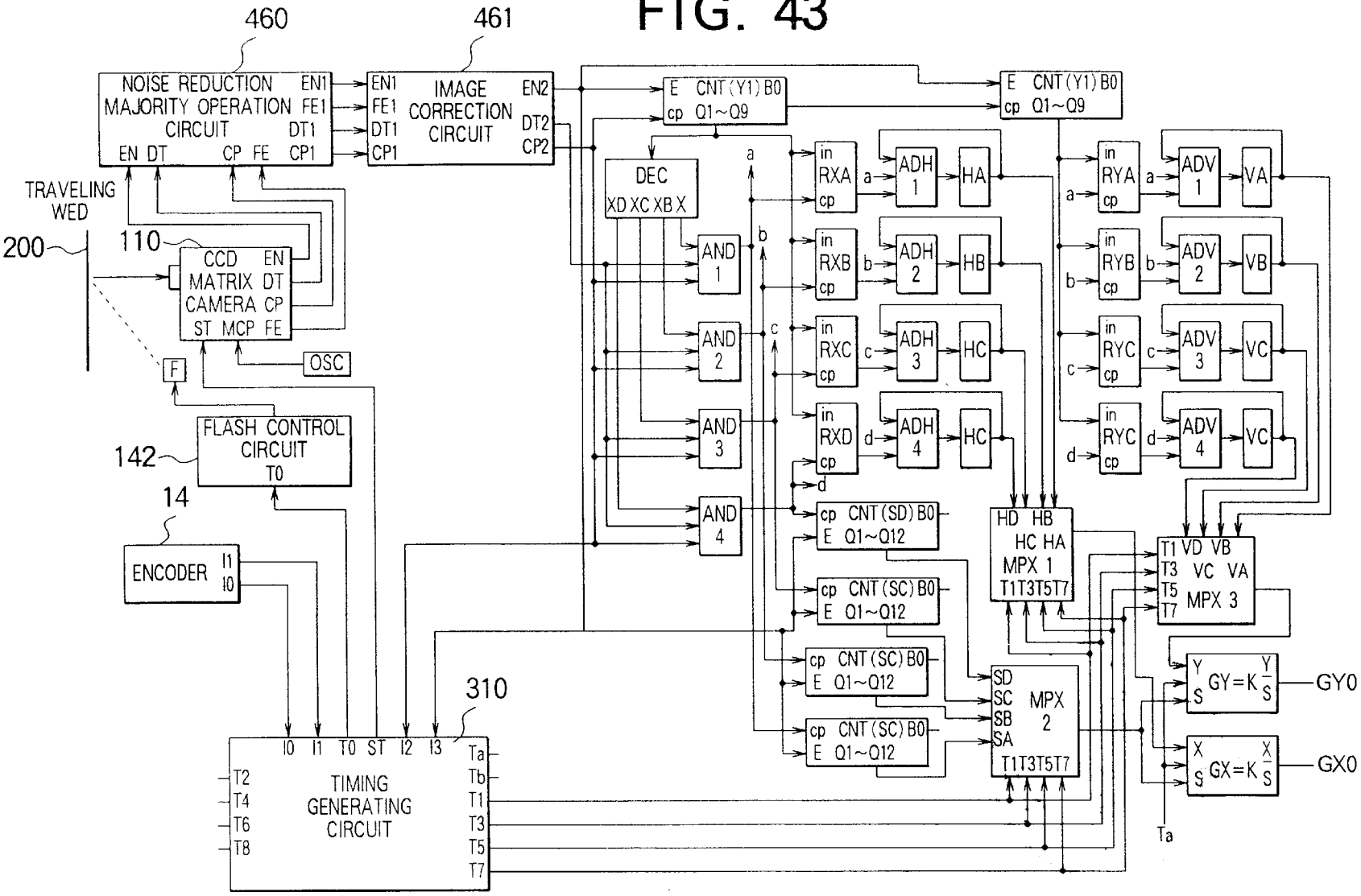
FIG. 43 is a diagram illustrating an example of the gravity coordinate calculating circuit.

FIG. 43 shows the configuration of a gravity coordinate calculating circuit embodying this invention. In the following, the method of calculating gravity coordinates will be described using the figure.

Pulses generated from an encoder 14 in synchronism with the plate cylinder of a rotary press comprise an indicating pulse signal indicating the standard rotating angular position of the plate cylinder generated at a rate of one pulse per revolution, and a synchronizing pulse signal generated in synchronism with the revolution of the plate cylinder. These pulses are inputted into I0 and I1 of a timing generating circuit 310. The timing generating circuit 310 that receives these signals generates an ST signal and a TO signal indicating the arrival of a printed register mark at the center of the reading area of a CCD matrix camera 110.

The signal inputted into I1 of the timing generating circuit 310 is inputted to cause the timing generating circuit 310 to produce a signal indicating that a register mark arrives at a position where the CCD matrix camera 110 reads a mark.

The ST signal is inputted into the CCD matrix camera 110 to issue a read-start signal. Upon receiving the signal the CCD matrix camera 110 performs a pixel reset, and starts exposure at the same time.

The TO signal is, on the other hand, inputted into a flash control circuit 142 to cause a flash lamp F to flash as soon as the CCD matrix camera 110 starts exposure.

The exposure time of the CCD matrix camera 110 is controlled by a shutter with a shutter speed of approx. 1 μs, while the flash lamp F gives a flash for less than 1 μs. This configuration is used to capture a still image. With the above-mentioned operations, the CCD matrix camera 110 reads a register mark, and sends sequentially 1-frame image signals in series.

A column line effective signal EN, a field effective signal FE, a binarized image signal DT, and an image reading clock signal CP are inputted from the CCD matrix camera 110 into a noise reduction majority operation circuit 460 as described in FIG. 29, for example. The noise reduction majority operation circuit 460 removes noise in the image data, and outputs a column line effective signal EN1, a field effective signal FE1, a binarized image signal DT1, and an image reading clock signal CP1. These signals are inputted into an image repair circuit 461 where the image data is repaired with the same processing as described in reference to the image repair circuit shown in FIG. 36. The repaired image data is transmitted to a gravity detection circuit.

That is, outputs Q1–Qp of a counter CNT(X1) indicate the X-coordinate address (row (horizontal line) address) of a register mark. The counter CNT(X1) counts clock signals outputted in synchronism with image effective signals EN2 and a picture elements. The counter CNT(X1) resets to zero upon receiving the 512nd BO signal.

An output of the counter CNT(X1) is inputted to a decoder DEC whose output decodes the X-coordinate four areas shown in FIG. 39 and outputs them. That is, a signal that divides the detecting area into four areas in terms of horizontal lines is outputted.

The output of the counter CNT(X1) for the X-coordinate reading area of B register mark is set to 0–127, the output of the counter CNT(X1) for the X-coordinate reading area of C register mark is set to 128–255, the output of the counter CNT(X1) for the X-coordinate reading area of M register mark is set to 256–383, and the output of the counter CNT(X1) for the X-coordinate reading area of Y register mark is set to 334–511, and these areas are decoded into XA, XB, XC and XD for outputting.

As for Y coordinates, 0–511 vertical lines in the XA area represent the area for B register mark, 0–511 vertical lines in the XB area represent the area for C register mark, 0–511 vertical lines in the XC area represent the area for M register mark, and 0–511 vertical lines in the XD area represent the area for Y register mark.

An accumulator comprising a register RXA, an adding controller ADH1 and a register HA constitutes a circuit for accumulating the X-coordinate addresses of picture elements corresponding to a register mark in the XA area. An accumulator comprising a register RXB, an adding controller ADH2 and a register HB constitutes a circuit for accumulating the X-coordinate addresses of picture elements corresponding to a register mark in the XB area. An accumulator comprising a register RXC, ad adding controller ADH3 and a register HC constitutes a circuit for accumulating the X-coordinate addresses of picture elements corresponding to a register mark in the XC area. An accumulator comprising a register RXD, an adding controller ADDH4 and a register HD constitutes a circuit for accumulating the X-coordinate addresses of picture elements corresponding to a register mark in the XD area.

An accumulator comprising a register RYA, an adding controller ADDV1 and a register VA constitutes a circuit for accumulating the Y-coordinate addresses of picture elements corresponding to a register mark in the XA area. An accumulator comprising a register RYB, an adding controller ADDV2 and a register VB constitutes a circuit for accumulating the Y-coordinate addresses of picture elements corresponding to a register mark in the XB area. An accumulator comprising a register RYC, an adding controller ADDV3 and a register VC constitutes a circuit for accumulating the Y-coordinate addresses of picture elements corresponding to a register mark in the XC area. An accumulator comprising a register RYD, an adding controller ADDV4 and a register VD constitutes a circuit for accumulating the Y-coordinate addresses of picture elements corresponding to a register mark in the XD area.

The X-coordinate addresses of a register mark in the XA area are accumulated in the following manner.

When the XA output of the decoder DEC is HIGH and the DT2 output (image) is HIGH, an AND circuit AND1 is actuated by a CP2 image reading clock pulse, a clock pulse a is inputted into the register RXA, and the register RXA latches the output (X-coordinate address) of the counter CNT(X1). Then, upon receiving an a' timing pulse, the data stored in the register HA and the X-address data latched by the register RXA are added by the adding controller ADH1 and stored again in the register HA.

X-coordinate addresses in the XB, XC and XD areas are accumulated through the circuit operation of AND circuits AND2, AND3 and AND4 in the same manner as in the case of the accumulation of X-coordinate addresses of the register mark in the XA area, as described above.

The Y-coordinate addresses of a register mark in the YA area are accumulated in the following manner.

When the XA output of the decoder DEC is HIGH and the DT2 output (image) is HIGH, an AND circuit AND1 is actuated by a CP2 image reading clock pulse, a clock pulse a is inputted into the register RYA, and the register RYA latches the output (Y-coordinate address) of the counter CNT(Y1). Then, upon receiving an a' timing pulse, the data stored in the register VA and the Y-address data latched by the register RYA are added by the adding controller ADV1 and stored again in the register VA.

Y-coordinate addresses in the YB, YC and YD areas are accumulated through the circuit operation of AND circuits AND2, AND3 and AND4 in the same manner as in the case of the accumulation of Y-coordinate addresses of the register mark in the YA area, as described above.

A counter CNT(SA) counts the number of all picture elements corresponding to a register mark in the XA area. A counter CNT(SB) counts the number of all picture elements corresponding to a register marks in the XB area. A counter CNT(SC) counts the number of all picture elements corresponding to a register mark in the XC area. A counter CNT(SD) counts the number of all picture elements corresponding to a register mark in the XD area.

The counter CNT(SA) counts the number of all picture elements corresponding to a register mark in the XA area by counting the number of operations of the AND circuit AND1. The counter CNT(SB) counts the number of all picture elements corresponding to a register mark in the XB area by counting the number of operations of the AND circuit AND2. The counter CNT(SC) counts the number of all picture elements corresponding to a register mark in the XC area by counting the number of operations of the AND circuit AND3. The counter CNT(SD) counts the number of all picture elements corresponding to a register mark in the XC area by counting the number of operations of the AND circuit AND4.

Next, the method of calculating gravity coordinates will be described in the following.

As an image signal for one screen is transmitted from the CCD matrix camera, data is stored in each register.

As described above, the accumulated value of the X-coordinate addresses of a register mark in the XA area is stored in the register HA, and the Y-coordinate addresses are stored in the register VA. The total number of picture elements corresponding to a register mark in the XA area is retained by the counter CNT(SA).

The accumulated value of the X-coordinate addresses of a register mark in the XB area is stored in the register HB, and the Y-coordinate addresses are stored in the register Vb. The total number of picture elements corresponding to a register mark in the XB area is retained by the counter CNT(SB).

The accumulated value of the X-coordinate addresses of a register mark in the XC area is stored in the register HC, and the Y-coordinate addresses are stored in the register VC. The total number of picture elements corresponding to a register mark in the XC area is retained by the counter CNT(SC).

The accumulated value of the X-coordinate addresses of a register mark in the XD area is stored in the register HD, and the Y-coordinate addresses are stored in the register VD. The total number of picture elements corresponding to a register mark in the XA area is retained by the counter CNT(SD).

EN2 and CP2 signals are inputted from the image repair circuit 461 to the I2and I3 of the timing generating circuit 310, which can recognize, based on these signals, the completion of transmission of a 1-screen image signal from the CCD matrix camera 110.

Upon recognizing the completion of image transmission, the timing generating circuit 310 generates T1 pulse. With the T1 pulse, multiplexers MPX1 and MPX2 operate, causing the contents of the register Ha nd the counter CNT(SA) to be inputted to a divider GX. Next, division is performed with Ta pulse to calculate X-gravity coordinates in the XA area. At the same time, a multiplexer MPX3 is actuated by T1 pulse, causing the contents of the register VA and the counter CNT(SA) to be inputted to a divider GY. Division is then performed with Ta pulse to calculate Y-gravity coordinates in the XA area.

Similarly, X-gravity coordinates and Y-gravity coordinates in the XB area are calculated by generating T3 and Ta pulses. X-gravity coordinates and Y-gravity coordinates in the XC area are calculated by generating T5 and Ta pulses. X-gravity coordinates and Y-gravity coordinates in the XD area are calculated by generating T7 and Ta pulses.

T2, T4, T6 and T8 pulses are used as timing pulses to transmit deviations to a registering-error correcting device, which will be described later.

Figure 44:
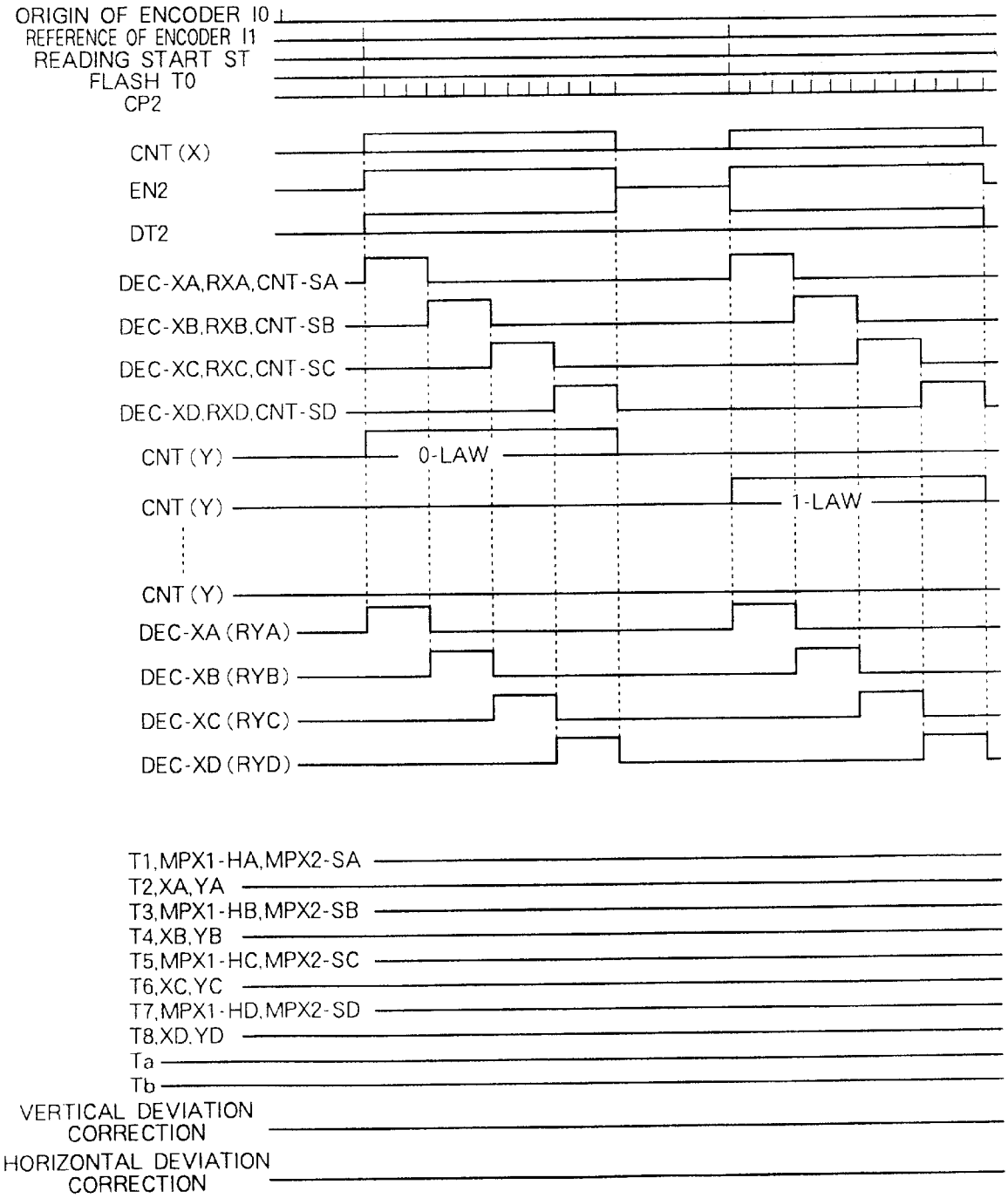
FIG. 44 is a timing chart of the circuit shown in FIG. 43.

A timing chart for a series of these operations is shown in FIG. 44 as a timing chart for the gravity-coordinates calculating circuit.

K in the following equations for the divider, $$GX=K\cdot X/S, \tag{1}$$

and $$GY=K\cdot Y/S \tag{2}$$

is a constant representing pitches between picture elements in the vertical and horizontal directions. If pitches between picture elements in horizontal lines do not equal to those between picture lines in vertical lines, K assumes different values for Equations (1) and (2).

Next, the method of correcting registering errors will be described.

Figure 45:
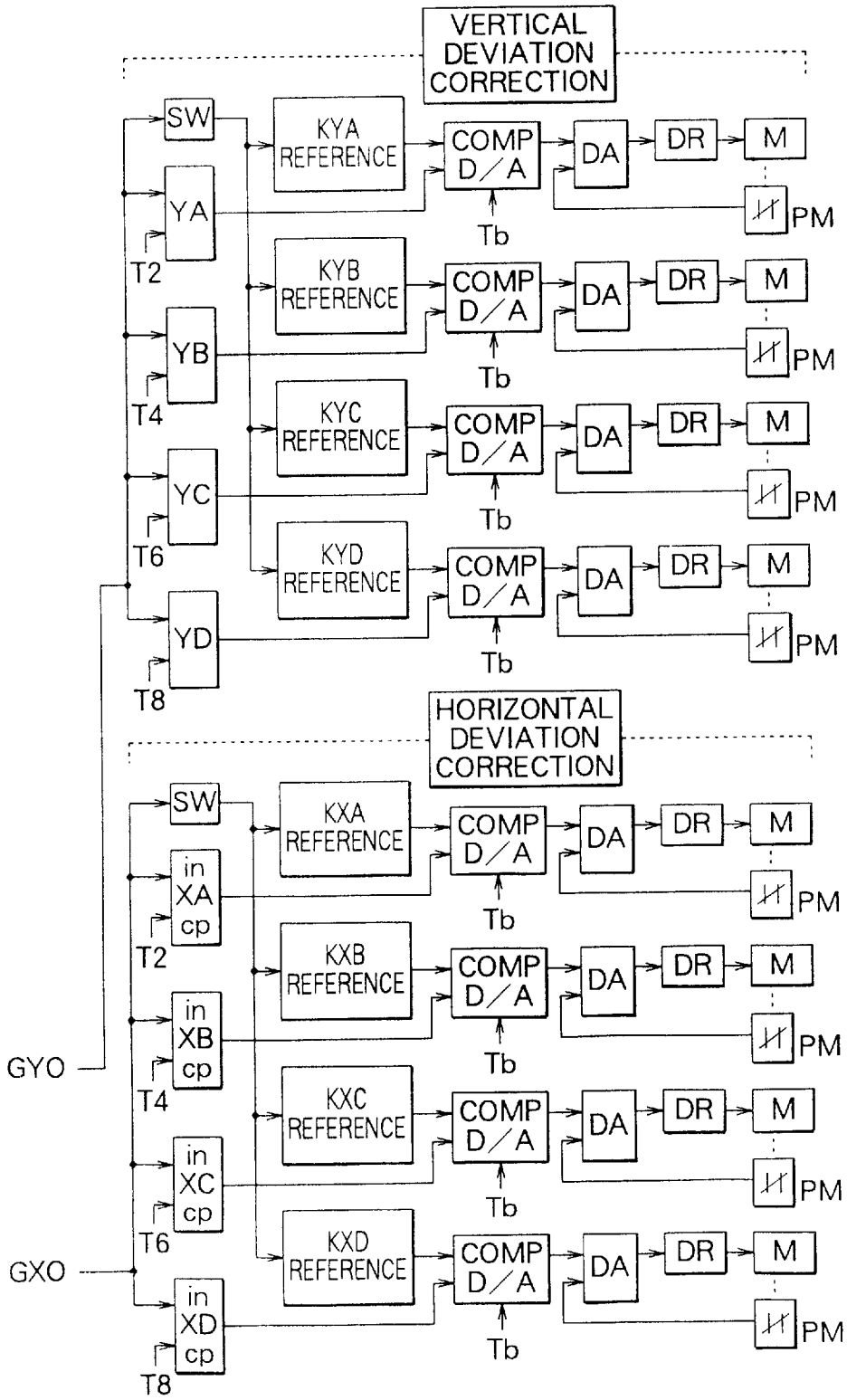
FIG. 45 is a diagram illustrating an example of the register control circuit.

FIG. 45 shows the construction of a registering-error correcting circuit embodying this invention.

To adjust registering errors in the horizontal direction, the register XA latches the X-gravity coordinates of a register mark in the XA area from the output GXO of the divider GX shown in FIG. 43, upon receiving T2 timing pulse. At the same time, the register YA latches the Y-gravity coordinates of a register mark in the YA area from the output GYO of the divider GY shown in FIG. 43, upon receiving T2 timing pulse, to adjust registering errors in the vertical direction.

Similarly, upon receiving T4 timing pulse, the registers XB and YB latch the X-gravity and Y-gravity coordinates of a register mark in the XB area.

Similarly, upon receiving T6 timing pulse, the registers XC and YC latch the X-gravity and Y-gravity coordinates of a register mark in the XC area.

Similarly, upon receiving T8 timing pulse, the registers XD and YD latch the X-gravity and Y-gravity coordinates of a register mark in the XD area.

Next, upon receiving Tb pulse, comparators COMP calculate deviations between the X-gravity coordinates stored in the registers XA, XB, XC and XD, and the reference coordinate data KXA, KXB, KXC and KXD, and the deviations are outputted as analog voltages by the D/A converter. At the same time, upon receiving Tb pulse, the comparators COMP also calculate deviations between the X-gravity coordinates stored in the registers YA, YB, YC and YD, and the reference coordinate data KYA, KYB, KYC and KYD, and the deviations are outputted as analog voltages by the D/A converter.

These analog voltages are compared with the voltage of the potentiometer PM by a differential amplifier DA so that the driver circuit DR causes the motor M to rotate to effect control to make the deviation zero. In this way, registering errors in the vertical and horizontal directions are corrected. When the deviation is zero, the motor M is not caused to rotate, and no control is effected.

Aside from the method of effecting control based on deviations from each reference coordinate data as described above, there can be another method where the vertical and horizontal distances between the gravity coordinates of B register mark as the reference, and the gravity coordinates of other register marks are preset, and deviations between measured distances and the preset distances are corrected. The reference mark in this method may not be limited to B register mark, but may be either of C mark, M mark and Y mark.

In the figure, symbol PM denotes a multi-rotational potentiometer to which a predetermined voltage is applied.

The adjusting motor M is a motor with reduction gear, whose output shaft is interlocked with the potentiometer PM, as described in reference to FIG. 27.

In the foregoing, description has been made about an embodiment where the register control circuit comprises hard logic. The hard logic, however, may be replaced with microprocessors.

The CCD matrix camera 110 also may not be limited to that of the aforementioned transmission timing, but may be of a type having a different output system. A color CCD matrix camera may also be used.

The automatic register control system, and apparatus and method for detecting registering errors embodying this invention using the first registering error detecting method as described above have the following effects.

(1) The still image of a register mark can be read because the system incorporates shutter control where a read start signal is given to the CCD matrix sensor by an external trigger when a register mark arrives at a reading position to make exposure time constant, and a flash light source that flashes in synchronism with exposure. Consequently, register marks can be read accurately, unaffected by printing speed. This leads to improved registering error detection accuracy.

(2) Since a noise reduction circuit is provided, registering errors can be adjusted without any adverse effects of tinting or smear. This results in reduced paper spoilage, bringing about a remarkable effect on resources conservation.

(3) By adopting a rectangle or square as the shape of a register mark, images of the partial printing skips of the mark printed on a fibrous newsprint can be easily repaired. This allows the system to read register marks more accurately, leading to improved registering error detection accuracy.

(4) Since noise reduction and image repair can be carried out in real time at the time of image data transmission from the CCD matrix camera, it is made possible to detect registering errors on the paper being printed at high speed. This leads to reduced paper spoilage.

(5) By adopting a telecentric lens in the optical system of the CCD matrix camera, the effects of mismatching in the position of printed material on both pages, and changes in the magnification factor of register marks due to deformed guide roller can be disregarded. This eliminates the need for correcting register marks after reading. This allows the logic construction to be simplified, leading to an inexpensive and easy-to-adjust system.

(6) By adopting register marks of a rectangular or square shape and the method of detecting gravity coordinates, fluctuations in image line thickness hardly affect detection accuracy.

Next, a third detecting method will be described, in which registering errors in a multi-color rotary press are detected by printing at least one cross-shaped register mark having a reference point on a traveling paper web for each printing section, causing a CCD camera to scan a CCD matrix sensor having a plurality of detecting elements arranged in a quadrilateral shape at a timing correlated with the above-mentioned printing sections to acquire picture-element data for each register mark, calculating the coordinate position of the abovementioned reference point for each register mark from the acquired picture-element data to obtain a deviation between the calculated coordinate position and the original coordinate position of the reference point of the register mark.

This type of registering error detection obtains picture-element data on each register mark of a cross shape having a reference point by scanning the CCD matrix sensor arranged in a quadrilateral shape. Based on the picture-element data, the coordinate position of the reference point of the register mark is calculated to compare the calculated coordinate position of the reference point with the original coordinate position to obtain the deviation as a registering error. In the following, the third registering error detecting method will be described.

Figure 46:
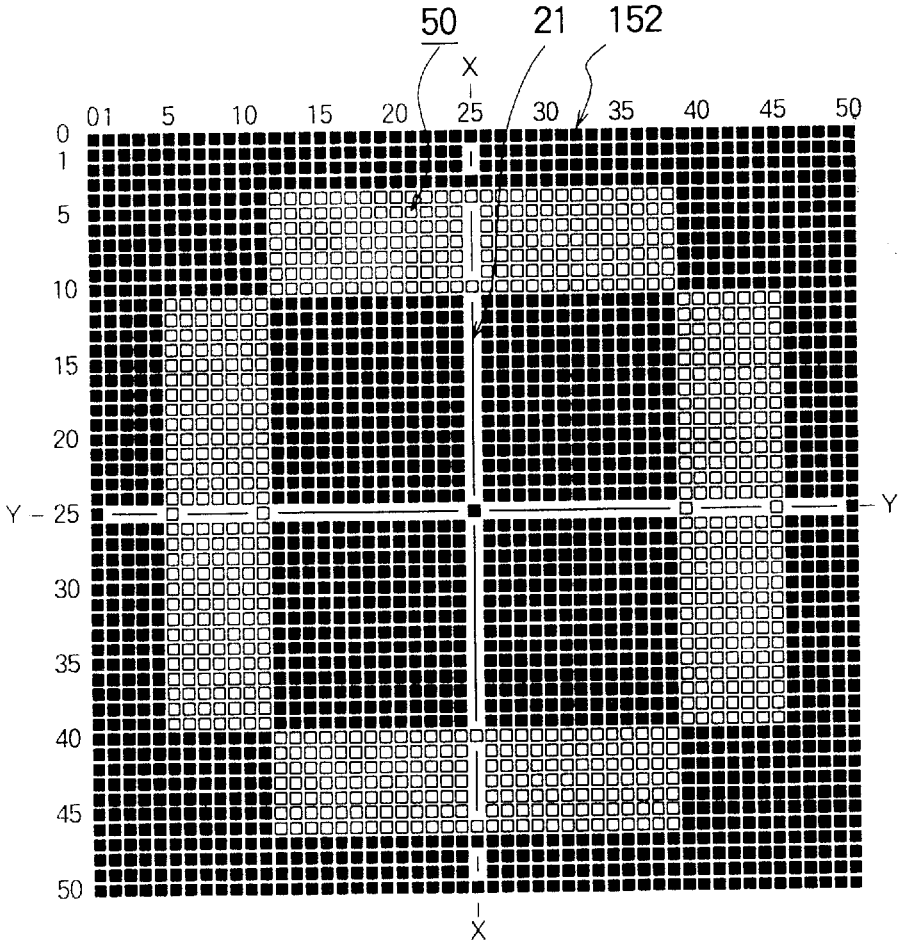
FIG. 46 is a diagram of assistance in explaining the CCD matrix sensor when the reference point of a register mark agrees with the center of the CCD matrix sensor.

FIG. 46 is a diagram of assistance in explaining a CCD matrix sensor in the state where the reference point of a register mark coincides with the center of the CCD matrix sensor.

The CCD matrix sensor 152 mounted on the CCD camera 100 has such a construction as to detect one register mark 21 of a cross shape having an intersecting point with vertical and horizontal bars crisscrossed as shown in FIG. 6 (A). The construction of the CCD matrix sensor 152 for simultaneously detecting a plurality of register marks 21 will be described in reference to FIG. 47.

In FIG. 46, the CCD matrix sensor 152 comprises picture elements of 51 columns in the horizontal direction and 49 rows in the vertical direction. □ and ■ shown in the figure denotes component picture elements. Picture elements in a window frame 50, represented by □ are called special picture elements. In the figure, the CCD matrix sensor 152 consisting of picture elements of 51 columns in the horizontal direction and 49 rows in the vertical direction is shown due to the limit of space. When picture elements are arranged in a square shape with equal picture-element pitches in the horizontal and vertical directions, a CCD matrix sensor 152 consisting of picture elements of 150 columns in the horizontal direction with special picture elements of 27 columns by 10 rows in the window frame 50, and 150 rows in the vertical direction with special picture elements of 27 columns 10 rows in the window frame 50 is used.

The reference point of the CCD matrix sensor 152 lies in the center of the CCD matrix sensor 152, that is, the origin of a coordinate system of 25 columns as the X axis and 24 rows as the Y axis. It also coincides with the center of the quadrilateral window frame 50, represented by □. In other words, the figure shows the state where the center of the quadrilateral window frame 50 represented by □. The register mark 21 in this case is represented by a cross consisting of one line and one row. In addition, □ and ■ are placed at key positions to clearly indicate the position of picture elements of the CCD matrix sensor 152.

The width of the bar of the cross of the register mark 21 is actually composed of about 9 picture elements. When calculating the center position of the register mark 21, therefore, the coordinate positions X and Y obtained by adding the first picture number to the last picture element number detected by traversing the bars of the cross of the register mark 21 and dividing the sum by 2 are used as the positions of the centerlines of the vertical and horizontal bars, that is, the center position of the register mark 21. This state applies to the following description.

When picture elements are arranged in a rectangular shape, rather than a square shape, with unequal horizontal and vertical picture-element pitches, the rows of special picture elements in the window frame 50 are arranged in such a manner that the area of picture elements becomes equal in the direction to add the gradation data, which will be described later, because the number of the rows of special picture elements in the window frame 50 is different in the vertical and horizontal directions.

Figure 47:
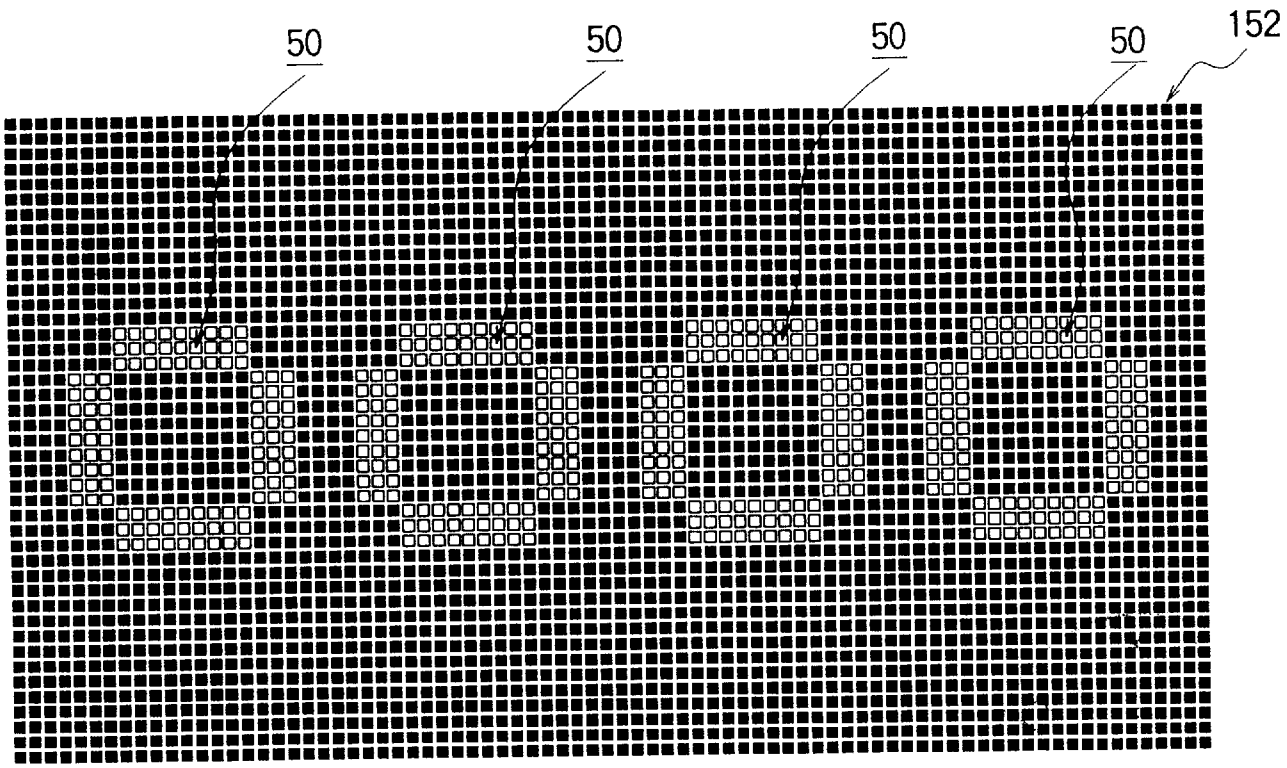
FIG. 47 is a diagram of assistance in explaining an arrangement of special picture elements captured by a CCD matrix sensor that detects a plurality of register marks.

FIG. 47 is a diagram illustrating the arrangement of special picture elements of the CCD matrix sensor when detecting a plurality of register marks simultaneously.

As described in reference to FIGS. 3 and 4, four register marks 21 are printed on the traveling paper web 200 in the order of black, cyan, magenta and yellow. Therefore, a CCD matrix sensor 152 of a type that can detect these four register marks 21 simultaneously is used.

The quadrilateral window frames 50 consisting of special picture elements (□) are areas for detecting black, cyan, magenta and yellow register marks 21 from the left to the right in the figure. The area of the window frame 50 consisting of these special picture elements has such a picture-element construction as described in FIG. 46. The coordinate position of the center of each register mark 21 in the CCD matrix sensor 152 can be obtained in such a manner as described in FIG. 46.

Figure 48:
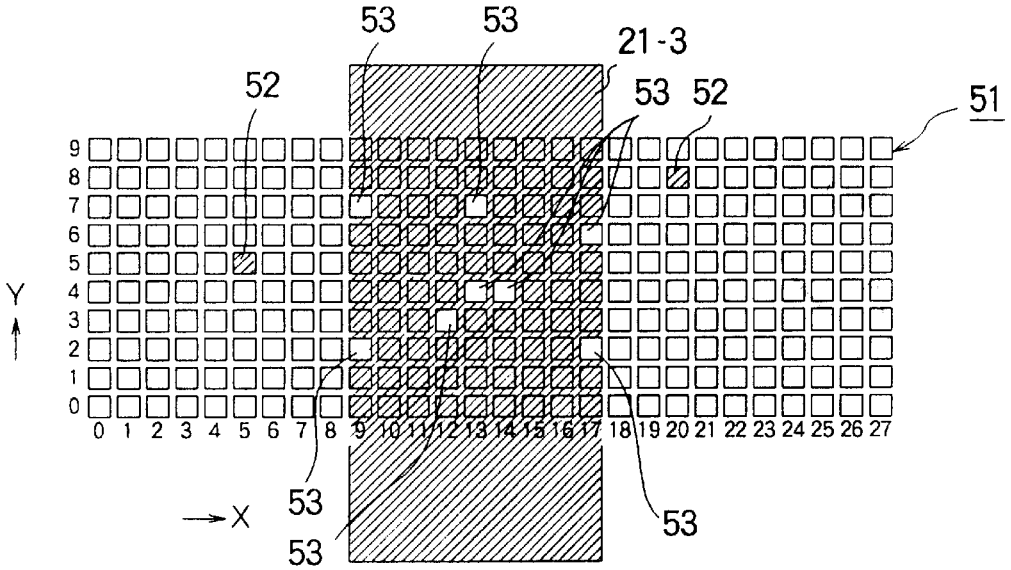
FIG. 48 is a diagram of assistance in explaining the state where part of a register mark has been printed.

FIG. 48 is a diagram illustrating part of a register mark being detected by the CCD matrix sensor 152.

In the figure, numeral 51 denotes one side of the quadrilateral window frame 50 consisting of special picture elements as described in FIG. 46; 21-3 denotes a vertical bar of the register mark 21; 52 denotes picture elements colored on the paper surface produced by ink splashes; and 53 denotes picture elements representing printing skips on the vertical bar 21-3.

The mark detecting sensitivity for each special picture element is set to 4:1, for example, in terms of SN ratio. Assuming that the gray-scale value per picture element for detecting the background color of the non-printed area is 20, introducing an XY coordinates having an origin at the left bottom, as shown in FIG. 48, will yield a gray-scale value of 20×10=200 for 10 vertical picture elements which are parallel with the Y axis. Since the gray-scale value per picture element for detecting the bar 21-3 of the printed register mark 21 is 20×1/(1+4)=4, the gray-scale value for 10 vertical picture elements that detect the bar 21-3 is 4×10=40.

Figure 49:
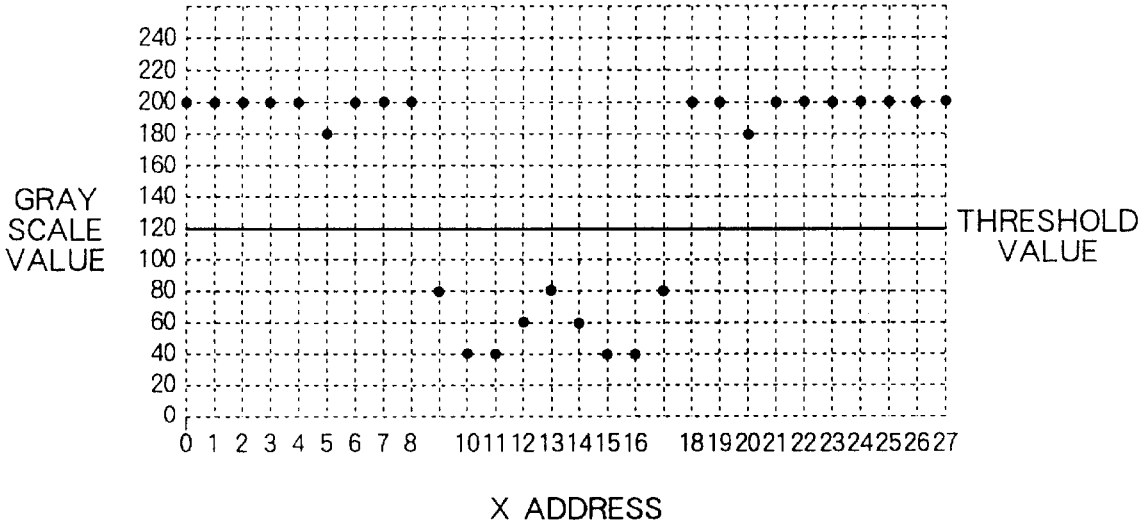
FIG. 49 is a diagram of assistance in explaining the correction of an image data.

The sum of gray-scale values of vertical picture elements over one side 51 of the quadrilateral window frame 50 under the aforementioned condition for gray-scale value per picture element is plotted in FIG. 49.

In FIG. 49, the gray-scale values of the picture elements 52 represented by the coordinates (5,5) and (20,8) are 4 each. Consequently, the gray-scale value obtained by adding in the vertical direction the gradation data on these picture elements is 20×9+4×1=184.

When the gray-scale value of 120 is selected as a threshold value for discriminating the bar 21-3 of the register mark 21 from the background color, the picture elements 52 represented by the coordinates (5,5) and (20,3) are judged as noise, or the background color, since the gray-scale value of 184 is larger than the threshold value of 120.

The gray-scale value obtained by vertically adding the gradation data of the row having picture elements 53 corresponding to printing skips, represented by the coordinates (9,2) and (9,7), becomes 20×2+4×8=72. Since the gray-scale value of 72 is smaller than the threshold gray-scale value of 120, the picture elements 53 represented by the coordinates (9,2) and (9,7) are printing skips on the bar 21-3 of the register mark 21.

Similarly, picture elements 52 in the row having picture element 53 represented by the coordinates (12,3), the row having picture elements 53 represented by the coordinates (13,4) and (13,7), the row having picture element 53 represented by the coordinates (14,4), and the row having picture elements 53 represented by the coordinates (17,2) and (17,6) can be judged as printing skips on the bar 21-3 of the register mark 21.

In this way, the noise caused by ink splashes can be eliminated and printing skips can be repaired using the image data repair method based on the majority principle, and the width of the bar 213 can be detected successfully without affecting the reading of register marks 21. The center position X of the bar 21-3 can be found by X=(9+17)/2=13. As described in FIG. 46, the center position X is given as the X coordinate of the reference point of the register mark 21.

In general, when the picture-element number of the first image data of the bar 21-3 is Xn1, and the picture-element number of the last image data is Xn2, the center position of the detected bar 213, that is the X coordinate of the reference point of the register mark 16, can be found by X=(Xn1+Xn2)/2.

Next, the method of detecting registering errors will be described in the following.

Figure 50:
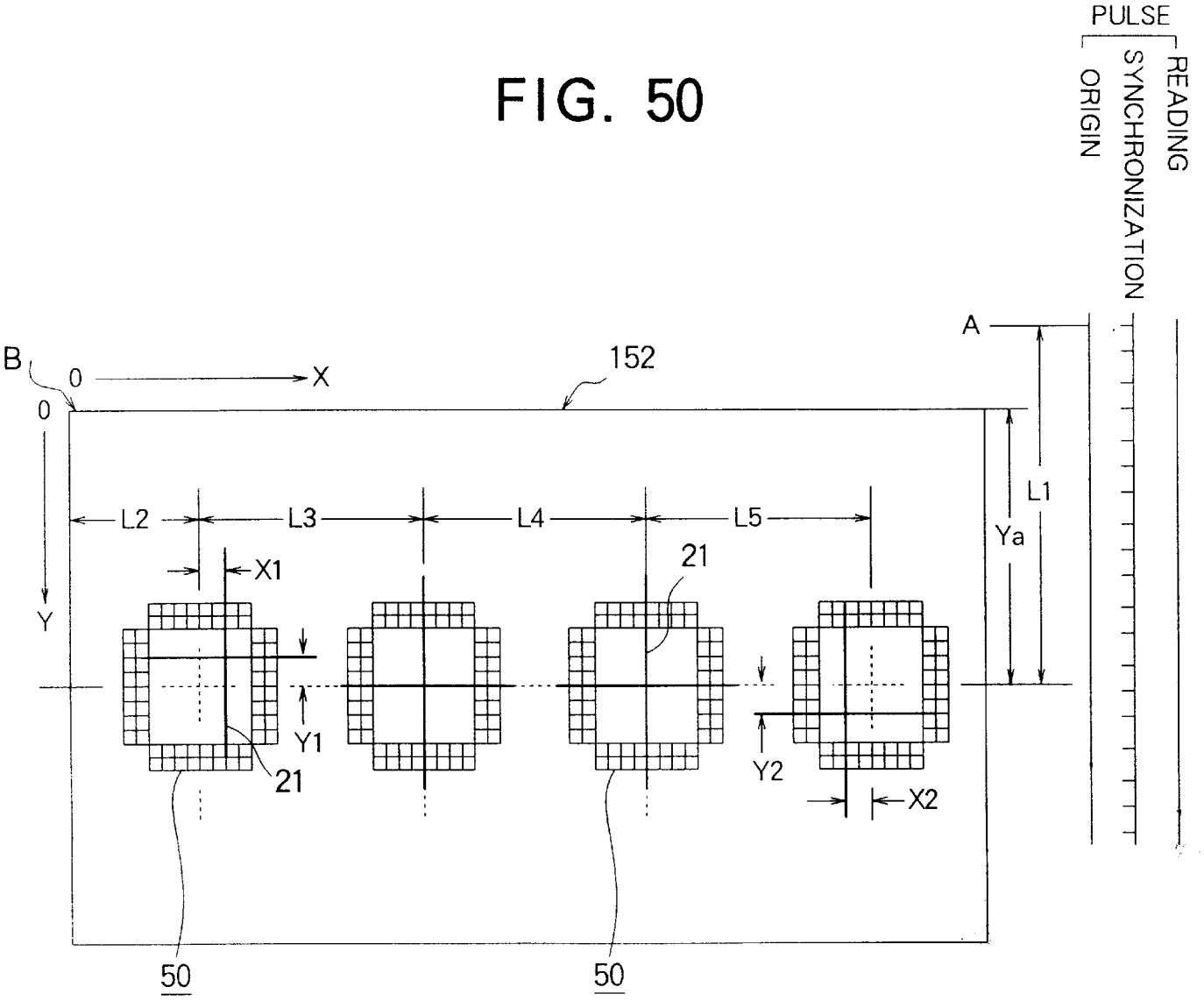
FIG. 50 is a diagram of assistance in explaining a CCD matrix sensor used in this invention and its reading timing.

FIG. 50 is a diagram of assistance in explaining the CCD matrix sensor used in this invention and the timing of reading.

In the figure, a CCD matrix sensor 152 is of the construction described in FIG. 47, in which the XY coordinates shown in the figure having an origin at the left top corner B of the CCD matrix sensor 152 is introduced. Assume that the picture-element address corresponding to a distance Ya from B in the Y-axis direction is the Y coordinate of the reference of the window frame 50 consisting of special picture elements, and the picture-element address corresponding to a distance L2 from B in the X-axis direction is the X coordinate of the reference of the window frame 50 for black. That is, the reference coordinates of the window frame 50 for black are (L2,Ya). Similarly, the reference coordinates of the window frame 50 for cyan are (L2+L3+L4,Ya), and the reference coordinates of the window frame 50 for yellow are (L2+L3+L4+L5,Ya).

In the CCD matrix sensor 152 shown in FIG. 50, the reference coordinates of the window frames 50 for cyan and magenta and the reference points of the register marks 21 for cyan and magenta completely coincide with each other, while the reference coordinates of the window frame 5- for black do not coincide with the reference point of the register mark for black, which is shifted by the number of picture elements corresponding to distances X1 and Y1, as shown in the figure, and the reference coordinates of the window frame 50 for yellow do not coincide with the reference point of the register mark for yellow, which is shifted by the number of picture elements corresponding to distances X2 and Y2, as shown in the figure.

The coordinate positions of the reference points of these register marks 21 are calculated by the method described in reference to FIGS. 48 and 49, with origins set to the reference coordinates of the window frames 50 for the above colors. Consequently, the registering errors of the register marks 21 can be easily detected by detecting the amount of shifts, as described above, and comparing them with the reference coordinates of the window frames 50 to obtain deviations.

On the right side of FIG. 50 shown are timing pulses for the CCD matrix sensor 152 to read the register marks 21 printed on the traveling paper web 200. Synchronizing and reading pulses are generated on the basis of the origin pulse A of the encoder 14 that detects the rotating angular position of the plate cylinder. That is, as the number of pulses corresponding to L1 in the figure is counted upon receiving the synchronizing pulse that synchronizes with the rotation of the plate cylinder, the xenon flash lamp of the light emitting device 140 shown in FIG. 1 is caused to flash, and a reading pulse is generated to actuate the shutter operation of the CCD matrix sensor 152, exposing the CCD matrix sensor 152 during the xenon flash lamp flashes. Thus, the register marks 21 are read simultaneously by the CCD matrix sensor 152 at the reference coordinate positions of the window frames 50 of the CCD matrix sensor 152.

Figure 51:
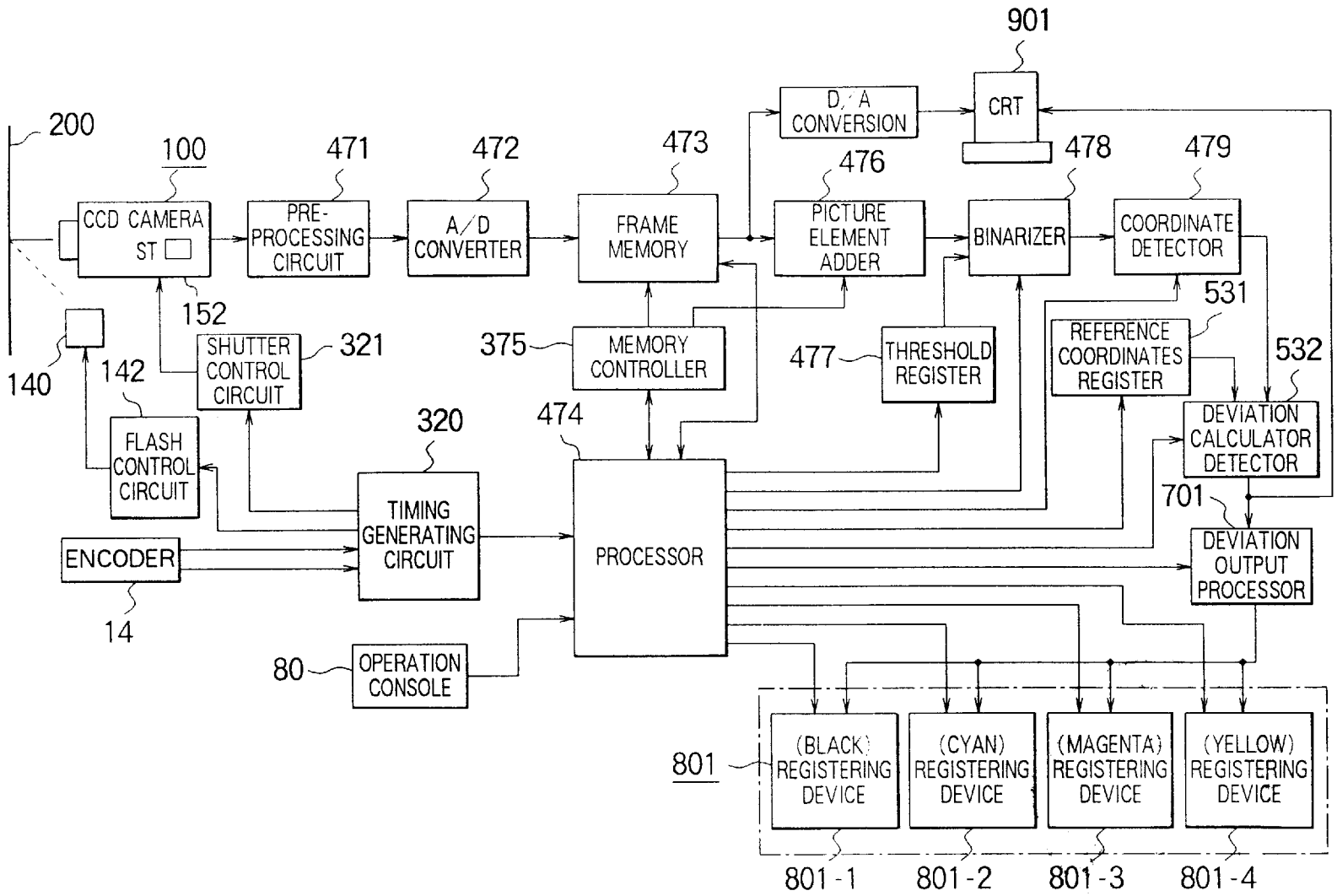
FIG. 51 is a circuit diagram illustrating the construction of a calculating and control circuit embodying this invention.

FIG. 51 is a diagram illustrating the circuit configuration of an arithmetic and control circuit embodying this invention.

In the figure, an origin pulse for instructing the rotational angular position of the plate cylinder described in FIG. 50 and a synchronizing pulse generated in synchronism with the rotation of the plate cylinder are inputted from the encoder 14 to the timing generating circuit 320, which in turn outputs an operation command signal to the flash control circuit 142 and the shutter control circuit 321. The flash control circuit 142 causes the xenon flash lamp of the light emitting device 140 to flash, and the shutter control circuit 321 causes the CCD camera 100 to start reading black, cyan, magenta and yellow register marks 21 printed on the traveling paper web 200. The timing of reading is as described in FIG. 50.

The video signal (picture-element signal) read by the CCD camera 100 is inputted into the preprocessing circuit 471 where shading processing for correcting the picture elements of the CCD matrix sensor 152 built in the CCD camera 100 to ensure uniform sensitivity, and optimization processing for processing input picture-element signal referring to the look-up table are carried out.

The picture-element signal which undergo preprocessing in the preprocessing circuit 471 is inputted to the A/D converter section 472 where the picture-element signal is converted into 256-level gradation data, for example. This gradation data is stored in the frame memory 473.

The processor 474 gives the memory controller 475 the memory addresses of the frame memory 473 corresponding to the special picture elements of the window frame 50 consisting of special picture elements as described in FIGS. 46 and 47 of the CCD matrix sensor 152 to extract the gradation data corresponding to the special picture elements of the window frame 50 from the frame memory 473 via the memory controller 475 to carry out picture-element addition processing in the picture-element addition processing section 476, as described in FIG. 49.

That is, the picture-element addition processing section 476 performs picture-element addition processing using predetermined gray-scale values to eliminate the noise caused by ink splashes and repair printing skips based on the gradation data obtained from the picture-element addition and the threshold value latched in the threshold value register 477, calculates the coordinates of the center positions X and Y of the vertical and horizontal bars 21-3 of the register mark 21 in the binarizing processing section 478, and discriminates the register mark 21 from the background color on the traveling paper web 200.

The coordinate detection processing section 479 calculates the coordinate positions of the reference points of register marks 21 from the coordinates of the center positions X and Y of the vertical and horizontal bars of the register marks, and then deviations of the reference points of the register marks 21 is calculated in the deviation calculator/detector 532 from the coordinate positions of the reference points of register marks 21 and the coordinates of the center positions of the corresponding window frames 50 consisting of the aforementioned special picture elements that are latched in advance by reference coordinates register 531. In other words, registering errors between the coordinate positions of the reference points of the register marks 21 and the target coordinate positions of the register marks 21.

The deviations of the reference points of the register marks 21 calculated in the deviation calculator/detector 532 are inputted into the deviation output processor 701 where adjusting signals for eliminating the deviations are generated. The adjusting signals are inputted into the registering devices 801 where registering is carried out in registering devices 801-1 through 801-4 for black, cyan, magenta so that deviations for each color become zero.

The deviations of the reference points of the register marks 21 calculated by the deviation calculator/detector 532 are displayed on the CRT 901.

In the operation console 80, alteration of the special picture elements of the window frame 50 consisting of the special picture elements to be provided in the CCD matrix sensor 152, alteration of coordinate values to be latched in advance to the reference coordinates register 531, or alteration of threshold values to be latched to the threshold register 477 are carried out arbitrarily via the processor 474.

A series of these processings are carried out on the basis of the program of the processor 474. By providing window frames 50 consisting of special picture elements in the CCD matrix sensor 152 and causing the processor 474 to execute the aforementioned processing, the speed of the processing can be remarkably improved. Although the register mark 21 for yellow in particular requires a special optical filter in a monochrome CCD matrix sensor 152, the aforementioned processing is made possible even when a color CCD matrix sensor is used for the CCD matrix sensor.

Figure 52:
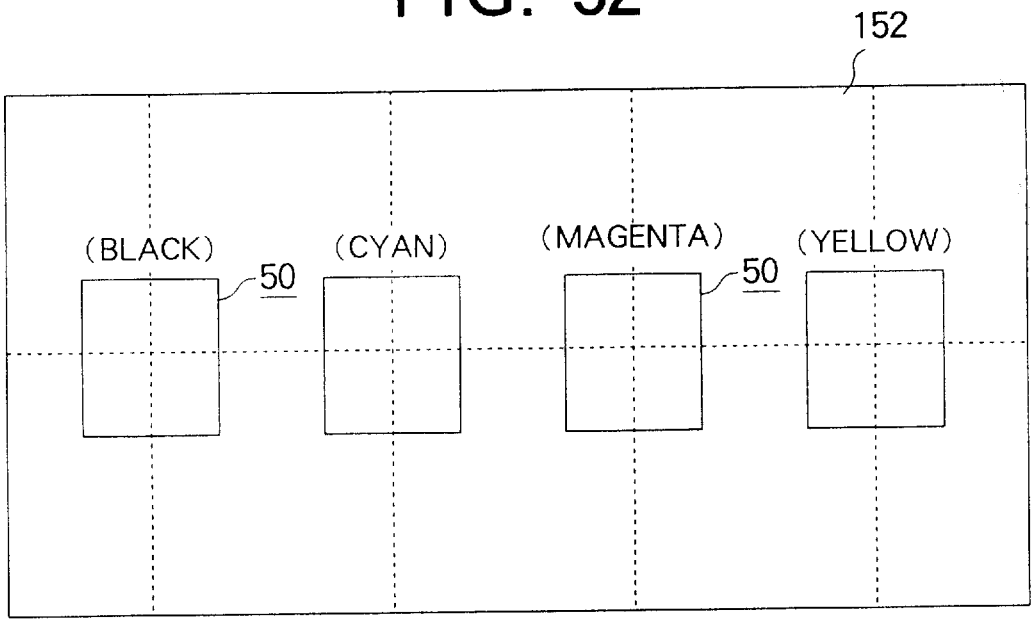
FIG. 52 is a diagram of assistance in explaining the layout of another example of a window frame comprising special picture elements.
Figure 54:
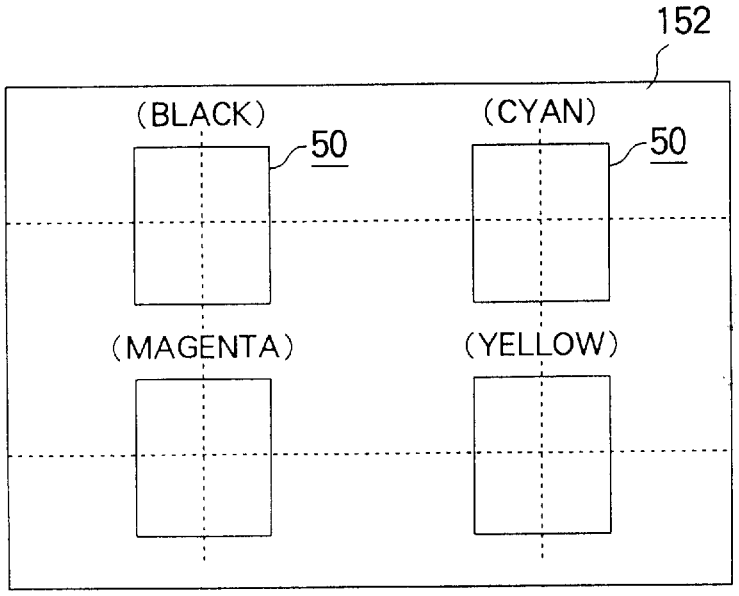
FIG. 54 is a diagram of assistance in explaining the layout of still another example of a window frame comprising special picture elements.

FIG. 52 is a diagram illustrating an embodiment of the layout of window frames consisting of special picture elements, and FIG. 54 is another embodiment of the layout of the window frames consisting of special picture elements.

Description of the embodiment shown in FIG. 52 is omitted because it is essentially the same as the embodiment described in reference to FIG. 47. The embodiment shown in FIG. 54 comprises two rows of two window frames 50 consisting of special picture elements in the horizontal direction. In this embodiment, the window frame on the upper left is the area for black, the window frame on the upper right is that for cyan, the window frame on the lower left is that for magenta, and the window frame on the lower right is that for yellow. At this time, register marks 21 for these colors are printed on the traveling paper web 200 corresponding to these areas.

Figure 53:
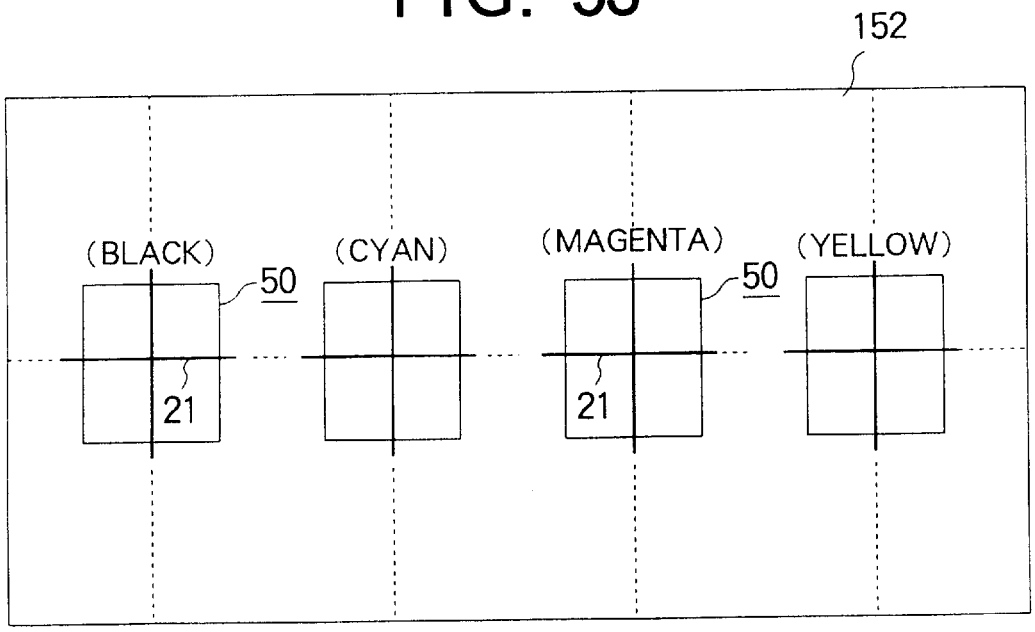
FIG. 53 is a diagram of assistance in explaining an example where register marks are read in a CCD matrix sensor.
Figure 55:
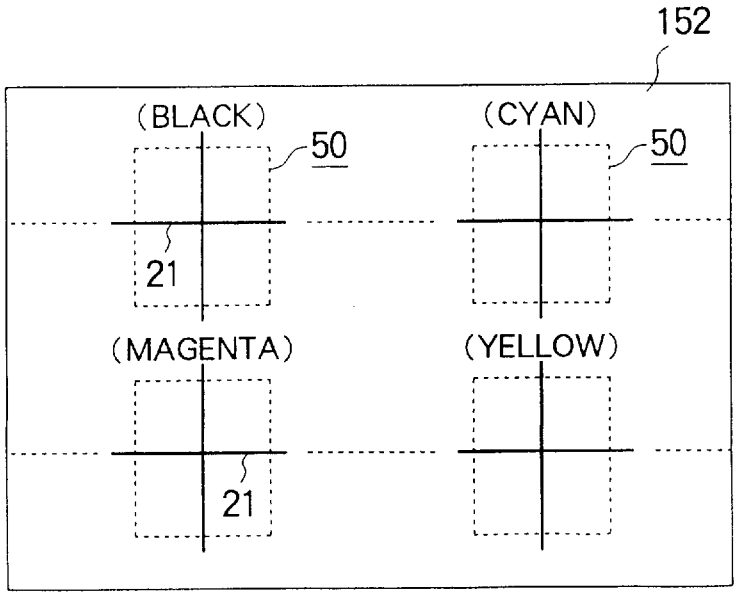
FIG. 55 is a diagram of assistance in explaining another example where register marks are read in a CCD matrix sensor.

FIG. 53 is a diagram of assistance in explaining an example register marks are read in the CCD matrix sensor, and FIG. 55 is a diagram of assistance in explaining another example where register marks are read in the CCD matrix sensor.

FIGS. 53 and 55 show the state where registering has been completed as the center coordinate positions of the four window frames 50 consisting of special picture elements completely agree with the coordinate positions of the reference points of the register marks 21. In this state, perfect color printing is accomplished without any shifts in printing elements.

Since these four window frames 50 consisting of special picture elements can be prepared in any layouts based on the program of the processor 474, the layout of the window frames 50 is not limited to those shown in FIGS. 52 and 54.

In FIG. 53, four register marks 21 printed in the horizontal direction are each read with a separate CCD camera 100 to detect registering errors for separate register control.

This embodiment has such a construction that one frame of the picture-element data of the CCD matrix sensor 152 is read in the frame memory 473. There can be another construction in which gradation data for only the special picture elements of the window frame 50 can be stored in a memory corresponding to the addresses of lines and rows of the picture-element data of the CCD matrix sensor 152. In this case, the capacity of memory can be reduced to approx 1/20, contributing to higher processing speed.

By employing a CID (charge injection device) camera, picture-element data can be retrieved from the leading address in a given column line to any row. This could reduce the time for storing the picture-element data in the memory, making fast processing possible. This would facilitate register control, contributing to reduced paper spoilage. This embodiment, which is of a type in which register marks 21 are read in both the horizontal and vertical directions with the special picture elements of the window frame 50, has an advantage in that vertical displacement of the traveling paper web 200 never affects reading accuracy.

By forming the window frame 50 consisting of the special picture elements into an L-shaped or inverted L-shaped frame having 2 side forming 90 degrees, registering errors may be detected as in the case of the quadrilateral window frame 50.

The method and apparatus for detecting registering errors, and the automatic register control system embodying this invention using the first registering error detecting method have the following effects.

(1) Relatively small register marks can be used to detect registering errors. High detection accuracy can be ensured, and register control accuracy can also be improved when detecting registering errors on printed matter printed on high quality paper, such as coated paper, or ground woody paper, such as newsprint, despite short detection time. This makes it possible to provide a registering error detecting method and apparatus for multi-color rotary press which can reduce paper spoilage, and an automatic register control system which is relatively inexpensive and easy to handle.

(2) By matching the frame memory with the picture elements of the CCD matrix sensor, and providing window frames consisting of special picture elements in the CCD matrix sensor to detect the intersecting point of the bars of the register marks, that is, the coordinate positions of the reference points of register marks in special picture element area of the window frame, the time for detecting and processing coordinate positions can be reduced, and register control can be effected quickly.

(3) When only special picture elements constituting window frames, that is, multiple rows of vertical special picture elements and multiple rows of horizontal special picture elements are stored in the frame memory, and the X coordinates of the coordinate positions of the reference points of the register marks are obtained by adding the gradation data of multiple rows of picture elements in the vertical direction, and the Y coordinates are obtained by adding the gradation data of multiple rows of picture elements in the horizontal direction, the area of the detected picture elements is apparently increased, improving light receiving sensitivity. As a result, the shutter speed (exposure time) of the CCD matrix sensor and the flashing time of the flash lamp can be reduced. This results in still images of higher accuracy. When an image repair method based on the majority principle is used, the coordinate positions of the reference points of register marks can be detected more positively, improving the registering error detecting accuracy.

(4) Since this invention detects the coordinate positions of the reference points of register marks, this invention can flexibly cope with changes in the layout of register marks by changing the layout of special picture elements constituting window frames and the size of the area of the window frames. Thus, not only register marks arranged in a direction vertical to the traveling direction of the traveling paper web but also various types of register marks can be detected. This gives the printing surface larger latitude.

As described above, this invention makes it possible to easily obtain registering errors with high accuracy by using relatively small, common types of register marks. Since registering errors can be detected easily, an inexpensive and high-accuracy registering error detecting apparatus and automatic register control system can be realized.

As this invention makes corrections of the image data of register marks and calculates the reference points of the register marks, this invention makes it possible to obtain higher-accuracy reference positions, improve the accuracy of registering error detection, achieve accurate color matching of each printing section and clear color printing.

In a failure of detection of register marks in a predetermined state, or failure of automatic register control due to large registering errors detected, the failure is displayed and an alarm is issued for immediate corrective action.

What is claimed is:

1. A registering error detecting method comprising the steps of:

providing a web:

providing a plurality of printing sections printing on said web as said web travels through said plurality of printing sections, each of said plurality of printing sections having a plate cylinder printing a predetermined color and corresponding register mark on said web, each said register mark having a reference point;

reading said register marks printed on said web by each of said printing sections with a plurality of CCD cameras as image data, each CCD camera reading a separate said register mark and having a CCD sensor with a predetermined CCD coordinate position;

correcting said image data using an inherent correcting means;

calculating reference points of said register marks as a reference coordinate position;

calculating a deviation between actual coordinate positions of said detected reference points and target coordinate positions of said reference points with respect to said CCD coordinate position;

generating an adjusting signal based on said detected deviation;

adjusting a phase of a plate cylinder in said each printing section to automatically adjust registering errors in multi-color rotary presses.

2. A registering error detecting method in accordance with claim 1, wherein:

said register marks have an inherent reference point;

picture element data of said register mark is fetched by scanning a circular CCD sensor of said CCD camera in which a plurality of detecting elements are arranged in a circular shape, said fetching being performed at a timing related to a rotation of said printing section;

said actual coordinate position of said reference point is calculated for said each register mark from said detected picture element data in a coordinate system having an origin at a center of said circular CCD sensor.

3. A registering error detecting method in accordance with claim 2, wherein:

said inherent reference point is a tangible reference point having two lines intersecting with each other in a predetermined relationship.

4. A registering error detecting method in accordance with claim 2, wherein:

said inherent reference point is an intangible reference point established in a predetermined relationship to a corresponding said registration mark.

5. A registering error detecting method in accordance with claim 2, wherein:

said target coordinate position of said register point is predetermined for said each register mark.

6. A registering error detecting method in accordance with claim 2, wherein:

said target coordinate position of said register point is calculated using a reference point coordinate position of a predetermined register mark.

7. A registering error detecting method in accordance with claim 2, wherein:

said calculating of said reference point coordinate position includes scanning an average value of a first picture element number of a line forming a register mark as said circular CCD sensor is scanned, entering a dark area from a bright area, and a last picture element number as scanning clears the dark area, moving to the bright area again, is regarded as a center line position of said line.

8. A registering error detecting method in accordance with claim 1, wherein:

said register marks are one of rectangular and square, said register marks are printed on said web in a direction to traverse a traveling direction of said web;

picture element data of said register marks is fetched by scanning a CCD matrix sensor of said CCD cameras, in which a plurality of detecting elements are arranged, at a timing related to rotation of said printing section, gravity center-coordinate positions of said register marks are calculated from said fetched picture element data of said register marks;

a deviation between said gravity coordinate positions of said register marks and target coordinate positions thereof is calculated to detect registering errors in a multi-color rotary press.

9. A registering error detecting method in accordance with claim 8, wherein:

a logic filter is provided to repair unreadable portions of said register marks prior to calculating said gravity coordinates of said register marks, binarized picture element data on preceding row line and binarized picture element data on succeeding row line, among picture element data on said register marks fetched by said CCD matrix sensor are shifted by each column, and unreadable portions of picture element data in two row lines are repeatedly repaired by said logic filter.

10. A registering error detecting method in accordance with claim 9, wherein:

a majority logic filter is used as said logic filter.

11. A registering error detecting method in accordance with claim 1, wherein:

one of said register marks is a cross-shaped register mark;

picture element data of said register marks is fetched by scanning a CCD matrix sensor of said CCD camera, in which a plurality of detecting elements are arranged in a quadrilateral shape, at a timing related to a rotation of said printing section;

said reference point coordinate position is calculated for each register mark from said fetched picture element data in a coordinate system, said coordinate system having an origin at a predetermined position of said CCD matrix sensor;

a deviation between said reference points and target coordinate positions thereof is calculated to detect registering errors in the multi-color rotary press.

12. A registering error detecting method in accordance with claim 11, wherein:

said target reference point coordinate position of a corresponding register mark is predetermined for each said register mark.

13. A registering error detecting method in accordance with claim 11, wherein:

said target reference point coordinate positions of said register marks are calculated using reference point coordinate positions of predetermined register marks.

14. A registering error detecting method in accordance with claim 1, wherein:

one of said reference marks is a cross-shaped register mark;

a surface of said web including said register marks is photographed with said CCD cameras having a CCD matrix sensor, in which a plurality of detecting elements are arranged in a quadrilateral shape, at a timing related to rotation of said printing section;

picture element data obtained by scanning said CCD matrix sensor is converted into gradation data and stored in a frame memory;

image data on said register marks is detected on a basis of said gradation data stored in said frame memory;

said reference point coordinate position is calculated for said each register mark from said detected image data in a coordinate system, said coordinate system has an origin at a predetermined position of said CCD matrix sensor;

a deviation between said reference point coordinate position and the target reference point coordinate position is determined to detect registering error in a multi-color rotary press.

15. A registering error detecting method in accordance with claim 14, wherein:

window frames are constructed by a first plurality of special detecting elements of said CCD sensor for detecting said register marks, said first plurality of special detecting elements are arranged to form first sides of said quadrilateral CCD matrix sensor in a direction traversing a traveling direction of said web, said window frames are also constructed by a second plurality of special detecting elements arranged to form second sides of said CCD matrix sensor in said web traveling direction, said first and second plurality of special detecting elements are among detecting elements arranged in a quadrilateral shape in said CCD matrix sensor, a memory is provided for storing picture element data on said special detecting elements constituting said window frames, said reference point coordinate positions of said register marks is obtained from said picture element data storing in said memory.

16. A registering error detecting method in accordance with claim 15, wherein:

reference point coordinate positions of said register marks are obtained by calculating the X coordinates of said register mark reference points by adding in a first direction gradation data on said window frames having a plurality of special detecting elements arranged in said direction traverse to said web traveling direction to form the first sides, among said detecting elements arranged in a quadrilateral shape in said CCD matrix sensor, and said sum of said gradation data is converted into binarized data by comparing said sum with a predetermined threshold value, and calculating Y coordinates of said register mark reference points by adding in a second direction gradation data on said window frames having a plurality of special detecting elements arranged in said web traveling direction to form the second sides, and the sum of said gradation data is converted into binarized data by comparing said sum with a predetermined threshold value.

17. A registering error detecting method for multi-color rotary presses as set forth in claim 15 wherein the target reference point coordinate position of said register mark is predetermined for each register mark.

18. A registering error detecting method for multi-color rotary presses as set forth in claim 15 wherein the target reference point coordinate positions of said register marks are determined on the basis of the reference point coordinate positions of predetermined register marks.

19. A registering error detecting method for multi-color rotary presses as set forth in claim 16 wherein the target reference point coordinate position of said register mark is predetermined for each register mark.

20. A registering error detecting method for multi-color rotary presses as set forth in claim 16 wherein the target reference point coordinate positions of said register marks are determined on the basis of the reference point coordinate positions of predetermined register marks.

21. An automatic register control system for multi-color rotary presses, the system comprising:

a web;

a plurality of printing sections printing on said web as said web travels through said plurality of printing sections, each of said plurality of printing sections having a plate cylinder for printing a predetermined color and corresponding register mark on said web, each register mark having a reference point;

a registering error detecting device including separate CCD camera means for each said printing section, each said CCD camera reading a corresponding said register mark printed on said web as image data, said each CCD camera also having a CCD sensor with a predetermined CCD coordinate position, said detecting device including inherent correcting means for correcting said image data, said detecting device also having calculating means for calculating an actual coordinate position of said reference point of said register marks in relation to respective said CCD coordinate position, and for calculating a deviation between said actual coordinate position of said reference point and a target coordinate position of said reference point;

adjusting signal means for generating an adjusting signal based on said deviation detected by said registering error detecting device;

an adjusting means for receiving said adjusting signal and adjusting the phase of a plate cylinder in each printing section to automatically adjust registering errors in the multi-color rotary presses.

22. An automatic register control system in accordance with claim 21, wherein:

said register marks have one of an inherent, tangible and intangible reference point;

said CCD sensor is circular with a plurality of detecting elements are arranged in a circular shape so as to detect one register mark simultaneously, and adjustable to a printing position of said register mark;

a scanning start signal generating means for generating a signal to start scanning of said CCD sensor at a timing related to a rotation of a respective said printing section;

said calculating means fetching picture element data detected by said CCD sensor at a start of scanning, and calculating a deviation between said coordinate position of said reference point of said register mark and said target coordinate position of said reference point in a coordinate system, said coordinate system having an origin at a center of said CCD sensor.

23. An automatic register control system in accordance with claim 22, further comprising:

a display means for displaying said deviation calculated by said calculating means, said display means displaying a failure of adjustment due to said deviation exceeding a predetermined value.

24. An automatic register control system in accordance with claim 21, wherein:

a plurality of one of rectangular and square register marks are printed on said web in a direction traversing a traveling direction of said web for each printing section, said CCD sensor is a matrix sensor with a plurality of detecting elements to detect one register mark simultaneously, and adjustable to a printing position of said register mark;

a scanning start signal generating means for generating a signal to start scanning of said CCD sensor at a timing related to a rotation of a respective said printing section;

a gravity coordinate calculating means for fetching picture element data detected by said CCD sensor at a start of scanning, and calculating an actual gravity coordinate positions of said register marks based on said picture element data on said register marks fetched by said CCD sensor;

a deviation calculating means for calculating a deviation between said actual gravity coordinate positions of said register marks and target coordinate positions of gravity coordinate positions.

25. An automatic register control system in accordance with claim 24, further comprising:

a logic filter provided in front of said gravity coordinate calculating means an image repairing means for repairing unreadable said register marks by shifting by each column of binarized said picture element data on a preceding row line and said binarized picture element data on a succeeding row line among the picture element data on said register marks fetched by said CCD matrix sensor, and repeating repair of unreadable portions via said logic filter.

26. An automatic register control system in accordance with claim 24, further comprising:

display means for displaying said deviation calculated by said calculating means, said display means displaying an alarm when one of said register marks cannot be detected in a predetermined state, and when said calculated deviation is larger than a predetermined value.

27. An automatic register control system in accordance with claim 21, wherein:

said CCD camera has a quadrilateral CCD matrix sensor with a plurality of detecting elements arranged as one side thereof in such a manner as to simultaneously detect one register mark and movable in accordance with a printing positions of said register mark;

timing generating means for generating a signal for starting a scanning of said CCD matrix sensor at a timing related to a rotation of said printing section;

said calculating means calculates a deviation by fetching picture element data detected by said CCD matrix sensor by scanning, and comparing a coordinate position of said reference point of said register mark with a target coordinate position of said reference point thereof to calculate a deviation in a coordinate system, said coordinate system having an origin at a predetermined position of said CCD matrix sensor.

28. An automatic register control system in accordance with claim 27, wherein:

said quadrilateral CCD matrix sensor has window frames for detecting a plurality of said register marks, said window frames including a first plurality of special detecting elements forming first sides of said quadrilateral CCD matrix sensor, said first sides being arranged in a direction traverse to said traveling direction of said web, said window frames including a second plurality of special detecting elements forming second sides of said quadrilateral CCD matrix sensor, said second sides being arranged in said traveling direction of said web;

said calculating means has a memory for storing picture element data of said special detecting elements, said calculating means calculating coordinate positions of said reference points of said register marks from said picture element data stored in said memory.

29. An automatic register control system in accordance with claim 28, wherein:

said calculating means has a reference coordinate value register for latching said target coordinate positions of said reference points of said register marks, said target reference point coordinate positions of said register marks being latched in said reference coordinate value register prior to operation of the automatic register control system.

30. An automatic register control system in accordance with claim 28, wherein:

said calculating means has a reference coordinate value register for latching said coordinate positions of said reference points of predetermined said register marks, said target reference point coordinate positions of said register marks being calculated using said reference point coordinate positions of said predetermined register marks.

31. An automatic register control system in accordance with claim 28, further comprising:

display means for displaying a deviation calculated by said calculating means, and displaying failure of adjustment due to said deviation exceeding a predetermined value.

* * * * *